US008135332B2

(12) United States Patent
Kikkoji et al.

(10) Patent No.: US 8,135,332 B2
(45) Date of Patent: Mar. 13, 2012

(54) INFORMATION PROCESSING DEVICE, INFORMATION PROCESSING METHOD, AND INFORMATION PROCESSING PROGRAM

(75) Inventors: Hiroyuki Kikkoji, Tokyo (JP); Nozomu Okuzawa, Tokyo (JP); Shinsuke Yamashita, Kanagawa (JP); Jun Moriya, Tokyo (JP); Yasuhiro Murase, Tokyo (JP)

(73) Assignee: Sony Corporation, Tokyo (JP)

( * ) Notice: Subject to any disclaimer, the term of this patent is extended or adjusted under 35 U.S.C. 154(b) by 1063 days.

(21) Appl. No.: 10/557,040

(22) PCT Filed: May 18, 2004

(86) PCT No.: PCT/JP2004/007027

§ 371 (c)(1),
(2), (4) Date: Nov. 16, 2005

(87) PCT Pub. No.: WO2005/006612

PCT Pub. Date: Jan. 20, 2005

(65) Prior Publication Data

US 2007/0056003 A1 Mar. 8, 2007

(30) Foreign Application Priority Data

| | | |
|---|---|---|
| Jul. 14, 2003 | (JP) | 2003-274302 |
| Aug. 11, 2003 | (JP) | 2003-291741 |
| Sep. 4, 2003 | (JP) | 2003-313167 |
| Sep. 29, 2003 | (JP) | 2003-338814 |

(51) Int. Cl.
*H04H 20/71* (2008.01)

(52) U.S. Cl. ..... 455/3.01; 455/3.02; 455/3.06; 455/66.1; 725/101; 725/106; 725/64; 725/136

(58) Field of Classification Search ..... 455/3.06, 455/66.1, 412.1, 3.01, 3.02, 3.04, 2.01; 725/87, 725/101, 109–115, 89, 22, 62, 63, 74, 86, 725/136, 142, 141
See application file for complete search history.

(56) References Cited

U.S. PATENT DOCUMENTS 6,205,419 B1 * 3/2001 Fiedler ..... 704/201
(Continued)

FOREIGN PATENT DOCUMENTS

CN 1304108 A 7/2001
(Continued)

OTHER PUBLICATIONS

U.S. Appl. No. 10/526,902, filed Aug. 16, 2005, Yamashita et al.
(Continued)

*Primary Examiner* — Sujatha Sharma
(74) *Attorney, Agent, or Firm* — Oblon, Spivak, McClelland, Maier & Neustadt, L.L.P.

(57) ABSTRACT

Set information including information identifying one or more areas of operation of a broadcast terminal apparatus and a user ID, and broadcast-station information including a name and an identification data item of a broadcast station are stored. The broadcast-station information is stored in association with an area in which a broadcast signal output by the broadcast station can be received. An information-processing apparatus includes a detecting unit that retrieves the name or the identification data item of the broadcast station upon a reception of information identifying one of the one or more areas of operation and the user ID. The information-processing apparatus also includes a transmitting/receiving unit that receives the reception, transmits a transmission of the name or the identification data item of the broadcast station upon the reception, and receives an indicator of the broadcast station and an indicator of the user ID in response to the transmission.

10 Claims, 20 Drawing Sheets

U.S. PATENT DOCUMENTS

| | | | | |
|---|---|---|---|---|
| 6,272,472 | B1 * | 8/2001 | Danneels et al. | 705/27 |
| 6,505,160 | B1 * | 1/2003 | Levy et al. | 704/270 |
| 6,912,431 | B2 * | 6/2005 | Kim et al. | 700/83 |
| 7,164,882 | B2 * | 1/2007 | Poltorak | 455/3.06 |
| 7,191,467 | B1 * | 3/2007 | Dujari et al. | 726/5 |
| 7,546,626 | B2 * | 6/2009 | Ohnuma | 725/136 |
| 2002/0164004 | A1 * | 11/2002 | Tamura et al. | 379/93.12 |
| 2002/0174436 | A1 * | 11/2002 | Wu et al. | 725/87 |
| 2003/0003909 | A1 * | 1/2003 | Keronen et al. | 455/434 |
| 2005/0060701 | A1 | 3/2005 | Murase | |
| 2005/0091679 | A1 | 4/2005 | Tanaka et al. | |
| 2007/0060112 | A1 * | 3/2007 | Reimer | 455/414.2 |
| 2007/0245373 | A1 * | 10/2007 | Shivaji-Rao et al. | 725/35 |

FOREIGN PATENT DOCUMENTS

| | | |
|---|---|---|
| JP | 10-177532 | 6/1998 |
| JP | 11-239067 | 8/1999 |
| JP | 2000-222360 | 8/2000 |
| JP | 2001-125914 | 5/2001 |
| JP | 2001-157136 | 6/2001 |
| JP | 2002-135671 | 5/2002 |
| JP | 2002-358283 | 12/2002 |
| JP | 2003-18108 | 1/2003 |
| JP | 2003-067661 | 3/2003 |
| JP | 2003-92556 | 3/2003 |
| JP | 2003-101898 | 4/2003 |
| JP | 2003-158730 | 5/2003 |

OTHER PUBLICATIONS

U.S. Appl. No. 10/554,542, filed Oct. 25, 2005, Iwatsu et al.
U.S. Appl. No. 10/564,317, filed Jan. 12, 2006, Kikkoji et al.
U.S. Appl. No. 10/557,207, filed Nov. 17, 2005, Kikkoji et al.
U.S. Appl. No. 10/555,654, filed Nov. 4, 2005, Kikkoji et al.
U.S. Appl. No. 10/556,944, filed Nov. 16, 2005, Kikkoji et al.
U.S. Appl. No. 10/563,258, filed Jan. 4, 2006, Iwatsu et al.
U.S. Appl. No. 10/557,141, filed Nov. 17, 2005, Murse et al.
U.S. Appl. No. 10/556,728, filed Nov. 14, 2005, Iwatsu et al.
U.S. Appl. No. 10/563,315, filed Jan. 4, 2006, Iwatsu et al.
U.S. Appl. No. 10/557,193, filed Nov. 17, 2005, Kikkoji et al.
U.S. Appl. No. 10/566,630, filed Jan. 31, 2006, Sakoh et al.
U.S. Appl. No. 10/561,187, filed Dec. 16, 2005, Araki et al.
U.S. Appl. No. 10/565,965, filed Jan. 26, 2006, Iwatsu.
U.S. Appl. No. 10/564,058, filed Jan. 10, 2006, Kikkoji et al.
U.S. Appl. No. 10/556,893, filed Nov. 15, 2005, Sakoh et al.
U.S. Appl. No. 10/557,040, filed Nov. 16, 2005, Kikkoji et al.
U.S. Appl. No. 10/556,729, filed Nov. 14, 2005, Kikkoji et al.
U.S. Appl. No. 10/555,990, filed Nov. 8, 2005, Murase et al.
U.S. Appl. No. 10/560,229, filed Dec. 12, 2005, Kikkoji et al.
U.S. Appl. No. 10/564,062, filed Jan. 10, 2006, Kikkoji et al.
U.S. Appl. No. 10/567,689, filed Feb. 9, 2006, Kikkoji et al.
U.S. Appl. No. 10/567,033, filed Feb. 3, 2006, Sakoh et al.
U.S. Appl. No. 10/572,743, filed Mar. 21, 2006, Kikkoji et al.
U.S. Appl. No. 10/564,414, filed Jan. 12, 2006, Sakoh et al.
U.S. Appl. No. 10/571,540, filed Mar. 10, 2006, Sakoh et al.
U.S. Appl. No. 10/567,776, filed Feb. 9, 2006, Iwatsu et al.
U.S. Appl. No. 10/568,968, filed Feb. 22, 2006, Okuzawa.
U.S. Appl. No. 10/569,227, filed Feb. 23, 2006, Yasuda.
U.S. Appl. No. 10/573,580, filed Mar. 24, 2006, Sakoh et al.
U.S. Appl. No. 10/573,418, filed Mar. 27, 2006, Iwatsu et al.
U.S. Appl. No. 10/571,458, filed Mar. 13, 2006, Iwatsu et al.
U.S. Appl. No. 10/571,774, filed Mar. 15, 2006, Sakoh et al.
U.S. Appl. No. 10/573,647, filed Mar. 28, 2006, Kikkoji et al.

* cited by examiner

14A BROADCAST-STATION INFORMATION DATABASE

141

| AREA BLOCK | RADIO STATION | | |
|---|---|---|---|
| | CALL SIGN | STATION NAME | FREQUENCY |
| METROPOLITAN AREA | JOAU | FM TOKYO | 80.0 |
| METROPOLITAN AREA | JOAU | FM TOKYO | 76.7 |
| METROPOLITAN AREA | JOAU | FM TOKYO | 84.3 |
| METROPOLITAN AREA | JOAV | J-WAVE | 81.3 |
| METROPOLITAN AREA | JOTU | FM YOKOHAMA | 84.7 |
| METROPOLITAN AREA | JOTU | FM YOKOHAMA | 80.2 |
| METROPOLITAN AREA | ... | ... | ... |
| METROPOLITAN AREA | JOKG | NHK-YAMANASHI | 84.7 |
| ... | ... | ... | ... |

FIG. 4

142 LIST INFORMATION

| STATION NAME | CALL SIGN |
|---|---|
| FM TOKYO | JOAU |
| J-WAVE | JOAV |
| FM YOKOHAMA | JOYU |
| ... | ... |
| NHK-YAMANASHI | JOKG |
| ... | ... |

FIG. 5

INFORMATION PROCESSING DEVICE, INFORMATION PROCESSING METHOD, AND INFORMATION PROCESSING PROGRAM

TECHNICAL FIELD

The present invention relates to an information-processing apparatus, an information-processing method and an information-processing program. More particularly, the invention relates to an information-processing apparatus to be connected by a network to broadcast terminal apparatuses that receive broadcast signals, an information-processing method for use in the apparatus, and an information-processing program for use in the apparatus.

BACKGROUND ART

Hitherto known are broadcast terminal apparatuses that receive broadcast signals transmitted from radio stations and television stations. Each broadcast terminal apparatus demodulates the broadcast signals, enabling the user to listen to a program such as music and to review the broadcast contents information that the broadcast station discloses on the Internet. Among the broadcast contents information are: the tile of the music broadcast in the program, the player of the music, the name or number of the compact disc (CD) in which the music is recorded.

The frequencies at which each broadcast station transmits signals are assigned to various receiving areas (in which the same program can be received on the same channel), one frequency to one receiving area. This is because signals transmitted at a specific frequency can be received in a limited area. In other words, the program broadcast at a frequency cannot be received in different areas. This is why any broadcast terminal apparatus designed to receive the broadcast signals has a tuner-preset function (hereinafter referred to as "preset function"). Having this function, the broadcast terminal apparatus can automatically set the receiving channel for the area in which it is located. A user of the broadcast terminal apparatus activates the preset function when he or she starts using the broadcast terminal apparatus or moves into a new receiving area. The receiving channel for the new area is thereby set.

Audio playback apparatuses are known, which are installed in moving bodies such as automobiles and which receive broadcast signals while moving from one receiving area to another. The audio playback apparatus identifies the receiving area on the basis of the position information it acquires from the global positioning system (GPS). Then, it automatically sets the receiving channel assigned to the receiving area. (Such an audio playback apparatus is disclosed in Jpn. Pat. Appln. Laid-Open Publication No. 8-5392, paragraphs [0006] to [0012], FIG. 1.)

The user of the broadcast terminal apparatus may select the channel that the preset function has set. He or she can then listen to the program being presented by the desired broadcast station. At this time, the broadcast terminal apparatus identifies the broadcast station from which it is receiving signals. The broadcast terminal apparatus acquires the information that represents the distributor of the information about the contents being broadcast by the broadcast station. This information has been specified by an information-processing apparatus that provides various data items via the Internet. Then, the broadcast terminal apparatus acquires the broadcast contents information via the Internet. A display provided on the broadcast terminal apparatus displays this information.

The user can therefore review the information about the contents being received, while listening to the program.

With the conventional broadcast terminal apparatus, however, the information that the user can review is limited to the information about the contents being broadcast from the broadcast station selected.

Hitherto, the broadcast terminal apparatus acquires the information about the contents being broadcast, exclusively from the broadcast station that the user has selected. The broadcast station is identified by referring to a table of broadcast stations against the frequency at which the program is being received at the broadcast terminal apparatus. Since the broadcast station is thus automatically identified, the user need not select the broadcast station. However, the user must select any other broadcast station in order to review the information about the broadcast contents that the other station is broadcast.

The user needs to review the information about any broadcast stations other than the one from which the broadcast terminal apparatus is receiving signals, or the information about the broadcast station from which the broadcast terminal apparatus is not receiving signals. To enable him or her to do so, the display on the broadcast terminal apparatus displays a list of all broadcast stations covering all areas. This list is so large that it is troublesome for the user much to find the broadcast station he or she wants. The more broadcast stations the list shows, the longer the time the user spends to find and select the desired broadcast station.

With the conventional broadcast terminal apparatus, the user must take much trouble to select the broadcast station he or she wants. Thus, the user cannot review the information about the contents being broadcast from the broadcast stations other than the broadcast station that is transmitting the signals the broadcast terminal apparatus is receiving. Therefore, the broadcast terminal apparatus is not so useful.

The broadcast terminal apparatus may not contain the list of broadcast stations. Instead, the broadcast terminal apparatus may be connected via a network to an information-processing apparatus that provides various data items, to acquire a list of the broadcast stations all over the nation. Even in this case, the user still needs to spend much time to find and select the broadcast station he or she wants. To make the matter worse, a great amount of data should be transmitted between the information-processing apparatus and the broadcast terminal apparatus. This inevitably increases the load on both the information-processing apparatus and the broadcast terminal apparatus.

DISCLOSURE OF THE INVENTION

This invention has been made in view of the foregoing. An object of the invention is to provide an information-processing apparatus that enables a broadcast terminal apparatus to display the broadcast contents information disclosed by broadcast stations, no matter whether the broadcast terminal apparatus is receiving broadcast signals, and to provide an information-processing method and an information-processing program, both for use in the information-processing apparatus.

To achieve the object, the present invention provides an information-processing apparatus that enables a user of a broadcast terminal apparatus to review the broadcast content information that the broadcast station selected by the user of the broadcast terminal apparatus discloses on a network. The information-processing apparatus is to be connected via a network to a broadcast terminal apparatus that can receive and reproduce broadcast signals and can display the information about the contents that the broadcast station discloses on the network. The information-processing apparatus comprises: a user-set information storing means for storing set information input by the user and corresponding to the broadcast terminal apparatus; a broadcast-station information storing means for storing broadcast-station information in association with an area where broadcast signals output by broadcast stations can be received, said broadcast-station information containing the names and identification data items of the broadcast stations; a detecting means for detecting, from the set information, broadcast stations from which the broadcast terminal apparatus can receive signals, and for generating list information; and a transmitting/receiving means for transmitting the list information to the broadcast terminal apparatus.

In this information-processing apparatus, the broadcast-station information storing means stores broadcast-station information in association with an area where broadcast signals output by broadcast stations can be received, and the broadcast-station information contains the names and identification data items of the broadcast stations. The user-set information storing means stores the set information input by the user and corresponding to the broadcast terminal apparatus. The set information includes, for example, the personal data items of the user and the information about the area in which the broadcast terminal apparatus is used. The personal data items are the postal code, the address, the phone number, and the like. The detecting means detects, from the set information, broadcast stations from which the broadcast terminal apparatus can receive signals. The detecting means then extracts, from the broadcast-station information, the identification data items and names of the broadcast stations corresponding to the broadcast stations detected, and generates list information. If necessary, the other data items contained in the broadcast-station information can be added to the list information. The transmitting/receiving means transmits the list information to the broadcast terminal apparatus.

Thus, any broadcast terminal apparatus can obtain the list information that is composed of data items about the broadcast stations from which the broadcast terminal apparatus can receive signals. The list information is transmitted to the broadcast terminal apparatus via the network. Once the broadcast terminal apparatus has acquired the information about the contents broadcast by the broadcast stations included in the list information, the user can review the information about the contents, no matter whether the broadcast terminal apparatus is not receiving signals from these broadcast stations.

To attain the object described above, the present invention provides an information-processing method of providing information that enables the user of a broadcast terminal apparatus capable of receiving and reproducing broadcast signals, to review the information about the contents that the broadcast stations disclose on a network, the broadcast terminal apparatus has functions of receiving and reproducing broadcast signals and displaying the information about the contents that the broadcast station discloses.

In this information-processing method, broadcast-station information stored in association with an area, where broadcast signals output by broadcast stations can be received, and containing the names and identification data items of the broadcast stations is retrieved in accordance with the set information input by a user and corresponding to the broadcast terminal apparatus, thereby detecting broadcast-station information about broadcast stations from which the broadcast terminal apparatus can receive the broadcast signals. Then, at least the names and identification data items of the broadcast stations detected are extracted from the broadcast-station information, thereby generating list information. The list information is transmitted to the broadcast terminal apparatus.

Hence, any broadcast terminal apparatus can obtain the list information that is composed of names and identification data items about the broadcast stations from which the broadcast terminal apparatus can receive signals. The list information is transmitted to the broadcast terminal apparatus via the network. Once the broadcast terminal apparatus has acquired the information about the contents broadcast by the broadcast stations included in the list information, the user can review the information about the contents, no matter whether the broadcast terminal apparatus is not receiving signals from these broadcast stations.

In the information-processing apparatus according to this invention, the broadcast stations from which the broadcast terminal apparatus can receive signals are detected in accordance with the set information input by the user of the broadcast terminal apparatus. List information is generated, which contains the names and identification data items of these broadcast station. The list information is transmitted to the broadcast terminal apparatus. The list information, which shows the broadcast stations from which the broadcast terminal apparatus can receive signals, is input to the broadcast terminal apparatus. Only a few broadcast stations are located in the receiving area of the broadcast terminal apparatus. Hence, the list information shows a small number of broadcast stations. This makes it easy for the user to select any desired broadcast station, and reduces the amount of data that must be exchanged between the broadcast terminal apparatus and the information-processing apparatus.

As a result, the user can select any broadcast station he or she wants and can review the information about the contents the broadcast station provides, by performing a simple operation on the broadcast terminal apparatus, whether the broadcast terminal apparatus is receiving broadcast signals or not.

In the information-processing method according to this invention, the broadcast-station information is retrieved in accordance with the set information about the broadcast terminal apparatus, which has been input by the user of the broadcast terminal apparatus. The information about the broadcast stations, from which the broadcast terminal apparatus can receive signals, is extracted from the broadcast-station information, thus generating list information. The list information is transmitted to the broadcast terminal apparatus. The broadcast terminal apparatus displays the list of the broadcast stations from which it can receive signals. Seeing the list, the user can select any broadcast station he or she wants for displaying the broadcast content information. The list shows a small number of broadcast stations. This makes it easy for the user to select any desired broadcast station.

Therefore, the user can select any broadcast station he or she wants and can review the information about the contents the broadcast station provides, by performing a simple operation on the broadcast terminal apparatus, whether the broadcast terminal apparatus is receiving broadcast signals or not.

BRIEF DESCRIPTION OF THE DRAWINGS

FIG. 4 is a diagram showing an example of the broadcast station information database;

FIG. 5 is a diagram showing an example list information;

BEST MODE FOR CARRYING OUT THE INVENTION

Embodiments of the present invention will be described, with reference to the accompanying drawings.

(1) Fundamental Concept of the Invention

The concept of this invention will first be explained. Then, the embodiments of the invention will be described in detail.

Figure 1:
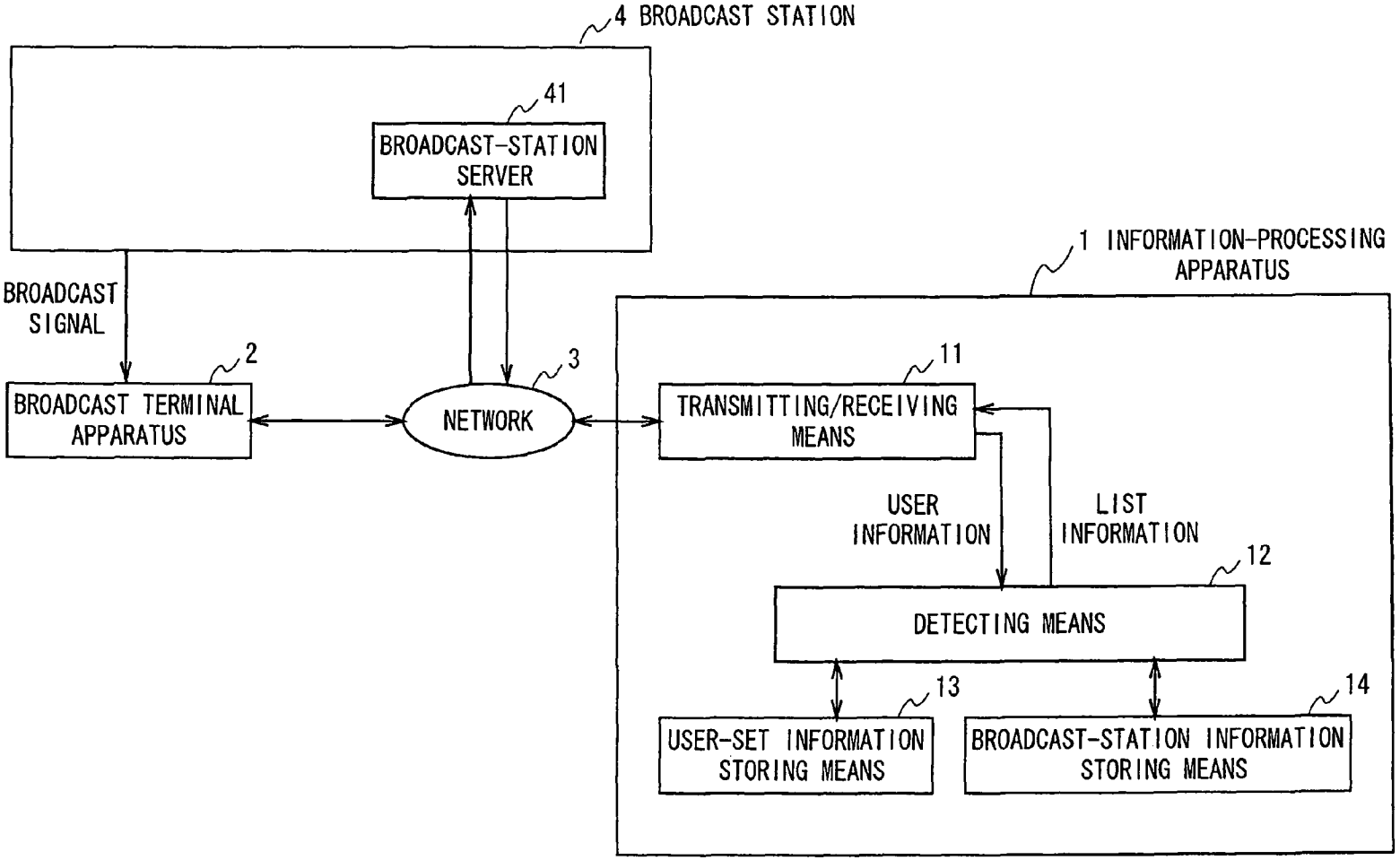
FIG. 1 is a diagram representing the concept of this invention, which is applied to embodiments.

FIG. 1 is a diagram representing the concept of the invention, which is applied to embodiments.

An information-processing apparatus 1 according to the present invention is connected to a broadcast terminal apparatus 2 and a broadcast-station server 41 by a network 3. A broadcast station 4 controls the broadcast-station server 41.

The broadcast terminal apparatus 2 has the function of receiving and playing back the broadcast signals transmitted from the broadcast station 4. It also has the function of review the information about the broadcast contents distributed by the broadcast-station server 41 of the broadcast station 4 that is connected to the broadcast terminal apparatus 2 by the network 3. The broadcast terminal apparatus 2 acquires the list information about the broadcast stations transmitting broadcast signals that it can receive from the information-processing apparatus 1 connected to it by the network 3. The broadcast terminal apparatus 2 uses the list information to select a broadcast station from which it will obtain the broadcast contents information to be reviewed.

The broadcast station 4 transmits particular broadcast contents on a broadcast signal of a predetermined frequency. It manages the broadcast-station server 41 that is connected to the network 3. The broadcast-station server 41 performs the service of providing the information about the contents that the broadcast stations 4 broadcasts.

The information-processing apparatus 1 has a transmitting/receiving means 11, a detecting means 12, a user-set information storing means 13, and a broadcast-station information storing means 14. The transmitting/receiving means 11 transmits and receives information via the network 3. The detecting means 12 detects data items related to any information preset and generates a list of the data items detected. The user-set information storing means 13 stores the user information that the user has set. The broadcast-station information storing means 14 stores the broadcast station information about the broadcast stations. Having these means, the information-processing apparatus 1 can select any broadcast stations from which the broadcast terminal apparatus 2 can receive broadcast signals. It performs the service of providing the information about the broadcast stations selected.

The transmitting/receiving means 11 controls the transmitting and receiving information between the information-processing apparatus 1 and the broadcast terminal apparatus 2 via the network 3. More precisely, the means 11 receives information from the broadcast terminal apparatus 2 via the network 3 and outputs this information to the detecting means 12. The means 11 receives information from the detecting means 12 and transmits the information to the broadcast terminal apparatus 2 via the network 3.

The user-set information storing means 13 is a memory device that stores the information that the user has set into the broadcast terminal apparatus 2. To receive the information-providing service from the information-processing apparatus 1, the user applies for the service to the information-processing apparatus 1. That is, the user has his personal information (the postal code, address, phone number, mail address, etc.) registered. The registered information includes the information about the areas in which the broadcast terminal apparatus 2, which may receive the service, will be used. To have his or her personal information registered, the user may use the broadcast terminal apparatus 2. The user may employ any other method of registering his or her personal information. For example, the user may send a mail. The information-processing apparatus 1 assigns the user's registration information to the user ID such as user identification information, generating a database item. The database item is recorded in the user-set information storing means 13.

The broadcast-station information storing means 14 is a storage device that stores the information about the broadcast-station server 41 that is managed by the broadcast station 4. This information is associated with the areas that the broadcast-station server 41 covers. The information about the broadcast station includes the name and identification (ID)

information of the broadcast station. The broadcast signal the broadcast station 4 transmits can be received, but in limited areas. Therefore, in the information-processing apparatus 1, the broadcast-station information storing means 14 stores the broadcast-station information as a database item associated with the areas in which the broadcast signal can be received.

Upon receipt of the user ID data from the transmitting/receiving means 11, the detecting means 12 determines the area in which the broadcast terminal apparatus 2 is being used, from the user-set information that corresponds to the user ID data. The detecting means 12 generates a list of the broadcast stations that transmit signals that can be received in the areas determined. This list is transmitted to the broadcast terminal apparatus 2 by using the transmitting/receiving means 11.

Assume that the user makes a log-in at the broadcast terminal apparatus 2. The user ID data such as the user's ID code is then input to the information-processing apparatus 1. In the apparatus 1, the detecting means 12 searches the user-set information storing means 13 in accordance with the user ID data and extracts the user-set information about the user. The detecting means 12 refers to the data items about the area, which are contained in the user-set information and which includes the postal code, address, phone number, etc., determining the area where the broadcast terminal apparatus 2 is being used. Next, the detecting means 12 searches the broadcast-station information storing means 14 in accordance with the area thus determined and extracts the broadcast stations that transmit signals that can be received in the areas determined. The means 12 then extracts the names and ID data items about the broadcast stations extracted and generates list information of these broadcast stations. More specifically, the detecting means 12 correlates the specified area with the areas associated with the broadcast-station information and extracts the name and ID data about the broadcast station from the broadcast-station information associated with the area found identical to the specified area. Thus the means 12 generates list information. If necessary, the data items of other broadcast stations are extracted and added to the list information. The information-processing apparatus 1 transmits the list information, thus generated, to the broadcast terminal apparatus 2.

The address of the user may change after the user has been registered. Further, the user may want to have information about the broadcast stations that transmit signal that can be received in some areas other than the registered address. In view of this, the information-processing apparatus 1 may be designed to transmit the information representing the area and read from the user-set information storing means 13, to the broadcast terminal apparatus 2 via the transmitting/receiving means 11. This enables the user to recognize the area. When the user recognizes the area, he or she may want to have information about some other areas. If so, the user sets information about the other areas. The information set by the user is transmitted from the broadcast terminal apparatus 2 via the network 3 to the information-processing apparatus 1. In the information-processing apparatus 1, the detecting means 12 searches the broadcast-station information storing means 14 in accordance with the user-set area information. The process performed thereafter is identical to the process that has been described above. The information-processing apparatus 1 may ask the user of the broadcast terminal apparatus 2 for the information about the area. In this case, the apparatus 1 can determine the broadcast stations that transmit signals that can be received in that area, without the necessity of retrieving the user-set information.

How the information-processing apparatus 1 of the configuration described above operates will be explained.

The information-processing apparatus 1 has the user-set information. The user-set information is stored in the user-set information storing means 13 and contains the information about the areas in which the user may use the broadcast terminal apparatus 2. The apparatus 1 has the broadcast station information, too. The broadcast station information is stored in broadcast-station information storing means 14 and contains the names and ID data items of the broadcast stations. The broadcast station information is stored in the means 14, in association with the areas where the signals from these broadcast stations can be received.

Assume that the user makes a log-in at the broadcast terminal apparatus 2, in order to receive a service. Then, the information-processing apparatus 1 receives the user ID data transmitted from the broadcast terminal apparatus 2, then input the user ID data to the detecting means 12 via the transmitting/receiving means 11. The detecting means 12 searches the user-set information of the user-set information storing means 13 in accordance with user ID data and extracts the information about areas from the user-set information. From the information, the detecting means 12 determines the area in which the broadcast terminal apparatus 2 is being used. Thereafter, the information-processing apparatus 1 may cause the broadcast terminal apparatus 2 to ask the user whether the user wishes to retrieve the broadcast station information in the area that the detecting means 12 has determined. In the information-processing apparatus 1, the broadcast station information is retrieved from the broadcast-station information storing means 14 in accordance with the information about the area determined or about the area set again into the broadcast terminal apparatus 2. From the broadcast station information, the detecting means 12 determines the broadcast stations transmitting signals that the broadcast terminal apparatus 2 can receive. The detecting means 12 then generates list information containing the names and ID data items about the broadcast stations thus determined. The information-processing apparatus 1 transmits the list information, thus generated, to the broadcast terminal apparatus 2.

Thus, the information-processing apparatus 1 according to this invention automatically detects the broadcast stations from which the broadcast terminal apparatus 2 can receive signals, in accordance with the user-set information. The apparatus 1 then generates and transmits list information. The list information represents only the broadcast stations from which the broadcast terminal apparatus 2 can receive signals while it exists in the limited areas. Therefore, the list information is not so great an amount of data.

The display on the broadcast terminal apparatus 2 displays a list of the broadcast stations from which the apparatus 2 can receive broadcast contents. More correctly, the display shows a list of the names of these broadcast stations, one of which the user may designate to select the broadcast station. The list displayed does not show so many broadcast stations because the apparatus 2 can receive signals from only a few broadcast stations while it exists in the limited areas. This makes it easy for the user to select a broadcast station. The information about the contents that each broadcast station provides on the network is data items concerning a program, such as the title of music, the name of the player, etc. In most cases, the user need not acquire information about the broadcast stations from which the broadcast terminal apparatus 2 cannot receive any programs. This is why the display on the apparatus 2 only needs to display a list of only the broadcast stations from which the apparatus 2 can receive signals.

When the user selects one of the broadcast stations displayed, the broadcast terminal apparatus 2 extracts the ID data about the broadcast station from the list information. On the basis of the ID data, the apparatus 2 designates the broadcast-station server 41 installed in the broadcast station that distributes the broadcast contents. Next, the apparatus 2 acquires the information about the broadcast contents from the broadcast-station server 41. The display on the apparatus 2 displays the information about the broadcast contents.

The broadcast terminal apparatus 2 can thus obtain the list information about the broadcast stations from which it can receive signals when its user performs a log-in. Using the list information, the broadcast terminal apparatus 2 displays a broadcast-station selection menu, which shows the information about the broadcast contents. The user can therefore easily select a desired broadcast station to review the information about the broadcast contents.

(2) First Embodiment

A first embodiment of the invention will be described in detail, with reference to the accompanying drawings. The first embodiment is an integrated service server that provides various types of services to terminal apparatuses that can receive the FM-broadcast signals and TV-broadcast signals that represent musical pieces. In the following description, the process of saving the information about musical pieces or a set of musical pieces will be referred to as "clip."

Figure 2:
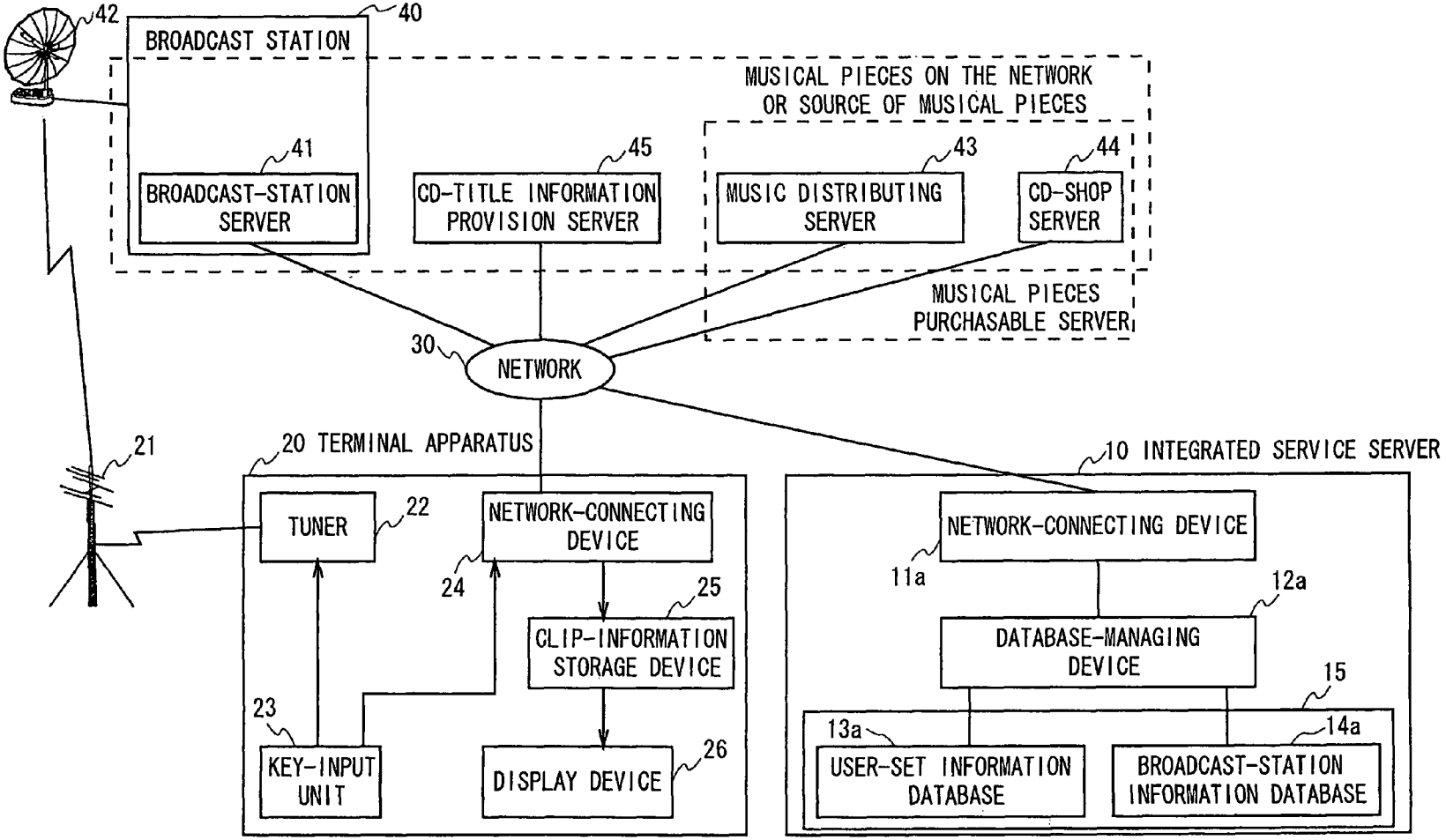
FIG. 2 is a block diagram of a network system according to a first embodiment of the invention.

FIG. 2 is a diagram depicting a network system related to the first embodiment. The network system comprises a terminal apparatus 20 and a network 30. The network 30 is, for example, the Internet. The network 30 connects the terminal apparatus 20, which is a broadcast terminal apparatus, to various server servers. The servers are an integrated service server 10, a broadcast-station server 41, a music distributing server 43, a CD-shop server 44, and a CD-title information server 45.

The broadcast-station server 41 provides contents information. The server 41 is managed by a broadcast station 40 that broadcasts FM programs and TV programs. The broadcast station 40 has an antenna 42, which transmits radio signals. The contents information represents the contents that the broadcast station 40 broadcast. The contents are, for example, music programs.

The broadcast-station server 41 provides the music content information in, broadly speaking, two modes. The first mode is "now on-air," in which the server 41 provides the information about the music being broadcast at present. In the second mode, the server 41 provides a list of music programs (or an on-air list) the broadcast station 40 has already broadcast. (The on-air list contains information about each musical piece that has been broadcast). The broadcast-station server 41 provides information about musical pieces broadcast on a specified program and information about musical pieces broadcast in a specified period.

The CD-title information server 45 distributes the information about the musical pieces recorded in CDs that are commercially available.

The music distributing server 43 distributes digital data representing musical pieces (music data items). It provides the music data to the terminal apparatus 20 only if the user of the apparatus 20 has taken procedures to buy the musical pieces. The server 43 can provide the information about the musical pieces that the broadcast station 40 is to broadcast.

The CD-shop server 44 receives the order the user makes to buy CDs. The server 44 can distribute promotion audio data and provide the information about the musical pieces recorded in the CDs that the CD shops sell.

The integrated service server 10, which is an information-processing apparatus, functions as a portal site where services are given via the network 30. In other words, the server 10 conveys services. The integrated service server 10 distributes to the terminal apparatus 20 the list information about the broadcast stations from which the terminal apparatus 20 can receive signals. The server 10 distributes the information representing the sources of the musical pieces broadcast, too, to the terminal apparatus 20. This information is, for example, URL (Uniform Resource Locator) that the broadcast-station server 41 discloses to the public. The integrated service server 10 will be later described in more detail.

Thus, a plurality of servers performs the service of providing the information about music pieces or a set of musical pieces on the network 30. That is, each server works as a source of the music program or a set of musical pieces on the network 30.

The music distributing server 43 and the CD-shop server 44 are a musical pieces purchasable server. If the user may operate the terminal apparatus 20, accessing the musical pieces purchasable server, he or she can buy musical pieces or a set of musical pieces. The user of the terminal apparatus 20 may take procedures to the music distributing server 43 in order to buy musical pieces. In this case, the music data can be down-loaded from the server 43 into the terminal apparatus 20. The user may also take procedures to the CD-shop server 44 in order to buy musical pieces. Then, the user can have the CD delivered to his or her home.

The terminal apparatus 20 comprises a broadcast signal receiving unit that has an antenna 21, a tuner 22 and a key-input unit 23. The apparatus 20 can therefore receive the broadcast contents contained in the broadcast signals that the antenna 21 has received. The tuner 22 selects and inputs one of the broadcast signals received at the antenna 21, which corresponds to the channel the user has selected by operating the key-input unit 23. The frequency of the broadcast signal selected and received is determined from information preset in the terminal apparatus 20.

The terminal apparatus 20 further comprises a network-connecting device 24 and a display device 26. The network-connecting device 24 controls the data exchange with the various servers through the network 30. The device 24 acquires the list information from the integrated service server 10 and clips the information about the musical pieces that the user wants, from the broadcast-station server 41 of the broadcast station 40. The network-connecting device 24 also acquires the list information detected by the integrated service server 10 and containing the names and ID data items of the broadcast stations from which the terminal apparatus 20 can receive signals. The display device 26 displays the names of the broadcast stations represented by the list information.

From the integrated service server 10, the terminal apparatus 20 acquires other information. This information designates the destination which are to receive the information about the musical pieces broadcast by the broadcast stations registered in the list information. The terminal apparatus 20 then clips the information about the musical pieces from the broadcast-station server 41 of the destination (i.e., a broadcast station) designated by the information.

The terminal apparatus 20 further comprises a clip-information storage device 25 for storing information clipped. That is, the storage device 25 stores the information about the musical pieces, which is transmitted from the broadcast-station server 41 and which the network-connecting device 24 has clipped. The clip-information storage device 25 is a secondary storage device of the terminal device 20. The terminal device 20 can use a part of the storage region of, for example, an HDD (Hard Disk Drive) as the clip-information storage device 25. The apparatus 20 can clip musical pieces and a set of musical pieces. Thus, the terminal apparatus 20 can clip an FM program or CD album that contains many musical pieces interesting to the user, through a single clipping operation. The terminal apparatus 20 can work as an audio apparatus, as well, which can playback the musical pieces.

The integrated service server 10 controls various databases such as the user-set information and the broadcast station information. The server 10 comprises a network-connecting device 11*a*, a database-managing device 12*a*, a user-set information database 13*a*, a broadcast-station information database 14*a*, and a storage device 15. The network-connecting device 11*a* controls the data exchange with the terminal apparatus 20 through the network 30. The database-managing device 12*a* detects necessary data from the databases and generates list information. The user-set information database (DB) 13*a* consists of the data items set by users and the user ID codes associated with the user-set data items. The broadcast-station information database (DB) 14*a* consists of broadcast station data items and area data items. Each broadcast station data item contains the name and ID data (call sign) about a broadcast station. Each area data-item represents the areas in which a terminal apparatus 20 can receive signals from the broadcast station. The storage device 15 stores various databases including the user-set information database 13*a* and the broadcast-station information database 14*a*.

The network-connecting device 11*a* controls the process of exchanging data with the terminal apparatus 20 through the network 30 and the like.

The database-managing device 12*a* controls the databases stored in the storage device 15, such as the user-set information database 13*a* and the broadcast-station information database 14*a*. Whenever the device 12*a* receives new information, it performs the process of updating the databases.

When the user starts using the terminal apparatus 20, the integrated service server 10 requests that the terminal apparatus 20 should send, via the network-connecting device 11*a*, the log-in information such as the user ID code and the user password. When the integrated service-server 10 receives the user ID code and the user password, it collates them with the user-set information database 13*a*, verifying the user ID code and the user password. The server 10 then allows the user to receive service and functions as detecting means that generates list information representing the broadcast stations from which the terminal apparatus 20 can receive signals. The list information is transmitted from the server 10 to the terminal apparatus 20. Further, the integrated service server 10 performs the process of providing various types of services in accordance with the other databases stored in the storage device 15.

Figure 3:
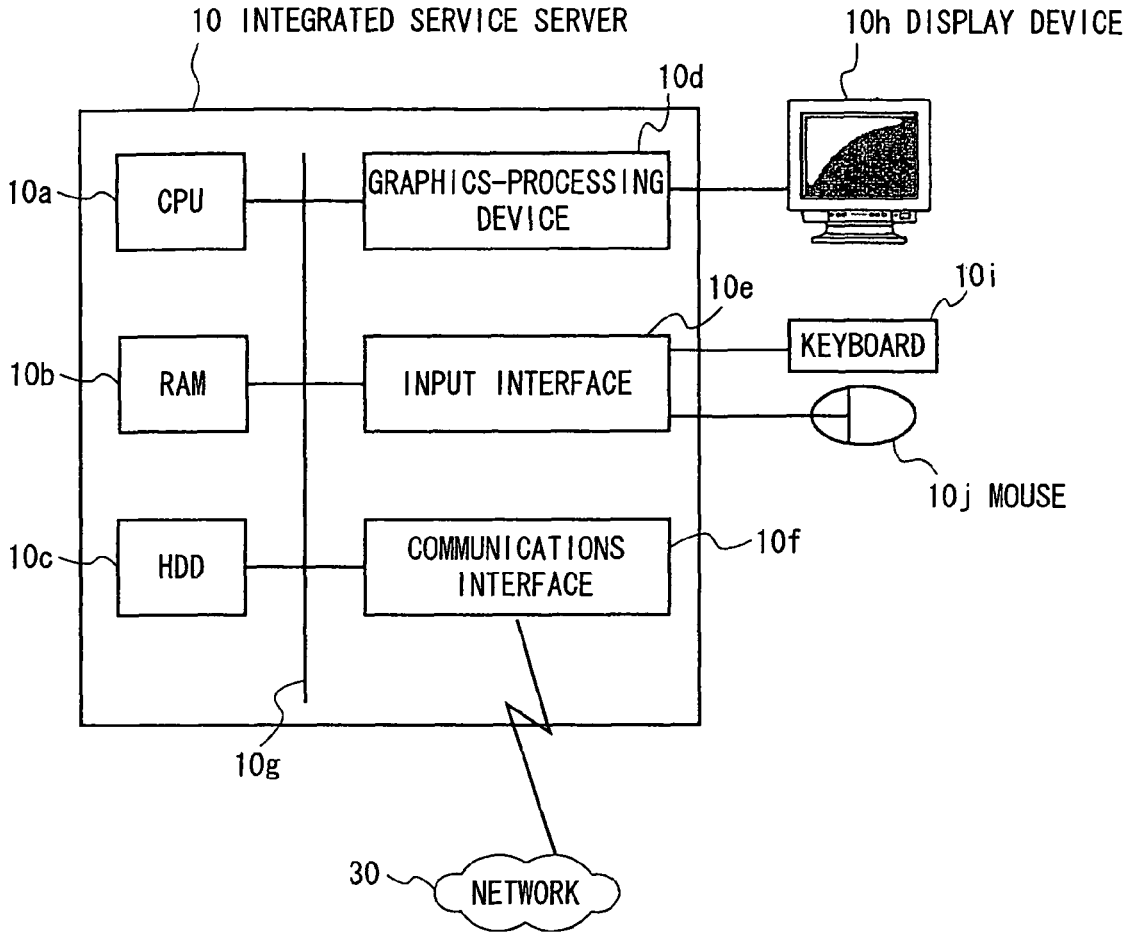
FIG. 3 is a block diagram illustrating the hardware configuration of the integrated service server according to the first embodiment.

The hardware configuration of the integrated service server 10 will be explained. FIG. 3 illustrates the hardware configuration of the integrated service server according to the embodiment of the invention. The server 10 comprises a CPU (Central Processing Unit) 10*a*, a RAM (Random Access Memory) 10*b*, an HDD (Hard Disk Drive) 10*c*, a graphics-processing device 10*d*, an input interface 10*e*, a communications interface 10*f*, and a bus 10*g*. The bus 10*g* connects the CPU 10*a* to all other components of the server 10, but the bus 10*g*. The CPU 10*a* can therefore control the RAM 10*b*, HDD 10*c*, device 10*d* and interfaces 10*e* and 10*f*.

The RAM 10*b* temporarily stores the OS (Operating System) program and at least a part of the application program that the CPU 10*a* executes. The RAM 10*b* stores various data items that the CPU 10*a* needs to use to perform its functions. The HDD 10*c* stores the OS program and application-programs. The HDD 10*c* stores various data items, too. Among these data items are the user-set information database 13*a* and broadcast-station information database 14*a*.

A display device 10*h* is connected to the graphics-processing device 10*d*. The graphics-processing device 10*d* makes the display device 10*h* to display an image in accordance with the instruction sent from the CPU 10*a*. A keyboard 10*i* and a mouse 10*j* are connected to the input interface 10*e*. The input interface 10*e* receives signals from the keyboard 10*i* and mouse 10*j* and supplies the signals to the CPU 10*a* through the bus 10*g*.

The communications interface 10*f* is connected to the network 30. The interface 10*f* transmits and receives data to and from the other servers or the terminal apparatus 20 via the network 30.

With the above-described hardware configuration, process of the integrated service server 10 of the present embodiment can be realized.

How the integrated service server 10 operates will be described next.

The integrated service server 10 provides various types of services to the terminal apparatus 20. To receive service from the server 10, the user of the terminal apparatus 20 applies for the service. That is, he or she registers the information about the terminal apparatus 20. More specifically, the user registers his or her postal code, address and phone number and also the information about the areas in which he or she may use the apparatus 20. To have these data items in the server 10, the user may operate the terminal apparatus 20 to send the data items to the server 10 via the network 30, or may send the data items by mail. Upon receiving the data items, the integrated service server 10 sets a user ID code for log-in and a user password, both assigned to the user. In the server 10, the user-set information database 13*a* stores the registered user information (including the postal code, address, phone number and pass word) in association with the user ID code.

In the integrated service server 10, the broadcast-station information database 14*a* stores the broadcast station information about the broadcast station 40, which includes at least the name and ID data (call sign), in association with the data representing the areas where the apparatus 20 can receive signals from the broadcast station 40. FIG. 4 shows an example of the broadcast-station information database. As FIG. 4 shows, the items of radio station information are registered in the database 14*a*, in association with the area blocks 141 (receiving areas) in which the terminal apparatus 20 can receive the same program at the same frequency. In the example of FIG. 4, the call signs identifying the broadcast stations are associated with not only the names of the broadcast stations, but also the frequencies at which the broadcast stations transmit signals. The call signs are ID data items that identify the broadcast stations, respectively. Each call sign is a code uniquely allocated to one broadcast station. The integrated service server 10 uses a call sign to identify one broadcast station. The name of the broadcast station is character string information that shows names of the broadcast stations, and is used to display the broadcast-station name of the receiving channel on the display device 26. The broadcast station information of FIG. 4 represents various call signs of the broadcast stations that belong to the area block "metropolitan area," the name of these broadcast stations, and the frequencies at which the broadcast stations transmit signals. The broadcast-station information database 14*a* may include the information about the broadcast-station server 41 that distributes the information about the musical pieces broadcast by any broadcast stations.

When the user performs a log-in, the terminal apparatus 20 transmits the user ID code and the user password via the network 30 to the integrated service server 10. In the integrated service server 10, the user ID code and the user password are input to the database-managing device 12*a* via the network-connecting device 11*a*. The device 12*a* extracts the information about the user from the user-set information database 13*a* on the basis of the user ID code. The device 12*a* then collates this information with the user password, authenticating the user.

Upon authenticating the user, the integrated service server 10 permits the user to use the service. In the server 10, the broadcast-station information database 14*a* is searched on the basis of the user-set information (postal code, address, phone number, etc.), thus detecting the area in which the apparatus 20 is located and the broadcast stations from which the apparatus 20 can now receive signals. That is, the integrated service server 10 refers to, for example, a table showing the area bocks and the postal codes of the area blocks, thereby detecting the area block associated with the postal code input. Various methods are known, which can be used to detect the area block in accordance with the associated data item, such as postal code, address or phone number. One of these methods may be employed to detect the area block. These methods will not be described in detail. After the area block is extracted from the user-set information in the integrated service server 10, the broadcast-station information database 14*a* is searched for the radio station associated with the area block. If the area block "metropolitan area," is obtained the information about the radio stations that reside in the metropolitan area is extracted. The list information that contains the names and call signs of the radio station is then generated in the integrated service server 10.

The integrated service server 10 may cause the terminal apparatus 20 to transmit the area code of a specific area and may then determine the area block from the area code.

FIG. 5 shows an example of list information. In the figure, the list information 142 which has been generated from the broadcast-station information database 14*a* and which is concerned with the radio stations located in the area block "metropolitan area." The list information 142 represents the names and call signs of the radio stations located in the area block "metropolitan area."

Thus, the integrated service server 10 generates the list information 142 in accordance with the user-set information. The list information 142 representing the broadcast stations from which the terminal 20 can receive signals is transmitted from the server 10 to the terminal apparatus 20 via the network 30.

Figure 6:
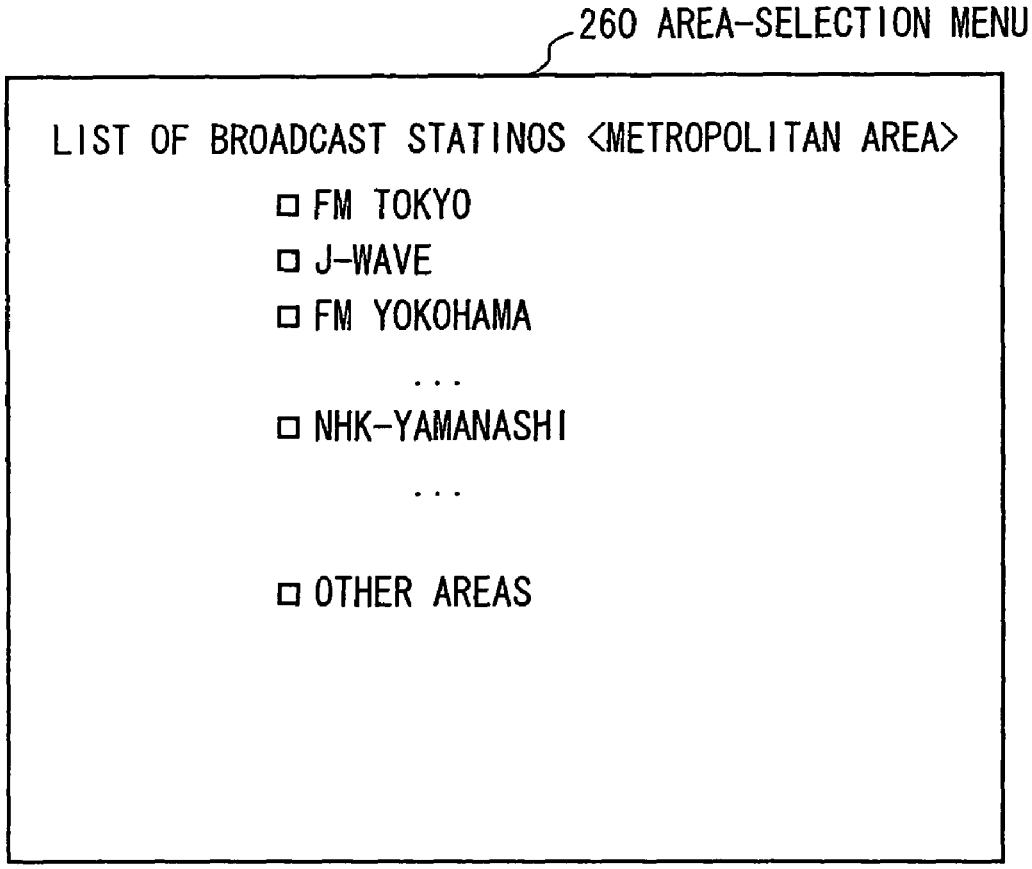
FIG. 6 is a diagram illustrating an example of a broadcast-station selection menu.

The terminal apparatus 20 acquires the list information 142 by the network-connecting device 24. The apparatus 20 temporarily stores it, if necessary, in the clip-information storage device 25. The display device 26 of the apparatus 20 displays a broadcast-station selection menu prepared on the basis of the list information 142. The user can therefore select a desired broadcast station to review the information about the musical pieces broadcast. FIG. 6 illustrates an example of the broadcast-station selection menu. This menu 260 is a list of all broadcast stations that the list information 142 shows. The user can select one of the broadcast stations shown in the menu. The menu 260 displayed contains a few broadcast stations. This is because the list information 142 shows only the broadcast stations located in the area in which the terminal apparatus 20 can receive signals. Hence, it is easy for the user to select a desired broadcast station.

The user operates the key-input unit 23, selecting one of the broadcast stations shown in the menu 260. Then, the call sign of the broadcast station thus selected is read from the list information 142. The terminal apparatus 20 transmits the call sign to the integrated service server 10. Upon receipt of the call sign, the server 10 acquires the URL of the broadcast-station server 41 that distributes the information about the musical pieces that the station broadcasts. Then, the terminal apparatus 20 obtains the information about the musical pieces from the broadcast-station server 41. The display device 26 displays this information. The information displayed on the display device 26 is, for example, a list of the data items the station broadcasts. This list is, for example, an on-air list. The broadcast station may distribute any other information about broadcast contents. In this case, the display device 26 displays the table of items about the broadcast contents. When the user operates the key-input unit 23, selecting one of these items displayed, the terminal apparatus 20 obtains the detailed information about the selected item. Then, the display device 26 displays the detailed information.

The terminal apparatus 20 transmits the call signs of the broadcast stations registered in the list information 142 to the integrated service server 10, no matter whether a broadcast station has been selected. Thus, the apparatus 20 acquires the URLs of the broadcast-station servers 41 provided in the broadcast stations, which distribute the information about musical pieces. The terminal apparatus 20 receives the information about musical pieces from the broadcast-station server 41 of each broadcast station. In the apparatus 20, the clip-information storage device 25 may store the information about musical pieces. The information about musical pieces stored in the clip-information storage device 25 is updated at regular intervals (e.g., 30 seconds). In this case, the display device 26 displays the clip information about the radio station from which the terminal apparatus 20 is receiving signals, unless the apparatus 20 receives instructions concerning the information about musical pieces. If any broadcast station is designated, the display device 26 displays the clip information about the broadcast station designated.

Thus, the terminal apparatus 20 can obtain the information about the musical pieces that the desired broadcast station distributes, no matter whether it is receiving broadcast signals from the desired broadcast station.

If the user wants to buy any musical piece broadcast, the terminal apparatus 20 can perform the process of buying the musical piece from the music distributing server 43. The apparatus 20 carries out this process on the basis of the information about the musical pieces, which is displayed by the display device 26.

As indicated above, the integrated service server 10 generates list information from the user-set information, and the display device 26 of the terminal apparatus 20 displays the information about the broadcast stations registered in the list information. Nonetheless, the display device 26 can display the information about the broadcast stations located in some other areas. This information is necessary if the user moves to one of these areas, but has yet to update the user-set information.

Figure 7:
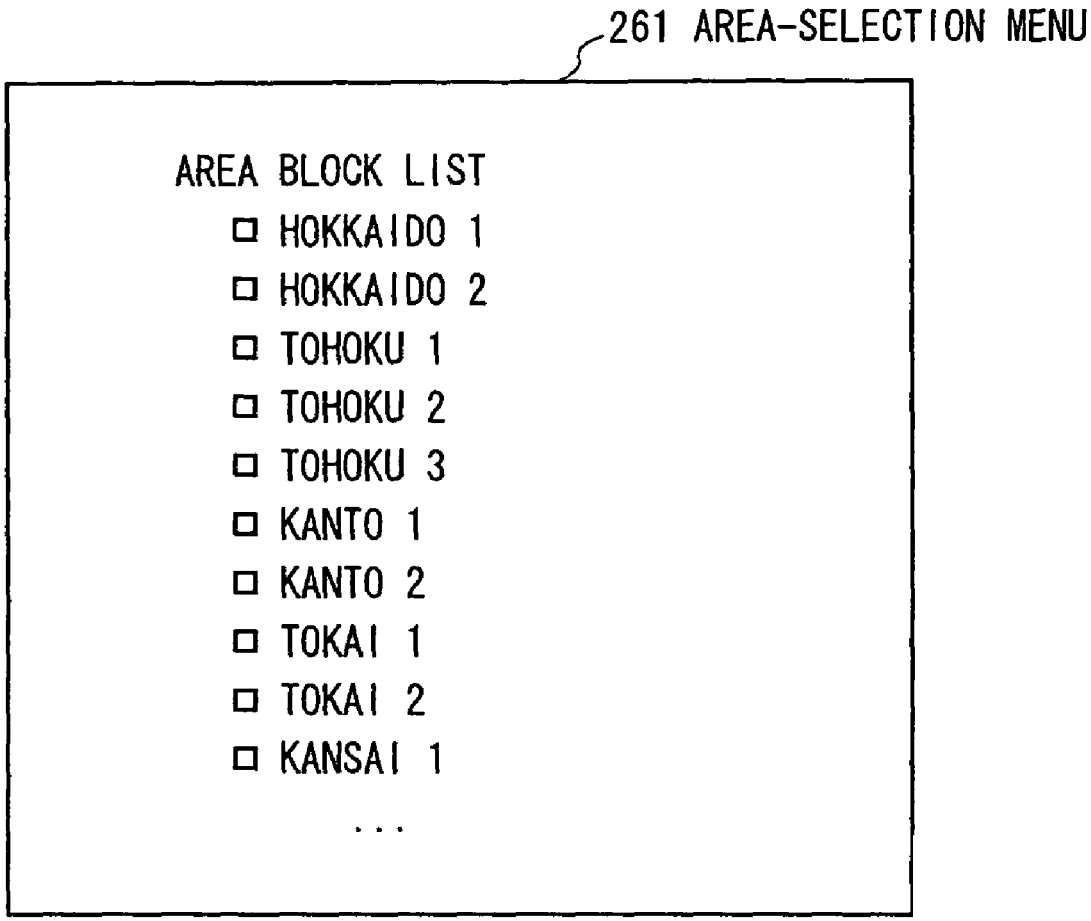
FIG. 7 is a diagram depicting an example of an area-selection menu displayed.

This is why the broadcast-station selection menu of FIG. 6 shows an item of data, i.e., "Other Areas" at the end of the list of the broadcast stations registered in the list information. This enables the user to select any broadcast station located in any other area by the terminal apparatus 20. That is, when the user operates the key-input unit 23, designating "Other Areas," the terminal apparatus 20 displays an area selection menu of other areas. FIG. 7 shows an example of the area-selection menu. When the user selects a desired one of the area blocks shown in the area-selection menu 261, the terminal apparatus 20 transmits the contents representing the area block selected, to the integrated service server 10 via the network-connecting device 24. The integrated service server 10 searches the broadcast-station information database 14*a* in accordance with the user-set information about the area, which it receives from the terminal apparatus 20. Thus, the server 10 generates list information for the broadcast station selected by the user. The list information is transmitted from the server 10 to the terminal apparatus 20. The terminal apparatus 20 displays the list of the broadcast stations from which it can receive signals in the area selected. When the user selects one of the broadcast stations shown in the list displayed, the terminal apparatus 20 acquires the URL of the selected broadcast station from the integrated service server 10, in the same way as in the process described above. Then, the apparatus 20 obtains the information about musical pieces, which the broadcast station discloses, from the broadcast-station server 41 of the selected broadcast station. The information thus obtained is displayed by the display device 26.

The terminal apparatus 20 can display a table of all broadcast stations of the country. The user can therefore select any desired broadcast station located in any area block.

As described above, the terminal apparatus 20 uses the call sign the user has selected from the list information, to request the integrated service server 10 for the URL of the broadcast-station server 41 of the broadcast station, which is associated with the call sign. Nonetheless, the URL may be contained in the list information that the integrated service server 10 transmits.

The process is performed as described above, whereby the terminal apparatus 20 displays not only the information about the musical pieces distributed by the broadcast stations from which it can receive signals in the area, but also the information about the musical pieces distributed by any other broadcast stations.

Figure 8:
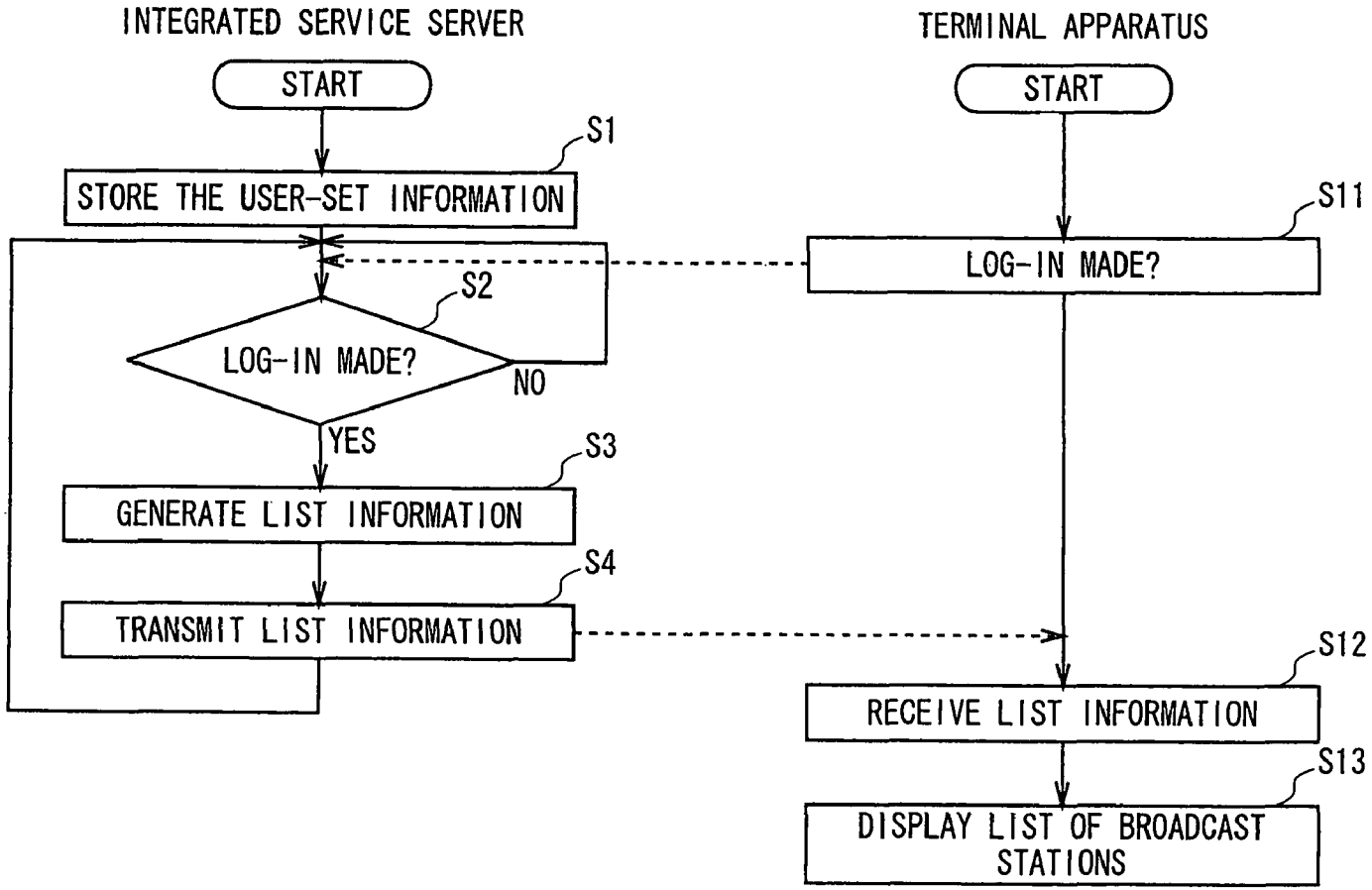
FIG. 8 is a flowchart explaining the sequence of an information-processing method according to the embodiment of the present invention.

How information is processed in this embodiment will be described. FIG. 8 is a flowchart that explains the sequence of the information-processing method according to the first embodiment. FIG. 8 also shows the sequence of processing information in the terminal apparatus.

When the user applies for service to the integrated service server 10, the process for providing service to the terminal apparatus 20 of the user is started.

[Step S1]

In the integrated service server 10, the CPU 10*a* stores the user-set information (including information about the areas, such as postal code, address, phone number) that the user has input in applying for the service, into the user-set information database 13*a*. The CPU 10*a* manages the user-set information in association with the user-identification information such as user ID code.

[Step S2]

The CPU 10*a* then waits for a log-in that the user may make on the terminal apparatus 20. Upon receiving log-in information from the terminal apparatus 20, the CPU 10*a* performs Step S3.

The operation sequence in the terminal apparatus 20 will be briefly explained. When the user applies for service, the terminal apparatus 20 can receive service from the integrated service server 10. The user then operates the apparatus 20 to utilize the service. Thus operated, the terminal apparatus 20 starts operating to receive the service.

[Step S11]

At the terminal apparatus 20, the user makes a log-in to receive service from the integrated service server 10. That is, the apparatus 20 transmits the log-in information, such as the user ID code and user password, to the integrated service server 10. The apparatus 20 then waits for a response from the integrated service server 10.

Thus, the log-in information including the user ID code is transmitted from the terminal apparatus 20 to the integrated service server 10. Then, the integrated service server 10 performs the following sequence of operation.

[Step S3]

In the integrated service server 10, the CPU 10*a* acquires the log-in information including the user ID code. Therefore, the. CPU 10*a* performs the process of generating a list of the broadcast stations from which the terminal apparatus 20 can receive signals. First, the CPU 10*a* extracts, on the basis of the user ID code, the information about the area where the user uses the terminal apparatus 20, from the user-set information database 13*a*. (In most cases, this area is the one where the user's house is located.) The information thus extracted represents the postal code, address, phone number and the like of the user. In accordance with this information, the CPU 10*a* selects the area block including the area. Next, the CPU 10*a* extracts information about the broadcast stations located in the area block thus selected, from the broadcast-station information database 14*a*. The CPU 10*a* generates list information that contains the names and call signs of the broadcast stations. Note that the terminal apparatus 20 can receive signals from these broadcast stations, because the names and call signs of the broadcast stations are contained in the list information.

[Step S4]

The CPU 10*a* of the integrated service server 10 transmits the list information, thus generated, to the terminal apparatus 20 via the network 30. The process then returns to Step S2, in which the CPU 10*a* waits for the next log-in that the user may make on the terminal apparatus 20.

The sequence of operation performed in the terminal apparatus 20 will be explained.

[Step S12]

The terminal apparatus 20 receives the list information from the integrated service server 10. The list information is temporarily stored in a prescribed storage device.

[Step S13]

The terminal apparatus 20 displays a list of the broadcast stations from which it can receive signals, on the basis of the list information it has received. Seeing the list, the user selects one or more of the broadcast stations thus displayed, to review the broadcast contents information.

As above-described steps are sequentially performed, the terminal apparatus 20 enables the user to select any desired broadcast station easily and to review the broadcast contents information that the broadcast station discloses.

With the configuration described above, the integrated service server 10 extracts the user information registered in the user-set information database 13*a*, in accordance with the user's ID code and user's password that have been transmitted from the terminal apparatus 20. The server 10 then generates list information from the user information and transmits the list information showing the broadcast stations located in the area represented by the user information. The list information is transmitted to the terminal apparatus 20. The user of the terminal apparatus 20 can therefore easily select any desired broadcast station from the broadcast stations from which the apparatus 20 can receive signals. Thus, the user can easily review the broadcast contents information that the broadcast station discloses.

(3) Second Embodiment

The second embodiment of this invention is a service-providing system. In this system, when the user selects one of the broadcast stations from which his or her terminal apparatus can receive signals, one of the service servers can provide the user with a now-on-air program of the broadcast station selected. This system has a single-sign-on function.

(3-1) Configuration of the System

Figure 9:
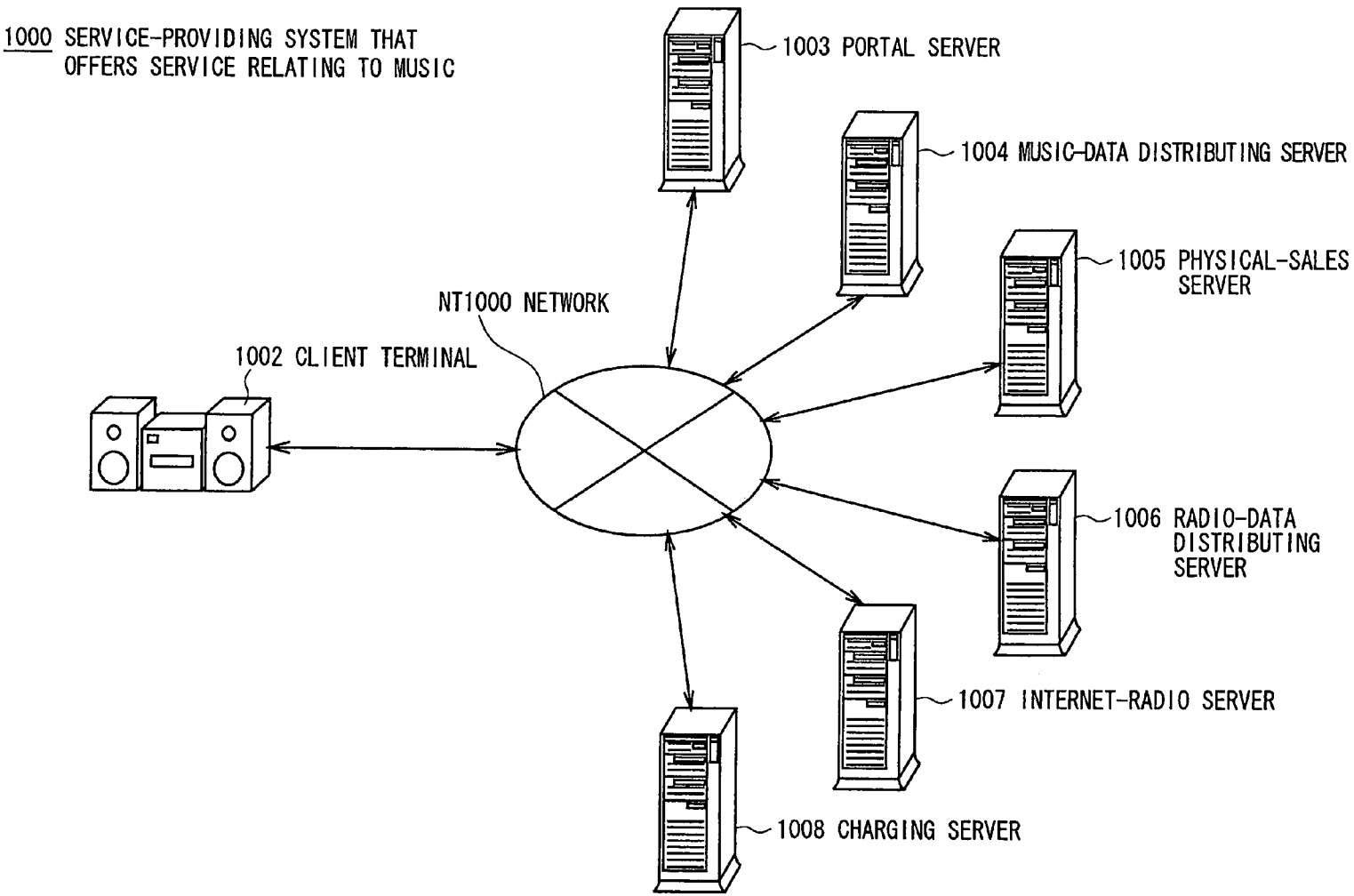
FIG. 9 is a diagram showing a service-providing system for distributing music data, which is a second embodiment of this invention.

FIG. 9 shows this service-providing system 1000 that offers service relating to music. As FIG. 9 depicts, the system 1000 comprises a client terminal 1002, a portal server 1003, and a plurality of servers 1004 to 1008. The client terminal 1002 is property of a user who has entered a contract with the provider that runs the service-providing system 1000. The portal server 1003 works as service server that controls the client terminal 1002. The servers 1004 to 1008 can give the client terminal 1002 various types of services relating to music.

The server 1004 is a music-data distributing server. It can distribute music data to the client terminal 1002. The music data is transmitted in, for example, ATRAC3 (Adaptive Transform Acoustic Coding 3) format, AAC (Advanced Audio Coding) format, WMA (Windows Media Audio) format, RealAUDIO G2 Music Codec format, or MP3 (MPEG Audio Layer-3) format.

The server 1005 is a physical-sales server. This server 1005 can sell CDs (Compact Discs), DVDs (Digital Versatile Discs), and the like to the user to fulfill the order the user has placed through the client terminal 1002.

The server 1006 is a radio-broadcasting information distributing server. It provides a radio-broadcasting information distributing service distributed to the client terminal 1002 the radio programs, music programs and the like that any radio station broadcasts.

The server 1007 is an Internet-radio server. This server 1007 performs the Internet radio-broadcasting service of transmitting the radio-proadcast data in the data-streaming mode to the client terminal 1002 via a network NT1000 that is equivalent to the Internet.

The server 1008 is a charging server that collects from the user the charge for the use of the system, in response to the request made by the portal server 1003 or the like.

The client terminal 1002 in the second embodiment is equivalent to the terminal apparatus 20 that is used in the first embodiment. The portal server 1003 corresponds to the integrated service server 10. The music-data distributing server 1004 corresponds to the music distributing server 43. The radio-data distributing server 1006 is equivalent to the broadcast-station server 41. The network NT1000 corresponds to the network 30.

(3-2) Configuration of the Client Terminal 1002

(3-2-1) Hardware Configuration of Client Terminal 1002

Figure 10:
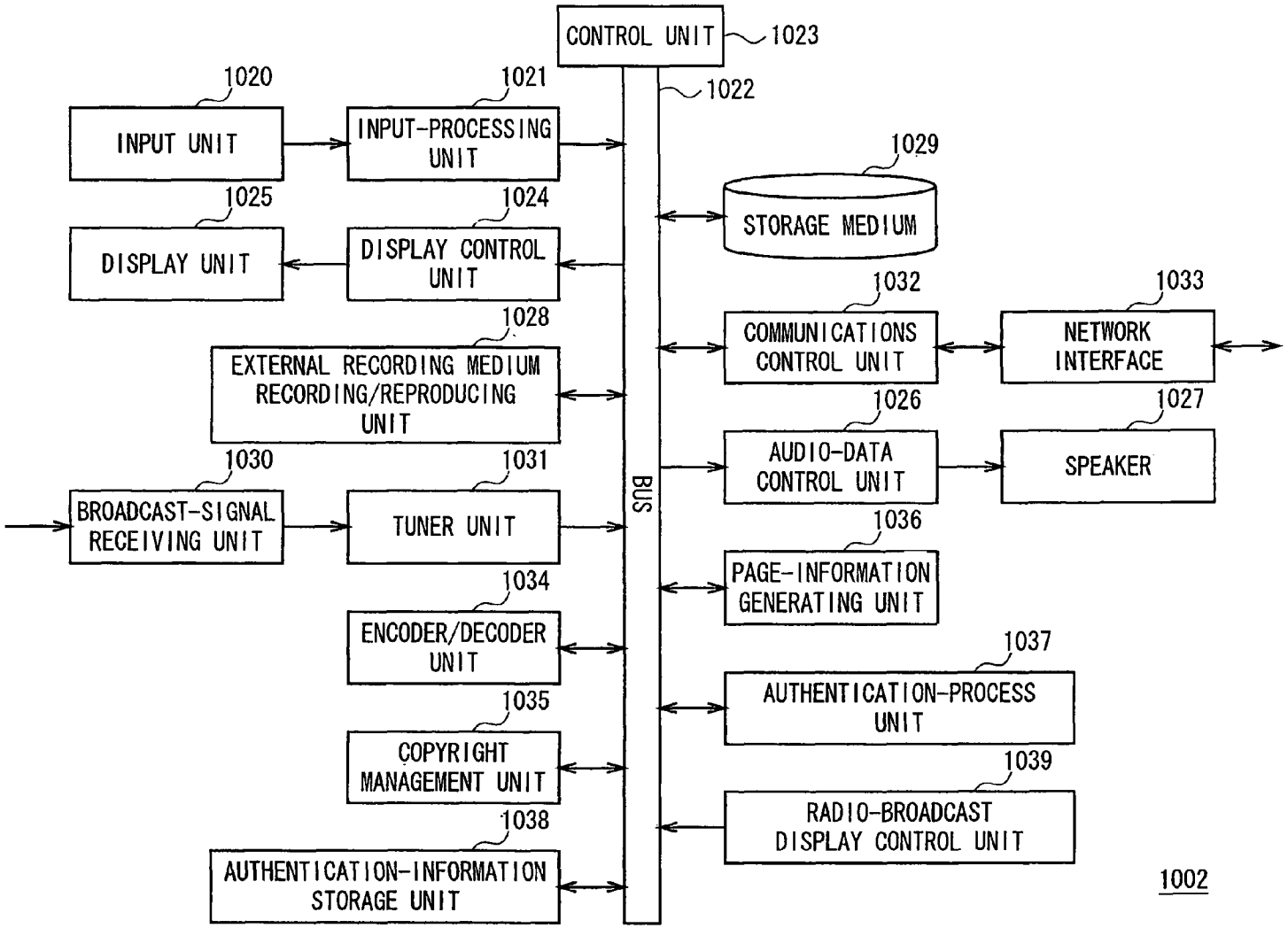
FIG. 10 is a block diagram of the hardware configuration of a client terminal, illustrating the function circuits of the terminal.

The hardware configuration of the client terminal 1002 as a broadcast terminal apparatus will be described, with reference to the block diagram of FIG. 10. As FIG. 10 shows, the client terminal 1002 has an input unit 1020. The input unit 1020 has various buttons that are provided on the housing of the client terminal 1002 or on a remote controller (not shown). When the user operates the buttons, the input unit 1020 detects the operation, generating operation-input signals. These signals are supplied to an input-processing unit 1021.

The input-processing unit 1021 converts the operation-input signals supplied from the input unit 1020 to operation commands. The operation commands are sent through a bus 1022 to a control unit 1023.

The control unit 1023 controls some of the other components of the client terminal 1002 in accordance with the operation commands and the control signals supplied from some other components of the client terminal 1002 via the bus 1022.

A display control unit 1024 performs analog-to-digital conversion on the video data supplied to it through the bus 1022, thus generating an analog video signal. The analog video signal is supplied to a display unit 1025.

The display unit 1025 is, for example, a display such as a liquid crystal display. It is provided on the housing of the client terminal 1002 or externally connected thereto.

The display unit 1025 receives the processing result generated by the control unit 1023 and various video data as the analog video signal via the display control unit 1024. The display unit 1025 displays images represented by the analog video signal.

An audio-data control unit 1026 receives the audio data supplied via the bus 1022 and converts it to an analog audio signal, which is supplied to a speaker 1027. The speaker 1027 generates sound from the analog audio signal supplied from the audio-data control unit 1026.

An external recording medium recording/reproducing unit 1028 is configured to reproduce content data from an external recording medium such as a CD, a memory stick (trademark), or the like and to record content data on the external recording medium. Note that a memory stick comprises a flash memory and a case containing the flash memory.

The recording/reproducing unit 1028 may read video data, as content data, from the external recording medium. In this case, the video data is supplied via the bus 1022 to the display control unit 1024.

The display control unit 1024 converts the video data (i.e., content data) read by the recording/reproducing unit 1028 from the external recording medium, to an analog video signal. The analog video signal is supplied to the display unit 1025.

The recording/reproducing unit 1028 may read audio data, as content data, from the external recording medium. If this is the case, the audio data is supplied via the bus 1022 to the audio-data control unit 1026.

The audio-data control unit 1026 converts the audio data (i.e., content data) read by the recording/reproducing unit 1028 from the external recording medium, to an analog audio signal. The analog audio signal is supplied to the speaker 1027.

The control unit 1023 causes the recording/reproducing unit 1028 to supply the content data read from the external recording medium, to the storage medium 1029 incorporated in the client terminal 1002. The content data is thereby stored in the storage medium 1029. (Hereinafter, this process of storing content data in the storage medium 1029 will be referred to as "clipping".)

The control unit 1023 may read video data (image data), as content data, from the storage medium 1029. In this event, the video data is supplied to the display control unit 1024 via the bus 1022.

The control unit 1023 may read audio data, as content data, from the storage medium 1029. In this event, the audio data is supplied to the audio-data control unit 1026 via the bus 1022.

In addition, the control unit 1023 can read music data from the storage medium 1029. The music data is transferred to the recording/reproducing unit 1028. Then, the recording/reproducing unit 1028 can record the music data on the external recording medium.

A broadcast-signal receiving unit 1030 receives radio waves transmitted from radio stations. The radio waves are supplied from the unit 1030 to a tuner unit 1031.

Controlled by the control unit 1023, the tuner unit 1031 extracts a radio broadcast signal from the radio waves received by the broadcast-signal receiving unit 1030, said signal having the frequency allocated to the radio station that the user has selected by operating the input unit 1020. The audio data obtained from the radio broadcast signal is supplied to the audio-data control unit 1026 through the bus 1022.

The audio-data control unit 1026 receives the audio data from the tuner unit 1031 and converts it to analog audio signal. The analog audio signal is sent to the speaker 1027. The speaker 1027 generates sound for the radio program broadcast from the radio station from the analog audio signal. The user can therefore listen to the radio program.

The control unit 1023 can supply the audio data obtained in the tuner unit 1031, to the storage medium 1029. Hence, the storage medium 1029 can store the audio data representing the radio program.

A control unit 1023 is connected to the network NT1000 first by a communications control unit 1032 and then by a network interface 1033. Thus, the control unit 1023 can access the portal server 1003 and other servers 1004 to 1007 that are provided on the network NT1000. The control unit 1023 can exchange various data items and data items with the portal server 1003 and the other servers 1004 to 1007.

The encoder/decoder unit 1034 receives the content data from the network NT1000 through the network interface 1033 and communications control unit 1032. The unit 1034 also receives the content data read from the storage medium 1029 or the external recording medium. The content data from the network NT100 and the content data from the storage medium 1029 or the external recording medium are encoded and compressed. The encoder/decoder unit 1034 decodes the content data and supplies them to the display control unit 1024 and the audio-data control unit 1026.

The content data read from the external recording medium may be one not compressed or encoded. In this case, the encoder/decoder unit 1034 compresses and encodes the content data. The encoder/decoder unit 1034 compresses and encodes the audio data and the like supplied from the tuner unit 1031, too. The content data, thus compressed and encoded, is sent to the storage medium 1029.

The content data compressed and encoded by the encoder/decoder unit 1034 is stored in the storage medium 1029 under the control of the control unit 1023.

A copyright management unit 1035 generates copyright management information about the content data downloaded from the network NT1000 via the network interface 1033 and communications control unit 1032. The unit 1035 also generates copyright management information about the content data the recording/reproducing unit 1028 has read from the external recording medium.

The control unit 1023 registers the copyright management information generated by the copyright management unit 1035, on the storage medium 1029. The copyright management information is registered, in association with the content data.

The copyright management unit 1035 may appropriately update the copyright management information to check out the content data associated with the copyright management information, between the storage medium 1029 and the external recording medium specified. Alternatively, the unit 1035 may appropriately update the copyright management information in order to check in the content data between the specified external recording medium and the storage medium 1029. In either case, the copy right to the content data is protected.

A page-information generating unit 1036 receives page information such as an XML (extensible Markup Language) file or an HTML (Hyper Text Markup Language) file from the network NT1000 via the network interface 1033 and communications control unit 1032. The unit 1036 interprets the page information and generates video data to be displayed by the display unit 1025. The video data is supplied to the display control unit 1024.

An authentication-process unit 1037 performs the process of transmitting authentication information to the portal server 1003 and the other servers 1004 to 1007 through the communications control unit 1032 and the network interface 1033. Note that the portal server 1003 and the other servers 1004 to 1007 are provided on the network NT1000 and are connected by the network interface 1033.

An authentication-information storage unit 1038 stores the authentication information that the authentication-process unit 1037 necessarily uses in order to access the portal server 1003 and the other servers 1004 to 1007.

A radio-broadcast display control unit 1039 transmits a request signal via the communications control unit 1032 and network interface 1033 to the radio-data distributing server 1006 of the radio station that is broadcasting the radio program the client terminal 1002 is receiving at present. The request signal requests that the server 1006 should give the user the information about the radio program that the client terminal 1002 is receiving.

As a result, the radio-data distributing server 1006 provided on the network NT1000 transmits the radio-program information. The radio-broadcast display control unit 1039 receives the radio-program information through the network interface 1033 and communications control unit 1032. Then, the unit 1039 transmits this information to the display control unit 1024. The display control unit 1024 conveys the information to the display unit 1025. The display unit 1025 displays the radio-program information. This information consists of the name of the radio program that the client terminal 1002 is receiving, the title of the musical piece the terminal 1002 is receiving, the name of the artist who plays the music, and the like. Note that the radio-program information is equivalent to the related information that is used in the first embodiment.

(3-2-2) Directory Management

Figure 11:
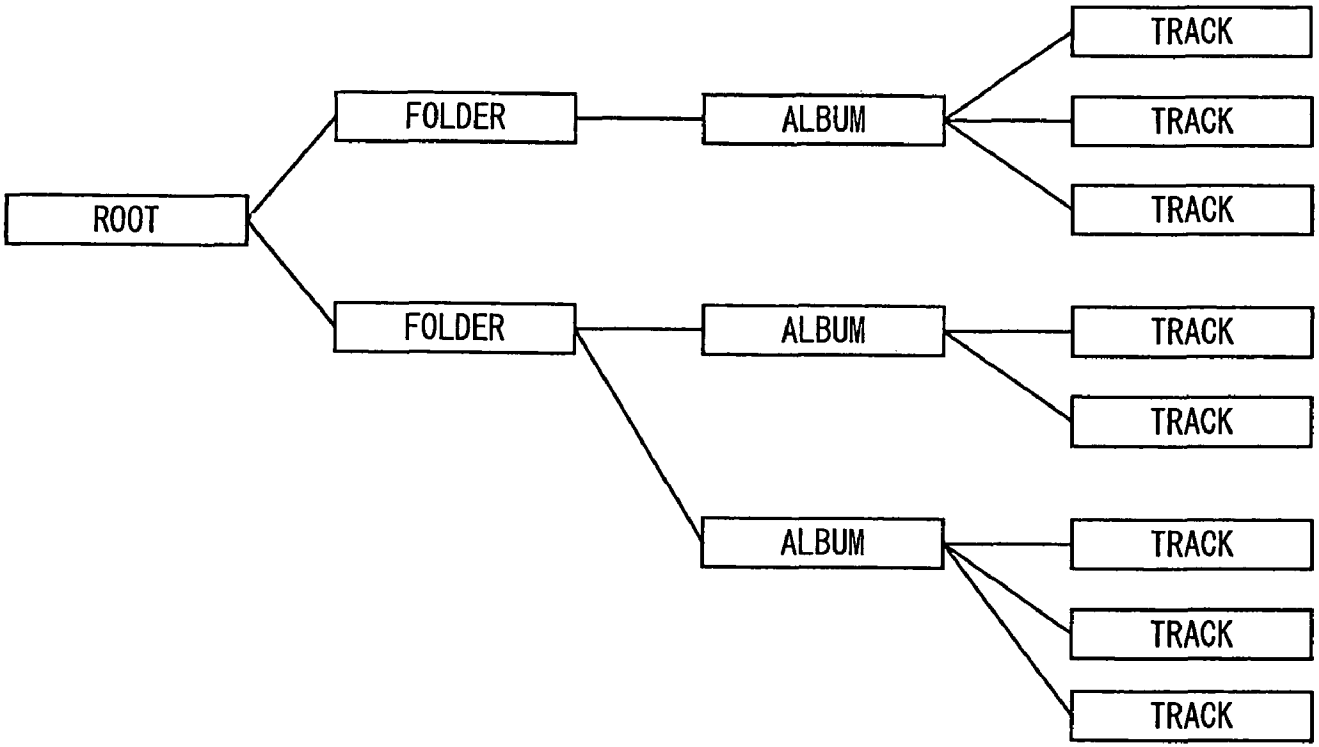
FIG. 11 is a diagram representing a directory configuration.

In the client terminal 1002, the control unit 1023 controls the content data to be stored in the storage medium 1029, in the form of such a directory configuration as is illustrated in FIG. 11. A given number of "folder" directories are prepared, constituting a layer immediately lower than "root" directories. The "folder" directories thus prepared correspond to the genres of contents or the users who may own the client terminal 1002.

"Album" directories are prepared, forming a layer immediately lower than "folder" directories. They are provided in numbers falling within a prescribed range. The "album" directories correspond to, for example, each album title. At least one "track" files are prepared, constituting a layer immediately lower than "album" directories. Several track files may belong to each album directory. Each track file is one musical piece, i.e., contents.

The content data of this directory configuration is managed by the database file that is stored in the storage medium 1029.

(3-3) Configuration of the Portal Server 1003

Figure 12:
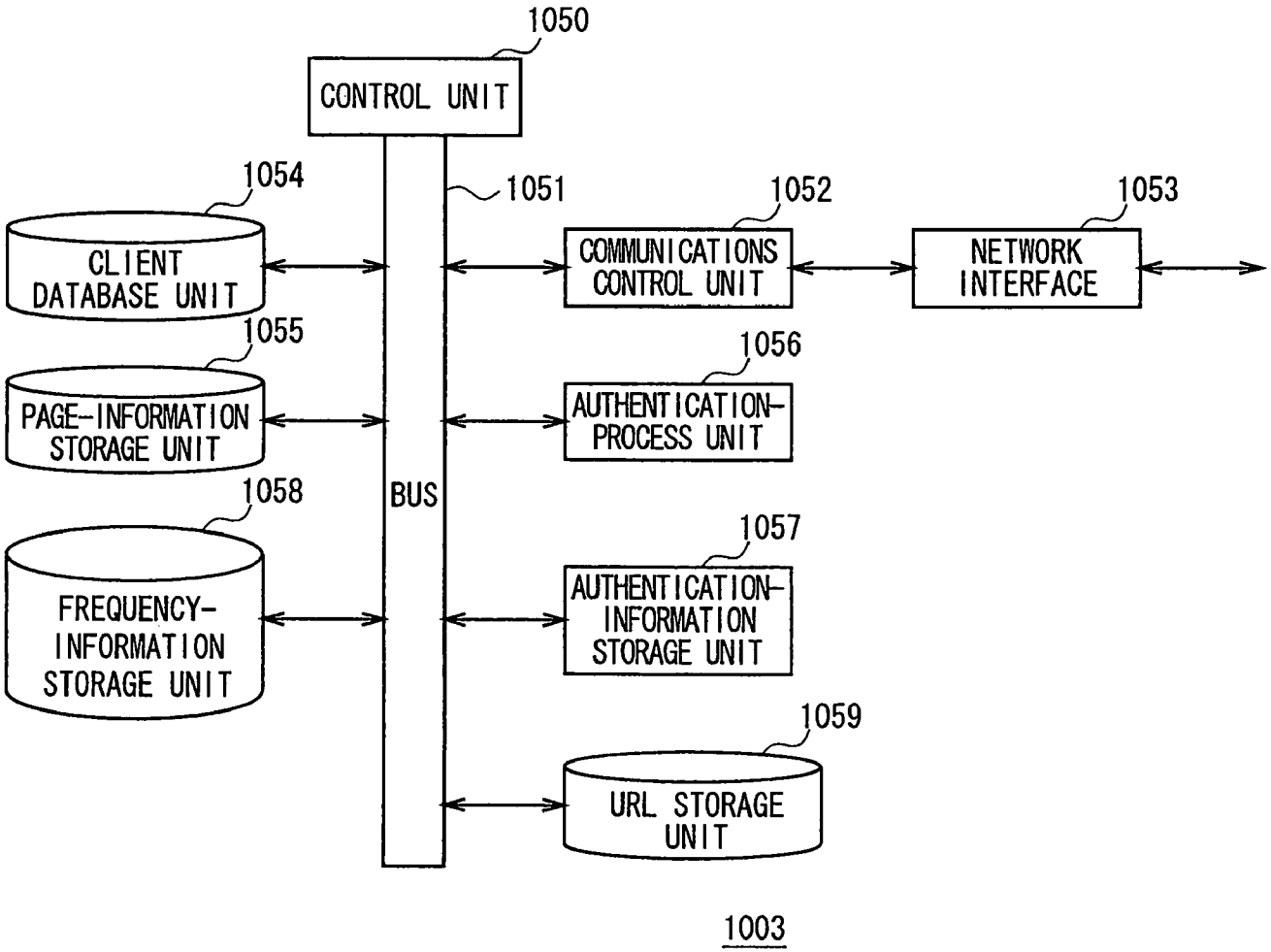
FIG. 12 is a block diagram of the hardware configuration of a portal server, depicting the function circuits constituting this server.

The hardware configuration of the portal server 1003, which functions as an information-processing apparatus and authentication server, will be described with reference to FIG. 12. The portal server 1003 incorporates a control unit 1050 and a bus 1051. The control unit 1050 controls the other components of the portal server 1003, which are connected to the unit 1050 by the bus 1051.

Controlled by the control unit 1050, a communications control unit 1052 receives various data items from, and transmits various data items to, the client terminal 1002 and the other servers 1004 to 1008 through a network interface 1053.

A client database unit 1054 contains the ID (Identification) code and password of any user who has entered contract with the provider that runs the service-providing system 1000 that offers service relating to music. The ID code and the password are registered, one associated with the other, forming an item of client information.

The client database unit 1054 contains user-set information about any user, in addition to the ID (Identification) code and the password. The user-set information represents, for example, the postal code, address, phone number and the like of the user.

A page-information storage unit 1055 storage unit 1055 stores page information and the like, which are managed by the provider that runs the service-providing system 1000 that offers service relating to music.

The page information is described in a specific language such as an XML. It contains URL (Uniform Resource Locator) information the portal server 1003 uses to access the music-data distributing server 1004, physical-sales server 1005, radio-data distributing server 1006, Internet-radio server 1007, etc.

An authentication-process unit 1056 can receive the user ID code and the user password from the client terminal 1002 through the network interface 1053 and communications control unit 1052. Upon receiving the user ID code and the user password, the unit 1056 determines whether the ID code and the password are registered as client information in the client database unit 1054.

Upon finishing the process of authenticating the user, the authentication-process unit 1056 issues portal-authentication result data (i.e., authentication-session ID data, later described). The portal-authentication result data, which indicates the result of the process of authenticating the user, is temporarily stored in an authentication-information storage unit 1057.

As the result of the process of authenticating the user, the authentication-process unit 1056 may determine that the user is an authenticated one. In this case, the control unit 1050 reads the page information for a contracting part, from the page-information storage unit 1055. The control unit 1050 transmits the page information, together with the portal-authentication result data, to the client terminal 1002, first through the communications control unit 1052 and then through the network interface 1053.

As the result of the process of authenticating the user, the authentication-process unit 1056 may determine that the user is not an authenticated one. In this case, the control unit 1050 reads authentication-error notifying page information from the page-information storage unit 1055. The control unit 1050 transmits authentication-error information, together with the authentication-error-notifying page information, to the client terminal 1002, first through the communications control unit 1052 and then through the network interface 1053. The authentication-error-notifying page information indicates that the user is not an authenticated one.

Portal-authentication result data (i.e., authentication ticket, later described) is transmitted from the client terminal 1002 when the music-data distributing server 1004, physical-sales server 1005 and radio-data distributing server 1006 finish the authentication process on the user of the client terminal 1002. The authentication-process unit 1056 receives the portal-authentication result data via the network interface 1053 and communications control unit 1052. The unit 1056 then compares this portal-authentication result data with the portal-authentication result data temporarily stored in the authentication-information storage unit 1057.

The authentication-process unit 1056 determines whether portal-authentication result data from the music-data distributing server 1004, physical-sales server 1005 and radio-data distributing server 1006 is normal one or not. The result of this decision is sent to the music-data distributing server 1004, physical-sales server 1005 and radio-data distributing server 1006, first through the communications control unit 1052 and then through the network interface 1053.

A frequency-data storage unit 1058 stores broadcast station information. The broadcast station information contains area code, frequency data items, names of radio stations, and call signs, each stored in association with any other data item. The area codes are, for example, postal codes assigned to the areas, respectively. The frequency data items represent the frequencies assigned to the radio stations from which the client terminal 1002 can receive signals. The names of radio stations (hereinafter referred to as "radio-station names") pertain to the stations that broadcast radio programs that the terminal 1002 can receive. The call signs are ID data items that are uniquely assigned to the radio stations, respectively.

The URL storage unit 1059 stores the call signs for each radio station and URL data items associated with the call signs, respectively. The URL data items represent URLs that can acquire the radio-broadcast data items (hereinafter called "now-on-air data items") about the radio programs that the radio stations are broadcasting at present. Each now-on-air data item is the name of a radio program being broadcast, the title of the musical piece being broadcast, and the like.

In the first embodiment described above, the CPU 10*a* of the integrated service server 10 (FIG. 3) carries out various processes, basically in accordance with the programs stored in the HDD 10*c*.

Hence, the CPU 10*a* can function in the same way as the control unit 1050, communications control unit 1052 and authentication-process unit 1056 of the portal server 1003, only if an appropriate program is selected from the various programs stored in the HDD 10*c*, in accordance with that function of the portal server 1003. Note that the function of the portal server 1003 is specified in FIG. 12 that shows the hardware configuration of the portal server 1003. Further, the HDD 10*c* can be used in the same way as the client database unit 1054, page-information storage unit 1055, authentication-information storage unit 1057, frequency-data storage unit 1058 and URL storage unit 1059 of the portal server 1003.

(3-4) Configuration of the Music-Data Distributing Server 1004

Figure 13:
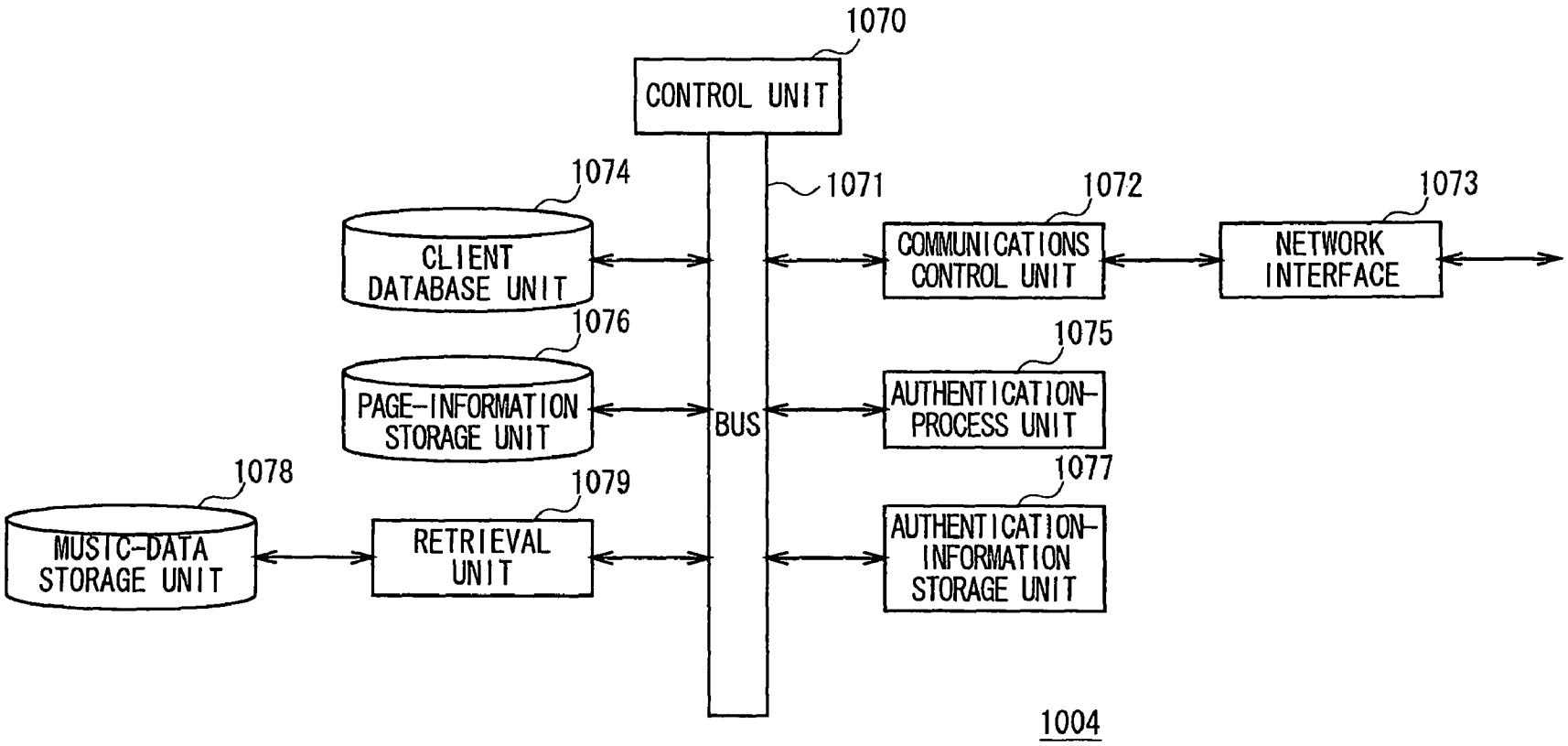
FIG. 13 is a block diagram of the hardware configuration of a music-data distributing server, showing the function circuits constituting this server.

The hardware configuration of the music-data distributing server 1004 will be described, with reference to FIG. 13. The server 1004 incorporates a control unit 1070 and a bus 1071. The control unit 1070 controls the other components of the server 1004 connected to it by the bus 1071.

Controlled by the control unit 1070, a communications control unit 1072 receives various data items or various data items from, and transmits various data items to, the client terminal 1002, the portal server 1003 and the like through a network interface 1073. The various data items are, for example, content data.

A client database unit 1074 contains the user ID code and password of any user who has entered contract with the provider that runs the music-data distributing server 1004. The user ID code and the password are registered, one associated with the other, forming an item of client information. The client database 1074 need not be used if an authentication-process unit 1075 can authenticate the user on the basis of the portal-authentication result data that has transmitted from the client terminal 1002 and that the portal server 1003 has issued.

A page-information storage unit 1076 stores page information and the like, which are managed in the music-data distributing server 1004. This page information introduces the music data items that can be downloaded.

The page information for use in distributing music data items is described in a specific language such as an XML. The page information helps the user of the client terminal 1002 to select any music data items that he or she wants to have downloaded.

The control unit 1070 may receive a request signal from the client terminal 1002 via the network interface 1073 and the communications control unit 1072. The request signal requests for the page information for distributing music data, which should be transmitted to the client terminal 1002. Upon receiving the request signal, the control unit 1070 supplies the page information for distributing the music data, which is stored in the page-information storage unit 1076, to the client terminal 1002 through the communications control unit 1072 and a network interface 1073.

The authentication-process unit 1075 receives the user ID code and password of the user from the client terminal 1002, first through the network interface 1073 and then through the communications control unit 1072. Then, it is determined whether the user ID code and the password have been registered, as client information, in the client database unit 1074. Thus, the authentication-process unit 1075 authenticates the user of the client terminal 1002.

The authentication-process unit 1075 may authenticate the user by a different method that uses neither the user ID code nor the user password. That is, the unit 1075 receives portal-authentication result data (i.e., authentication ticket, later described) issued by the portal server 1003 and transmitted from the client terminal 1002, first through the network interface 1073 and then through the communications control unit 1072. The authentication-process unit 1075 then transmits the portal-authentication result data to the portal server 1003, first through the communications control unit 1072 and then through the network interface 1073.

The portal server 1003 receives the portal-authentication result data and confirms the receipt of this data. The server 1003 transmits the data indicating the receipt of the portal-authentication result data. The authentication-process unit 1075 receives this data from the portal server 1003, first through the network interface 1073 and then through the communications control unit 1072. From this data, the authentication-process unit 1075 determines whether the user is an authenticated user who has entered a contract with the provider that runs the service-providing system 1000 in order to receive the service relating to music.

Thus, the authentication-process unit 1075 issues server-authentication result data (i.e., service-session ID data, later described) that shows the result of the authentication of the user.

The authentication-process unit 1075 may thus determine that the user is an authenticated one, as it finishes the process of authenticating the user. If this is the case, the control unit 1070 supplies the page information to the client terminal 1002, together with the server-authentication result data, through the communications control unit 1072 and the network interface 1073. The page information, which will be used to distribute the music data, is stored in the page-information storage unit 1076.

Conversely, the authentication-process unit 1075 may not determine that the user is an authenticated one, as it finishes the process of authenticating the user. In this case, the control unit 1070 supplies an authentication-error information to the client terminal 1002, together with the page information, through the communications control unit 1072 and the network interface 1073. The page information, which indicates the authentication failure, is stored in the page-information storage unit 1076.

An authentication-information storage unit 1077 temporarily stores the server-authentication result data issued by the authentication-process unit 1075. The storage unit 1077 stores various authentication data items, too. The authentication-process unit 1075 must use these authentication data items to authenticate the user of the client terminal 1002.

A music-data storage unit 1078 stores a plurality of music data items that have been compressed and encoded in the above-mentioned ATRAC3 format or the above-mentioned MP3 format. In the unit 1078, the music data items are recorded, each associated with a retrieval key such as a content ID code.

A retrieval unit 1079 can receive a download request signal from the client terminal 1002 through the network interface 1073 and the communications control unit 1072. Note that the client terminal 1002 transmits the download request signal when it receives the page information for distributing music data items. The download request signal requests that any music data item that the user wants should be downloaded into the client terminal 1002. This signal contains a key for retrieving the music data. Upon receiving the download request signal, the retrieval unit 1079 extracts the retrieval key from the download request signal.

In accordance with the retrieval key, the retrieval unit 1079 retrieves the music data item the user wants to have downloaded, from the music-data storage unit 1078.

The control unit 1070 transmits the music data item thus retrieved, to the client terminal 1002, first through the communications control unit 1072 and then through the network interface 1073.

The control unit 1070 transmits charge information to the charging server 1008, first through the communications control unit 1072 and then through the network interface 1073. The charge information will be used to collect from the user the charge for downloading the music data item. On the basis of the charge information, the charging server 1008 performs the process of charging the user for the music data item downloaded by the user.

(3-5) Configuration of the Physical-Sales Server 1005

Figure 14:
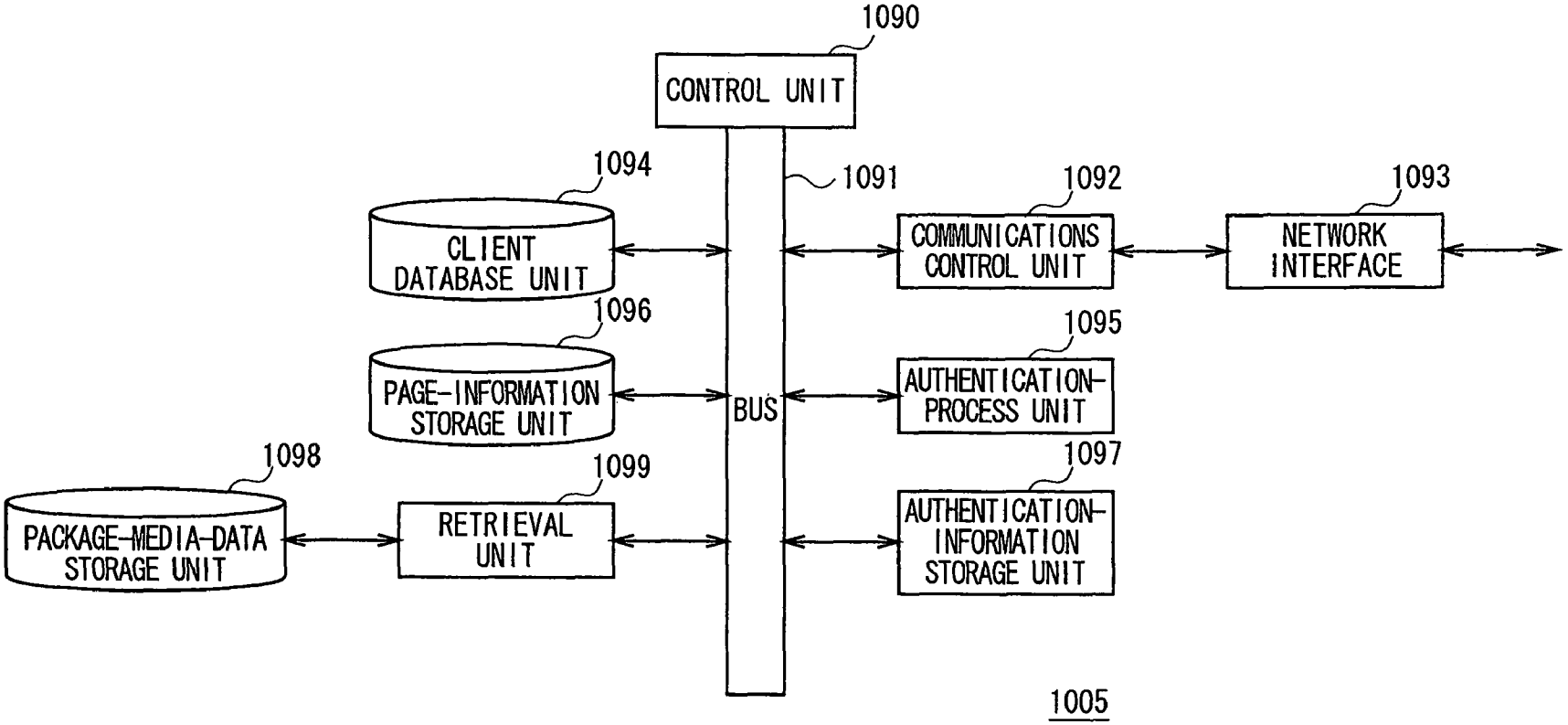
FIG. 14 is a block diagram of the hardware configuration of a sales server, showing the function circuits constituting the sales server.

The hardware configuration of the physical-sales server 1005 will be described, with reference to FIG. 14. The physical-sales server 1005 incorporates a control unit 1090 and a bus 1091. The control unit 1090 controls the other components of the physical-sales server 1005, which are connected to it by the bus 1091.

When controlled by the control unit 1090, a communications control unit 1092 receives various data items from, and transmits various data items to, the client terminal 1002, the portal server 1003 and the like through a network interface 1093.

A client database unit 1094 stores the user ID codes and passwords of the users who have already entered a contract with the provider that runs the physical-sales server 1005. The user ID codes and the user passwords are registered in one-to-one association, in the client database unit 1094. An authentication-process unit 1095 may have the function of authenticate the user of the client terminal 1002 in accordance with the portal-authentication result data issued by the portal server 1003 and transmitted from the client terminal 1002. In this case, the client database unit 1094 need not be provided.

A page-information storage unit 1096 stores page information and the like. The page information is used for the sale of package media such as CDs and DVDs for sale. More precisely, the page information introduces the package media.

The page information for promoting the sale of the package media is described in a specific language such as an XML. The page information helps the user of the client terminal 1002 to select any package media (e.g., CDs or DVDs) that he or she wants to buy.

The control unit 1090 can receive a page-information acquisition request signal from the client terminal 1002, which requests for the page information for the sale of package media. Upon receipt of the page-information acquisition request signal, first through the network interface 1093 and then through the communications control unit 1092, the control unit 1090 transmits the page information for the sale of package media to the client terminal 1002, first through the communications control unit 1092 and then through the network interface 1093. It should be recalled that the page information is stored in the page-information storage unit 1096.

The authentication-process unit 1095 receives the user IC code and the password, both assigned to the user of the client terminal 1002, from the client terminal 1002 through the network interface 1093 and the communications control unit 1092. The unit 1095 then determines whether the user ID code and the user password are registered as client information in the client database unit 1094, in order to authenticate the user.

The authentication-process unit 1095 may authenticate the user by a different method that uses neither the user ID code nor the user password. In this method, the unit 1095 receives the portal-authentication result data (i.e., authentication ticket, later described) issued by the portal server 1003 and transmitted from the client terminal 1002, first through the network interface 1093 and then through the communications control unit 1092. The portal-authentication result data, thus received, is transmitted to the portal server 1003, first through the communications control unit 1092 and then through the network interface 1093.

When the portal-authentication result data is transmitted to the portal server 1003, the authentication-process unit 1095 receives confirmation result data from the portal server 1003 through the network interface 1093 and the communications control unit 1092. The confirmation result data shows that the portal server 1003 has performed an authentication process (i.e., the confirmation process described above) on the basis of the portal-authentication result data. Then, the authentication-process unit 1095 determines, from the confirmation result data, whether the user of the client terminal 1002 is an authenticated one who has entered a contract with the provider that runs the service-providing system 1000 that offers service relating a music.

When the authentication-process unit 1095 finishes the process of authenticating the user, it generates server-authentication result data (i.e., service-session ID data, later described) that indicates the result of the process of authenticating the user.

If the authentication-process unit 1095 authenticates the user as the result of the process of user authentication, the control unit 1090 transmits the page information, together with the server-authentication result data, to the client terminal 1002, first through the communications control unit 1092 and then through the network interface 1093. Note that the page information is stored in the page-information storage unit 1096 and is used to promote the sale of package media.

The authentication-process unit 1095 may not authenticate the user, as the result of the process of user authentication. If this is the case, the control unit 1090 transmits authentication-error information, together with authentication-error-notifying page information, to the client terminal 1002, first through the communications control unit 1092 and then through the network interface 1093. The authentication-error-notifying page information, which indicates the authentication failure, is stored in the page-information storage unit 1096.

An authentication-information storage unit 1097 temporarily stores the server-authentication result data issued by the authentication-process unit 1095. The storage unit 1097 stores various authentication data items, too. The authentication-process unit 1095 must use these authentication data items to authenticate the user of the client terminal 1002.

The package-media-data storage unit 1098 stores data items about a plurality of package media such as CDs and DVDs for sale. (Hereinafter, these data items will be referred to as "package-media data items.") In the unit 1098, the package-media data items are recorded, each associated with a retrieval key such as package-medium ID code.

The retrieval unit 1099 can receive a media-data request signal from the client terminal 1002 through the network interface 1093 and the communications control unit 1092. Note that the client terminal 1002 transmits the media-data request signal when it receives the page information for the sale of package media. The media-data request signal requests for the package media information about the specific package medium such as CD or DVD. Upon receiving the media-data request signal, the retrieval unit 1099 extracts the retrieval key for retrieving the specific package media.

On the basis of the retrieval key, the retrieval unit 1099 retrieves the package-media data item about the specific package medium that corresponds to the retrieval condition designated by the retrieval key from a plurality of package-media data items in the package-media-data storage unit 1098.

The control unit 1090 transmits the package-media data item thus retrieved, to the client terminal 1002, first-through the communications control unit 1092 and then through the network interface 1093. The client terminal 1002 displays the package-media data item about the specific package medium.

The control unit 1090 may receive a purchase request signal from the client terminal 1002, through the network interface 1093 and the communications control unit 1092. Note that the purchase request signal indicates that the user wants to buy the specific package medium. Upon receiving the purchase request signal, the control unit 1090 performs the process of buying and delivering the package medium specified by the user of the client terminal 1002.

The control unit 1090 transmits charge information to the charging server 1008, first through the communications control unit 1092 and then through the network interface 1093. The charge information will be used to collect from the user the money for package medium. On the basis of the charge information, the charging server 1008 performs the process of charging the user for the specific package medium.

Upon finishing the process of causing the charging server 1008 to charge the user, the control unit 1090 transmits purchase-completion page information to the client terminal 1002, first through the communications control unit 1092 and then through the network interface 1093. The purchase-completion page information shows that the user has bought the package medium.

(3-6) Configuration of the Radio-Data Distributing Server 1006

Figure 15:
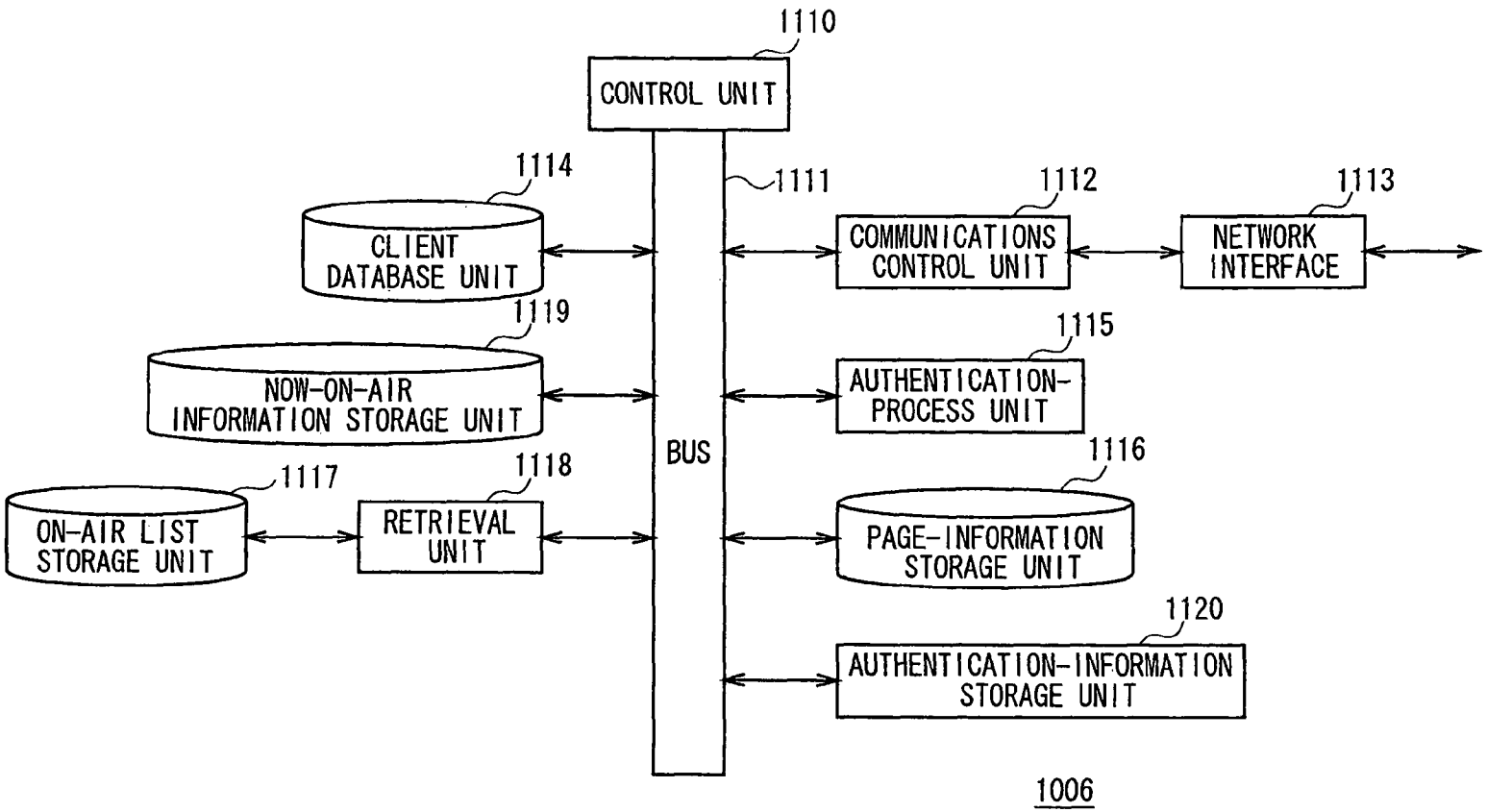
FIG. 15 is a block diagram of the hardware configuration of a radio-broadcasting information server, showing the function circuits constituting this server.

The radio-data distributing server 1006 that operates as server for providing related information will be described, with reference to FIG. 15. The radio-data distributing server 1006 incorporates a control unit 1110 and a bus 1111. The control unit 1110 controls the other components of the radio-data distributing server 1006, which are connected to it by the bus 1111.

Controlled by the control unit 1110, a communications control unit 1112 receives various data items from, and transmits various data items to, the client terminal 1002, the portal server 1003 and the like through a network interface 1113.

A client database unit 1114 stores client information. The client information contains the user ID (Identification) code and password of any user who has entered contract with the provider that runs the radio-data distributing server 1006. The user ID code and the password are registered, one associated with the other, forming an item of client information. The client database unit 1114 need not be used if an authentication-process unit 1115 can authenticate the user on the basis of the portal-authentication result data that has transmitted from the client terminal 1002 and that the portal server 1003 has issued.

A page information storage unit 1116 stores page information and the like, which will be used to acquire radio broadcast information (hereinafter called "on-air list information"). The on-air list information is managed by the radio-data distributing server 1006 and concerns with the radio programs that have been broadcast by the radio stations that are linked to the radio-data distributing server 1006.

The page-information for distributing the on-air list information is described in a specific language such as an XML. It contains an input box or the like. The input box is used to input the name and broadcast date of any radio program that the user wishes to have, which will be used as a key for retrieving the on-air list information.

An on-air list storage unit 1117 stores the name, on-air start time and on-air end time of each radio program that any radio station linked to the radio-data distributing server 1006 has already broadcast. The unit 1117 stores on-air list information, too. The on-air list information represents a list of the titles of the musical pieces broadcast in the radio program, the names of the artists who play the musical pieces, the on-air start time of each of these musical pieces, and the like.

The control unit 1110 receives a page-information acquisition request signal requesting the page information for distributing the on-air list information, from the client terminal 1002, first through the network interface 1113 and then through the communications control unit 1112. In response to the page-information acquisition request signal, the control unit 1110 transmits the page information for distributing the on-air list information, to the client terminal 1002, first through the communications control unit 1112 and then through the network interface 1113. Note that this page information is stored in the page-information storage unit 1116.

A retrieval unit 1118 can receive an on-air list information request signal from the client terminal 1002 through the network interface 1113 and the communications control unit 1112. Note that the on-air list information request signal contains a key for retrieving the desired on-air list information input on the page information for distributing the on-air list information. Upon receiving the on-air list information request signal, the retrieval unit 1118 extracts the retrieval key from the on-air list information request signal.

In accordance with the retrieval key, the retrieval unit 1118 retrieves, from the on-air list storage unit 1117, that part of the on-air list information which meets the retrieval condition defined by the retrieval key. This part of the on-air list information, thus extracted, is the on-air list information desired.

The control unit 1110 transmits the on-air list information thus retrieved, to the client terminal 1002, first through the communications control unit 1112 and then through the network interface 1113.

A now-on-air information storage unit 1119 stores the now-on-air information that represents the name, on-air start time and on-air end time of the radio program being broadcast from the radio station linked to the radio-data distributing server 1006. The now-on-air list information represents the titles of the musical pieces, the names of the artists who play the musical pieces, the on-air start time of each of these musical pieces being broadcast, and the like, too.

The authentication-process unit 1115 receives the user ID code and password of the user of the client terminal 1002, along with the now-on-air information request signal, from the client terminal 1002 through the network interface 1113 and the communications control unit 1112. Upon receiving the user ID code and password of the user, the unit 1115 determines whether the user ID code and user password have been registered as client information in the client database unit 1114, in order to authenticate the user.

The authentication-process unit 1115 may authenticate the user by a different method that uses neither the user ID code nor the user password. In this method, the unit 1115 receives the portal-authentication result data (i.e., authentication ticket, later described) issued by the portal server 1003 and transmitted from the client terminal 1002, first through the network interface 1113 and then through the communications control unit 1112. The portal-authentication result data, thus received, is transmitted to the portal server 1003, first through the communications control unit 1112 and then through the network interface 1113.

When the portal-authentication result data is transmitted to the portal server 1003, the authentication-process unit 1115 receives confirmation result data from the portal server 1003 through the network interface 1113 and the communications control unit 1112. The confirmation result data shows that the portal server 1003 has performed an authentication process (i.e., the confirmation process described above) on the basis of the portal-authentication result data. Then, the authentication-process unit 1115 determines, from the confirmation result data, whether the user is an authenticated one who has entered a contract with the provider that runs the service-providing system 1000 that offers service relating to music.

When the authentication-process unit 1115 finishes the process of authenticating the user, it generates server-authentication result data (i.e., service-session ID data, later described) that indicates the result of the process of authenticating the user.

If the authentication-process unit 1115 authenticates the user as the result of the process of user authentication, the control unit 1110 transmits the now-on-air information, together with the server-authentication result data, to the client terminal 1002, first through the communications control unit 1112 and then through the network interface 1113. Note that the now-on-air information is stored in the now-on-air data storage unit 1119.

The authentication-process unit 1115 may not authenticate the user, as the result of the process of user authentication. If this is the case, the control unit 1110 transmits authentication-error information, together with authentication-error-notifying page information, which indicates the authentication failure, to the client terminal 1002, first through the communications control unit 1112 and then through the network interface 1113.

Thus, the control unit 1110 distributes the now-on-air information at the request of the user if the user is authenticated. If the user cannot be authenticated, the control unit 1110 disables the user from receiving the radio broadcast information distribution service, such-as the now-on-air information, which the radio-data distributing server 1006 provides.

An authentication-information storage unit 1120 temporarily stores the server-authentication result data issued by the authentication-process unit 1115. The unit 1120 stores various authentication data items, too. The authentication-process unit 1115 must use these authentication data items to authenticate the user of the client terminal 1002.

(3-7) Processes Performed by the Servers

The process carried out between the client terminal 1002 and the portal server 1003, and the processes accomplished between the client terminal 1002, on the one hand, and the music-data distributing server 1004, physical-sales server 1005 and radio-data distributing server 1006, on the other hand, will be described, with reference to the sequence charts of FIGS. 16 to 21.

(3-7-1) Sequence of the User Authentication Between the Client Terminal 1002 and the Portal Server 1003

The process of authenticating the user, which is achieved between the client terminal 1002 and the portal server 1003 will be explained, with reference to FIG. 16.

Assume that the power switch on the client terminal 1002 of the user who has entered a contract with the provider that runs the service-providing system 1000 is turned on, or the user depresses an operation button of the input unit 1020. Then, an operation signal is generated. The input-processing unit 1021 converts the operation-input signal to an operation command. Upon receiving this operation command, the control unit 1023 starts the authentication request process.

When the client terminal 1002 starts the authentication request process. First, in Step SP1000, the control unit 1023 generates a connection request signal. The connection request signal contains the authentication-session ID data and the like, which are temporarily stored in the authentication-information storage unit 1038. The connection request signal is transmitted to the portal server 1003, first through the communications control unit 1032 and then through the network interface 1033.

Note that the portal server 1003 issues authentication-session ID data every time the client terminal 1002 is connected to the portal server 1003. That is, the authentication-session ID data identifies the communication connection condition (i.e., session) between the client terminal 1002 and the portal server 1003.

The authentication-session ID data used for user authentication or the like is valid for a predetermined term, from the time the portal server 1003 issues it. (The validation term is, for example, about one minute.)

Therefore, the client terminal 1002 that has received the authentication-session ID data from the portal server 1003 is considered to be disconnected from the portal server 1003 if it fails to transmit the ID data back to the portal server 1003 within the validation term.

Since the authentication-session ID data is valid for a specific time only, the portal sever 1003 prevents any user who has entered a contract with the provider that runs the service-providing system 1000 from using any authentication-session ID data issued in the past to identify himself or herself as an authenticated user.

The authentication-information storage unit 1038 temporarily stores the authentication-session ID data. This ID data is data that the portal server 1003 issued when the client terminal 1002 was connected to the portal server 1003 to have its user authenticated.

In Step SP1001, the control unit 1050 of the portal server 1003 receives the connection request signal from the client terminal 1002 through the network interface 1053 and the communications control unit 1052. The control unit 1050 supplies the authentication-session ID data and the like, which are contained in the connection request signal, to the authentication-process unit 1056.

Controlled by the control unit 1050, the authentication-process unit 1056 performs the process of authenticating the user on the basis of the authentication-session ID data received as connection request signal from the client terminal 1002.

The authentication-process unit 1056 may not authenticate the user of the client terminal 1002 because the authentication-session ID data is no longer valid. In this case, the control unit 1050 transmits authentication-error data indicating that the user is not authenticated, to the client terminal 1002, first through the communications control unit 1052 and then through the network interface 1053.

In Step SP1002, the control unit 1023 of the client terminal 1002 receives the authentication-error data from the portal server 1003, first through the network interface 1033 and then through the communications control unit 1032. In response to the authentication-error data, the control unit 1023 reads the user ID code, the user password, and the like, stored in the authentication-information storage unit 1038. Then, the control unit 1023 transmits the user ID code, the user password and the like to the portal server 1003 through the communications control unit 1032 and the network interface 1033.

In Step SP1003, the control unit 1050 of the portal server 1003 receives the user ID code, the user password and the like from the client terminal 1002, first through the network interface 1053 and then through the communications control unit 1052. The control unit 1050 supplies the user ID code, the user password and the like to the authentication-process unit 1056.

Controlled by the control unit 1050, the authentication-process unit 1056 performs the process of authenticating the user. That is, the unit 1050 determines whether the user ID code, the user password and the like, received from the client terminal 1002, are included in the client information registered in the client database unit 1054.

As the result, the authentication-process unit 1056 may determine that the user of the client terminal 1002 is authenticated. If this is the case, the control unit 1050 controls the authentication-process unit 1056, causing the unit 1056 to issue authentication-session ID data that shows the condition of communication between the client terminal 1002 and the portal server 1003. The authentication-session ID data is transmitted to the client terminal 1002. At the same time, the authentication-session ID data is temporarily stored in the authentication-information storage unit 1057.

The control unit 1050 transmits the authentication-session ID data and the like, issued by the authentication-process unit 1056, to the client terminal 1002, first through the communications control unit 1052 and then through the network interface 1053.

In Step SP1004, the control unit 1023 of the client terminal 1002 receives the authentication-session ID data and the like, transmitted from the portal server 1003, first through the network interface 1033 and then through the communications control unit 1032. The control unit 1023 supplies the authentication-cession ID data and the like to the authentication-process unit 1037.

Controlled by the control unit 1023, the authentication-information storage unit 1038 temporarily stores the authentication-session ID data and the like that have been received from the portal server 1003.

The control unit 1023 transmits a page-information acquisition request signal to the portal server 1003, first through the communications control unit 1032 and then through the network interface 1033. The page-information acquisition request signal demands that the portal server 1003 should give page information to the terminal 1002. The control unit 1023 transmits this signal, together with the authentication-session ID data and the like that have been received from the portal server 1003 and temporarily stored in the authentication-information storage unit 1038.

In Step SP1005, the control unit 1050 of the portal server 1003 receives the page-information acquisition request signal, the authentication-session ID data, and the like, transmitted from the client terminal 1002, first through the network interface 1053 and then through the communications control unit 1052. The control unit 1050 supplies the authentication-session ID data and the like to the authentication-process unit 1056.

The authentication-process unit 1056 carries out the process of authenticating the user of the client terminal 1002, under the control of the control unit 1050. More precisely, the unit 1056 compares the authentication-session ID data and the like, which have been transmitted from the client terminal 1002, with the authentication-session ID data and the like, which have been issued to the client terminal 1002 in Step SP1003 and temporarily stored in the authentication-information storage unit 1057.

If the user of the client terminal 1002 is found to be an authenticated one in Step SP1006, the authentication-process unit 1056 determines that the request for page information made by the client terminal 1002 is justifiable. Then, the validation term of the authentication-session ID data and the like issued to the client terminal 1002 is extended.

In Step SP1006, the control unit 1050 reads the page information requested for by the user, from the page-information storage unit 1055. The control unit 1050 then transmits the page information to the client terminal 1002, first through the communications control unit 1052 and then through the network interface 1053, together with the authentication-session ID data and the like, the validation term of which has been extended from the authentication-process unit 1056.

In Step SP1007, the control unit 1023 of the client terminal 1002 receives the page information, the authentication-session ID data, and the like, all transmitted from the portal server 1003, first through the network interface 1033 and then through the communications control unit 1032. The page information is supplied to the page-information generating unit 1036. The authentication-session ID data and the like, the validation term of which has been extended, are supplied to the authentication-process unit 1037.

The page-information generating unit 1036 generates video data from the page information supplied from the control unit 1023. The video data represents a page that contains data items showing the links to the music-data distributing server 1004, physical-sales server 1005 and radio-data distributing server 1006. The generated video data is sent to the display control unit 1024.

The display control unit 1024 performs digital-to-analog conversion on the video data supplied from the page-information generating unit 1036. Thus, the unit 1024 generates an analog video signal. The analog video signal is supplied to the display unit 1025. The display unit 1025 displays the page information about the portal server 1003, which is represented by the analog video signal.

The authentication-process unit 1037 updates the authentication-session ID data and the like, which are temporarily stored in Step S1004, to new authentication-cession ID data and the like whose validation term has been extended. More specifically, the unit 1037 receives the authentication-session ID data and the like, whose validation term has been extended, from the portal server 1003, and writes them over the authentication-session ID data and the like, whose validation term has not been extended, in the authentication-information storage unit 1038.

(3-7-2) Sequence of the User Authentication Between the Client Terminal 1002 and the Servers 1004 to 1006

The process of authenticating the user, which is achieved between the client terminal 1002, one the one hand, and the music-data distributing server 1004, physical-sales server 1005 and radio-data distributing server 1006, on the other hand, will be explained, with reference to the sequence chart of FIG. 17.

Figure 16:
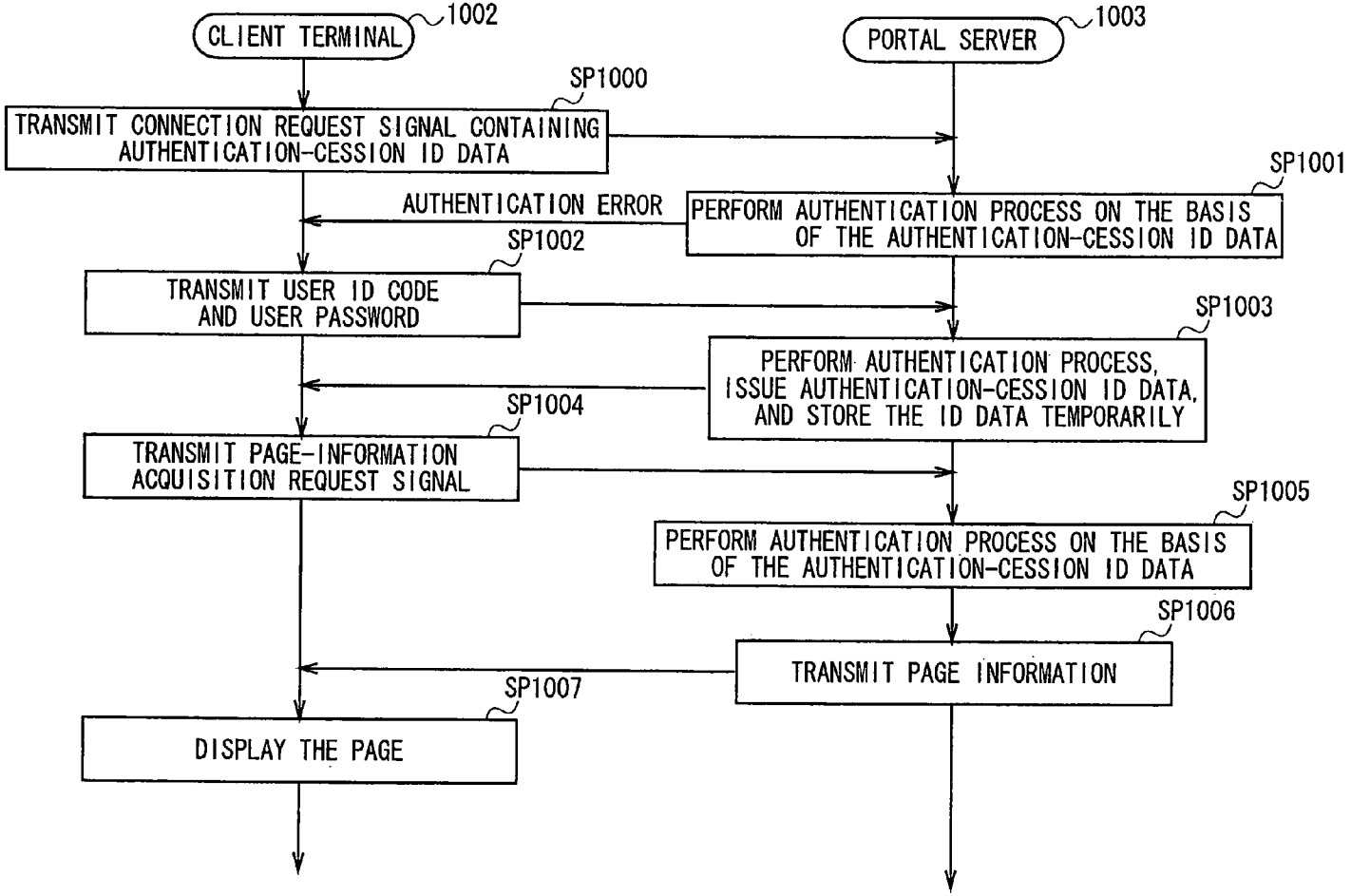
FIG. 16 is a sequence chart illustrating the sequence of verifying the user, which is achieved between the client terminal and the portal server.

The user may be authenticated as illustrated in FIG. 16. That is, the client terminal 1002 may first acquire the page information from the portal server 1003 and then accesses the music-data distributing server 1004, physical-sales server 1005 and radio-data distributing server 1006 by using the link contained in the page information. (Hereinafter, the method of authenticating the user will be called "indirect-access authentication process.")

The user may be authenticated by another method. In this method, the client terminal 1002 uses URL information and the like, which are registered as book marks. Thus, the client terminal 1002 directly accesses the music-data distributing server 1004, physical-sales server 1005 and radio-data distributing server 1006, without acquiring the page information about the portal server 1003. (Hereinafter, this method of authenticating the user will be referred to as "direct-access authentication process").

In the indirect-access authentication process, the steps are performed in the same sequence, no matter whether the client terminal 1002 exchange data with the music-data distributing server 1004, physical-sales server 1005 or radio-data distributing server 1006.

In the direct-access authentication process, too, the steps are carried out in the same sequence, whether the client terminal 1002 exchange data with the music-data distributing server 1004, physical-sales server 1005 or radio-data distributing server 1006.

That is, the direct-access authentication process and the indirect-access authentication process are different only in the way in which the client terminal 1002 acquires the URL information it uses to access to the music-data distributing server 1004, physical-sales server 1005 or radio-data distributing server 1006. In both processes, the steps are performed in the same order.

Therefore, the direct-access authentication process and the indirect-access authentication process will be explained hereinafter as one method of authenticating the user. For simplification of description, it will be described how the music-data distributing server 1004 is accessed in order to authenticate the user of the client terminal 1002.

First, in Step SP1010, the control unit 1023 of the client terminal 1002 transmits the service-cession ID data to the music-data distributing server 1004 through the communications control unit 1032 and the network interface 1033, in accordance with the URL information contained as a link in the page information or the URL information registered as book mark. The service-cession ID data is transmitted to the server 1004, together with a page-information acquisition request signal. This request signal requests for the page information about the music data distribution. (If the client terminal 1002 must access the physical-sales server 1005, the request signal will be one that requests for the page information about the package media for sale. If the client terminal 1002 must access the radio-data distributing server 1006, the request signal will be one that requests for the page information about on-air list information.)

The service-cession ID data is identification data that the server (i.e., music-data distributing server 1004, physical-sales server 1005 or radio-data distributing server 1006) accessed by the client terminal 1002 issues every time it communicates with the client terminal 1002 to perform any process such as the authentication of the user. Namely, the service-cession ID data identifies the communication connection condition (i.e., cession) between the client terminal 1002 and the server (i.e., music-data distributing server 1004, physical-sales server 1005 or radio-data distributing server 1006).

Like the authentication-cession ID data described above, the service-cession ID data is valid for a predetermined term (e.g., about one minute), from the time the music-data distributing server 1004, physical-sales server 1005 or radio-data distributing server 1006 issues it. This measure is taken to accomplish reliable user authentication.

Thus, the client terminal 1002 will be considered to have been disconnected from the music-data distributing server 1004, physical-sales server 1005 or radio-data distributing server 1006 if it cannot give the service-cession ID data back to one of these servers within the validation term. In other words, the music-data distributing server 1004, physical-sales server 1005 or radio-data distributing server 1006, which has issued the service-cession ID data, will regard the client terminal 1002 as having been disconnected unless it receives the ID data returned from the terminal 1002 within that validation term.

Hence, the music-data distributing server 1004, physical-sales server-1005 and radio-data distributing server 1006 are prevented from being used by anyone who has not entered a contract with the provider that runs the service-providing system 1000 that offers service relating to music.

The authentication-information storage unit 1038 temporarily stores the service-cession ID data. Note that the service-cession ID data is the data that the music-data distributing server 1004, physical-sales server 1005 or radio-data distributing server 1006 issued when it was connected to the client terminal 1002 in the past for user authentication or the like.

In Step SP1011, the control unit 1070 of the music-data distributing server 1004 receives the page-information acquisition request signal, the service-cession ID data and the like that have been-transmitted from the client terminal 1002, first through the network interface 1073 and then through the communications control unit 1072. The control unit 1070 supplies the service-cession ID data and the like to the authentication-process unit 1075.

Controlled by the control unit 1070, the authentication-process unit 1075 compares the service-cession ID data and the like transmitted from the client terminal 1002, with the service-cession ID data and the like temporarily stored in the authentication-information storage unit 1077. Thus, the unit 1075 carries out the process of authenticating the user.

The authentication-process unit 1075 may not authenticate the user of the client terminal 1002 as a legal one, because the service-cession ID data received from the client terminal 1002 is no longer valid. In this case, the unit 1075 determines that the requests for the page information for distributing music data transmitted from the client terminal 1002 is an illegal one.

If the authentication-process unit 1075 does not authenticate the user of the terminal 1002 as a legal one, the control unit 1070 transmits authentication-error data and a shop code to the client terminal 1002, first through the communications control unit 1072 and then through the network interface 1073. The authentication-error data indicates that the user has not been authenticated. The shop code identifies the music-data distributing server 1004.

In Step SP1012, the control unit 1023 of the client terminal 1002 receives the authentication-error data and the shop code, both transmitted from the music-data distributing server 1004, first through the network interface 1033 and then through the communications control unit 1032. From the authentication-error data, the control unit 1023 determines that the user has not been authenticated in the music-data distributing server 1004. The authentication-information storage unit 1038 temporarily stores the shop code received from the music-data distributing server 1004.

The portal server 1003 generates an authentication-ticket request signal, requesting for an authentication ticket that the client terminal 1002 will use to access the music-data distributing server 1004. The control unit 1023 transmits the authentication-ticket issuance request signal, along with the shop code of the server 1004, the authentication-cession ID data temporarily stored in the authentication-information storage unit 1038, and the like, to the portal server 1003, first through the communications control unit 1032 and then through the network interface 1033.

In Step SP1013, the control unit 1050 of the portal server 1003 receives the authentication-ticket issuance request signal, the shop code, the authentication-cession ID data, and the like, all transmitted from the client terminal 1002, through the network interface 1053 and the communications control unit 1052. The control unit 1050 supplies these data items to the authentication-process unit 1056.

Controlled by the control unit 1050, the authentication-process unit 1056 compares the authentication-cession ID data and the like, received from the client terminal 1002, with the authentication-cession ID data and the like, temporarily stored in the authentication-information storage unit 1057. Thus, the authentication-process unit 1056 carries out the process of authenticating the user.

The authentication-cession ID data transmitted from the client terminal 1002 may no longer be valid, the authentication-process unit 1056 cannot determine whether the user is a legal user of the client terminal 1002 or not. If this is the case, the authentication-process unit 1056 determines that the requests for issuing the authentication ticket from the client terminal 1002 is an illegal one.

The authentication-process unit 1056 may not authenticate the user of the client terminal 1002. In this case, the control unit 1050 generates authentication-error information indicating the user cannot be authenticated. The control unit 1050 transmits the authentication-error information to the client terminal 1002, first through the communications control unit 1052 and then through the network interface 1053.

The authentication-process unit 1056 may authenticate the user of the client terminal 1002. Then, it is determined that the authentication-cession ID data received from the client terminal 1002 remains valid. The user of the client terminal 1002 is authenticated as a legal one. The requests for issuing the authentication ticket transmitted from the client terminal 1002 is therefore considered to be illegal.

If the authentication-process unit 1056 authenticates the user of the client terminal 1002, the control unit 1050 goes to Step SP1018.

In Step SP1014, the control unit 1023 of the client terminal 1002 receives the authentication-error information from the portal server 1003, first through the network interface 1033 and then through the communications control unit 1032. Then, the control unit 1023 reads the user ID code, the user password and the like, which are stored in the authentication-information storage unit 1038. The user ID code, the user password and the like are transmitted to the portal server 1003 through the communications control unit 1032 and the network interface 1033.

In Step SP1015, the control unit 1050 of the portal server 1003 receives the user ID code, the user password and the like from the client terminal 1002, through the network interface 1053 and the communications control unit 1052. The control unit 1050 supplies the user ID code, the user password and the like to the authentication-process unit 1056.

Controlled by the control unit 1050, the authentication-process unit 1056 performs the process of authenticating the user. More precisely, the unit 1056 determines whether the user-ID code, the user password and the like it has received from the client terminal 1002 are contained in the client information that is registered in the client database unit 1054.

The authentication-process unit 1056 may determine that the user of the client terminal 1002 is a legal one. In this case, the unit 1056 issues authentication-cession ID data and the like, under the control of the control unit 1050. The authentication-cession ID data identifies the communication connection condition between the client terminal 1002 and the portal server 1003. The authentication-cession ID data and the like, thus issued for the client terminal 1002, are temporarily stored in the authentication-information storage unit 1057.

The control unit 1050 then transmits the authentication-cession ID data and the like, which have been issued for the client terminal 1002, to the client terminal 1002 by the authentication-process unit 1056, first through the communications control unit 1052 and then through the network interface 1053.

In Step SP1016, the control unit 1023 of the client terminal 1002 receives the authentication-cession ID data and the like from the portal server 1003, first through the network interface 1033 and then through the communications control unit 1032. The authentication-process unit 1037 writes the authentication-cession ID data and the like into the authentication-information storage unit 1038. The unit 1038 temporarily stores the authentication-cession ID data and the like.

The control unit 1023 generates an authentication-ticket issuance request signal, requesting that the portal server 1003 should issue an authentication ticket again. The authentication-ticket issuance request signal is transmitted to the portal server 1003 through the communications control unit 1032 and the network interface 1033, together with the shop code, the authentication-cession ID data, and the like, all temporarily stored in the authentication-information storage unit 1038.

In the present embodiment, the shop code is temporarily stored in the authentication-information storage unit 1038 of the client terminal 1002. Nonetheless, the shop code can be transferred between the client terminal 1002 and the portal server 1003 to perform Steps SP1012 to SP1016. Thus, the shop code can be transmitted to the portal server 1003 in Step SP1016, without the necessity of temporarily storing the shop code in the authentication-information storage unit 1038 of the client terminal 1002.

In Step SP1017, the control unit 1050 of the portal server, 1003 receives the authentication-ticket issuance request signal, the shop code, the authentication-cession ID data, and the like, from the client terminal 1002, first through the network interface 1053 and then through the communications control unit 1052. The control unit 1050 supplies them to the authentication-process unit 1056.

Controlled by the control unit 1050, the authentication-process unit 1056 performs the process of authenticating the user. To be more specific, the unit 1056 compares the authentication-cession ID data and the like it has just received from the client terminal 1002, with the authentication-cession ID data and the like that are temporarily stored in the authentication-information storage unit 1057.

The authentication-process unit 1056 may authenticate the user as a legal user of the client terminal 1002 because the authentication-cession ID data and the like, received from the client terminal 1002, are still valid. If this is the case, the unit 1056 determines that the request for issuing the authentication ticket transmitted from the client terminal 1002 is justifiable.

When the authentication-process unit 1056 authenticates the user as a legal user of the client terminal 1002, the control unit 1050 goes to the next step, Step SP1018.

In Step SP1018, controlled by the control unit 1050, the authentication-process unit 1056 issues an authentication ticket and the like in accordance with the shop code and authentication-ticket issuance request signal it has received from the client terminal 1002 in Step SP1017. The authentication ticket and the like enable the client terminal 1002 to access the music-data distributing server 1004 indicated by the shop code.

Controlled by the control unit 1050, the authentication-process unit 1056 writes the authentication ticket and the like into the authentication-information storage unit 1057, thus temporarily storing them in this storage unit 1057. At the same time, the unit 1056 extends the validation term of the authentication-cession ID data and the like that have been issued to the client terminal 1002.

The control unit 1050 transmits the authentication ticket and the like to the client terminal 1002, first through the communications control unit 1052 and then through the network interface 1052 together with the authentication-cession ID data and the like, whose validation term has been extended by the authentication-process unit 1056.

In Step SP1019, the control unit 1023 of the client terminal 1002 receives the authentication ticket, the authentication-cession ID data, and the like, from the portal server 1003, first through the network interface 1033 and then through the communications control unit 1032. The control unit 1023 supplies the authentication-cession ID data to the authentication-process unit 1037.

The control unit 1023 transmits the authentication ticket and the like it has received from the portal server 1003, together with an authentication request signal, to the music-data distributing server 1004, through the communications control unit 1032 and the network interface 1033.

Controlled by the control unit 1023, the authentication-process unit 1037 writes the authentication-cession ID data and the like which have been transmitted from the portal server 1003 and whose validation term has been extended, over the authentication-cession ID data and the like that are stored authentication-information storage unit 1038. In other words, the authentication-process unit 1037 updates, in the storage unit 1038, the authentication-cession ID data and the like temporarily stored in Step SP1016 to those the validation term of which has been extended.

In Step SP1020, the control unit 1070 of the music-data distributing server 1004 receives the authentication request signal, the authentication ticket, and the like, from the client terminal 1002, first through the network interface 1073 and then through the communications control unit 1072.

The control unit 1070 transmits the authentication ticket, and the like received from the client terminal 1002 to the portal server 1003 through the communication control unit 1072 and the network interface 1073, together with an authentication-ticket confirmation request signal requesting the confirmation of the authentication ticket.

In Step SP1021, the control unit 1050 of the portal server 1003 receives the authentication-ticket confirmation request signal, the authentication ticket and the like from the music-data distributing server 1004, first through the network interface 1053 and then through the communications control unit 1052. The control unit 1050 supplies the authentication-ticket confirmation request signal, the. authentication ticket and the like to the authentication-process unit 1056.

Controlled by the control unit 1050, the authentication-process unit 1056 performs the process of confirming the authentication ticket transmitted from the music-data distributing server 1004, in response to the authentication-ticket confirmation request signal. More correctly, the unit 1056 compares the authentication ticket and the like it has received from the music-data distributing server 1004, with the authentication ticket and the like, which are stored in the authentication-information storage unit 1057.

The authentication-process unit 1056 may confirm that the authentication ticket and the like, which have been received from the music-data distributing server 1004, is a legal one. In this case, the control unit 1050 generates confirmation-result information indicating that the authentication ticket is a legal one. The confirmation-result-information is transmitted to the music-data distributing server 1004, first through the communications control unit 1052 and then through the network interface 1053.

In Step SP1022, the control unit 1070 of the music-data distributing server 1004 receives the confirmation-result information from the portal server 1003, first through the network interface 1073 and then through the communications control unit 1072. The control unit 1070 supplies the confirmation-result information to the authentication-process unit 1075.

Controlled by the control unit 1070, the authentication-process unit 1075 issues a service-cession ID data and the like in response to the confirmation-result information. The service-cession ID data identifies the communication connection condition between the client terminal 1002 and the music-data distributing server 1004 as server-authentication result information. The authentication-process unit 1075 writes the service-cession ID data and the like into the authentication-information storage unit 1077, thus temporarily storing them in the authentication-information storage unit 1077.

Further, the control unit 1070 transmits the service-cession ID data and the like issued by the authentication-process unit 1075 to the client terminal 1002 through the communications control unit 1072 and the network interface 1073. Note that the service-cession ID data and the like have been issued for the client terminal 1002.

In Step SP1023, the control unit 1023 of the client terminal 1002 receives the service-cession ID data and the like from the music-data distributing server 1004, first through the network interface 1033 and then through the communications control unit 1032. The authentication-process unit 1037 writes the service-cession ID data and the like into the authentication-information storage unit 1038, temporarily storing them in the storage unit 1038.

The control unit 1023 then receives a page-information acquisition request signal from the music-data distributing server 1004. The page-information acquisition request signal requests for page information that will be used to have music-data distributed from the music-data distributing server 1004. The control unit 1023 transmits the page-information acquisition request signal to the music-data distributing server 1004 through the communication control unit 1032 and the network interface 1033, together with the service-cession ID data and the like which are temporarily stored in the authentication-information storage unit 1038.

In Step SP1024, the control unit 1070 of the music-data distributing server 1004 receives the page-information acquisition request signal, the service-cession ID data and the like from the client terminal 1002, first through the network interface 1073 and then through the communications control unit 1072. The control unit 1070 then supplies the service-cession ID data and the like to the authentication-process unit 1075.

Controlled by the control unit 1070, the authentication-process unit 1075 compares the service-cession ID data and the like received from the client terminal 2002 with the service-cession ID data and the like that have been issued for the client terminal 1002 in Step SP1022 and temporarily stored into the authentication-information storage unit 1077. Thus, the control unit 1070 performs the process of authenticating the user.

The authentication-process unit 1075 may authenticate the user as a legal user of the client terminal 1002 because the service-cession ID data and the like received from the client terminal 1002 are still valid. If this is the case, the unit 1075 determines that the request for acquiring the page information that has been transmitted from the client terminal 1002 and will be used to distribute music data is justifiable.

When the authentication-process unit 1075 authenticates the user of the client terminal 1002 is a legal one, the control unit 1070 goes to the next step, Step SP1025.

In Step SP1025, the control unit 1070 reads the page information from the page-information storage unit 1076, so that music data may be distributed to the user. Further, the control unit 1070 causes the authentication-process unit 1075 to extend the validation term of the service-cession ID data and the like issued to the client terminal 1002.

Then, the control unit 1070 transmits the page information for use in distributing music data from the page-information storage unit 1076, to the client terminal 1002 through the communications control unit 1072 and the network interface 1073. The page information is transmitted to the client terminal 1002, together with the service-cession ID data and the like whose validation term has been extended by the authentication-process unit 1075.

In Step SP1026, the control unit 1023 of the client terminal 1002 receives, through the network interface 1033 and communications control unit 1032, the page information for use in distributing music data transmitted from the music-data distributing server 1004 and also the service-cession ID data and the like whose validation term has been extended. The control unit 1023 supplies the page information for use in distributing music data, to the page-information generating unit 1036. At the same time, the control unit 1023 transmits the service-cession ID data and the like to the authentication-process unit 1037. Note that the service-cession ID data and the like have been received from the music-data distributing server 1004.

Controlled by the control unit 1023, the authentication-process unit 1037 writes the service-cession ID data and the like which have been transmitted from the music-data distributing server 1004 and whose validation term has been extended, over the service-cession ID data and the like that are stored in the authentication-information storage unit 1038. In other words, the authentication-process unit 1037 updates, in the storage unit 1038, the service-cession ID data and the like temporarily stored in above-described Step SP1023 to those the validation term of which has been extended.

The page-information generating unit 1036 generates video data from the page information for use in distributing music data. The video data thus generated is supplied to the display control unit 1024.

The display control unit 1024 performs digital-to-analog conversion on the video data supplied from the page-information generating unit 1036, generating an analog video signal. The analog video signal is supplied to the display unit 1025. The display unit 1025 displays a music-data distributing page that is represented by the analog video signal.

(3-7-3) Process of Providing the Music-Related Service

As described above with reference to FIG. 17, the process of authenticating the user is achieved between the client terminal 1002, one the one hand, and the music-data distributing server 1004, physical-sales server 1005 and radio-data distributing server 1006, on the other hand. This process is followed by the process of providing a music-related service. In the process of providing a music-related service, the client terminal 1002 receives the music-data distributing service, the physical sales service, and the radio-broadcasting information distribution service, by using the page information for distribution of music data, the page information for selling package media and the page information for distributing on-air list information that the client terminal 1002 has acquired from the music-data distributing server 1004, physical-sales server 1005 and radio-data distributing server 1006, respectively. The process of providing a music-related service will be explained, with reference to FIGS. 18 to 21.

(3-7-3-1) Sequence of Process of Providing the Music-Data Distributing Service

The music-data distributing service will be described first, in which the client terminal 1002 can receive music data distributed from the music-data distributing server 1004.

In Step SP1030, the control unit 1023 of the client terminal 1002 receives a control command input at the input-processing unit 1021 to select a part of the music-data distributing page displayed by the display unit 1025. In response to the control command, the control unit 1023 generates a download request signal that requests for the downloading of the music data the user wants.

The control unit 1023 transmits the download request signal to the music-data distributing server 1004 through the communication control unit 1032 and network interface 1033, together with the service-cession ID data and the like, which have been issued by the music-data distributing server 1004 and which are temporarily stored in the authentication-information storage unit 1038.

In Step SP1031, the control unit 1070 of the music-data distributing server 1004 receives the download request signal, the service-cession ID data and the like from the client terminal 1002, first through the network interface 1073 and then through the communications control unit 1072. The control unit 1070 supplies the service-cession ID data and the like to the authentication-process unit 1075.

Controlled by the control unit 1070, the authentication-process unit 1075 compares the service-cession ID data and the like, which have been transmitted from the client terminal 1002, with the service-cession ID data and the like that are temporarily stored in the authentication-information storage unit 1077. Thus, the authentication-process unit 1075 carries out the process of authenticating the user.

The authentication-process unit 1075 may determine that the user who has operated the client terminal 1002, demanding that the music data be downloaded into the client terminal 1002, is a legal user. In this case, the control unit 1070 goes to the next step, Step SP1032.

In Step SP1032, the retrieval unit 1079 retrieves the music data item the user desires, from the music data items that are stored in the music-data storage unit 1078, in accordance with the retrieval key contained in the download request signal. It should be noted that the music data item retrieved accords with the retrieval condition the retrieval key describes.

When the retrieval unit 1079 retrieves the music data item the user desires, the control unit 1070 causes the authentication-process unit 1075 to extend the validation term of the service-cession ID data and the like issued to the client terminal 1002. The control unit 1070 then goes to the next step, i.e., Step SP1033.

In Step SP1033, the control unit 1070 reads from the music-data storage unit 1078 the music data that has been retrieved by the retrieval unit 1079 and that should be downloaded into the client terminal 1002. Further, the control unit 1070 transmits the music data thus read from the storage unit 1078 to the client terminal 1002, first through the communications control unit 1072 and then through, the network interface 1073, along with the service-cession ID data and the like whose validation term has been extended by the authentication-process unit 1075.

In Step SP1034, the control unit 1023 of the client terminal 1002 receives the music data from the music-data distributing server 1004, together with the service-cession ID data and the like whose validation term has been extended, first through the network interface 1033 and then through the communications control unit 1032. The control unit 1023 writes the music data into the storage medium 1029. At the same time, the control unit 1023 supplies the service-cession ID data and the like, which have been received from the music-data distributing server 1004, to the authentication-process unit 1037.

Controlled by the control unit 1023, the authentication-process unit 1037 writes the service-cession ID data and the like which have been transmitted from the music-data distributing server 1004 and whose validation term has been extended, over the service-cession ID data and the like that are stored in the authentication-information storage unit 1038. The authentication-process unit 1037 therefore updates, in the storage unit 1038, the service-cession ID data and the like to those the validation term of which has been extended.

Thus, the client terminal 1002 can download the music data desired by the user, utilizing the music-data distributing service the music-data distributing server 1004 provides.

(3-7-3-2) Sequence of Process of Providing the Physical Sales Service

Figure 19:
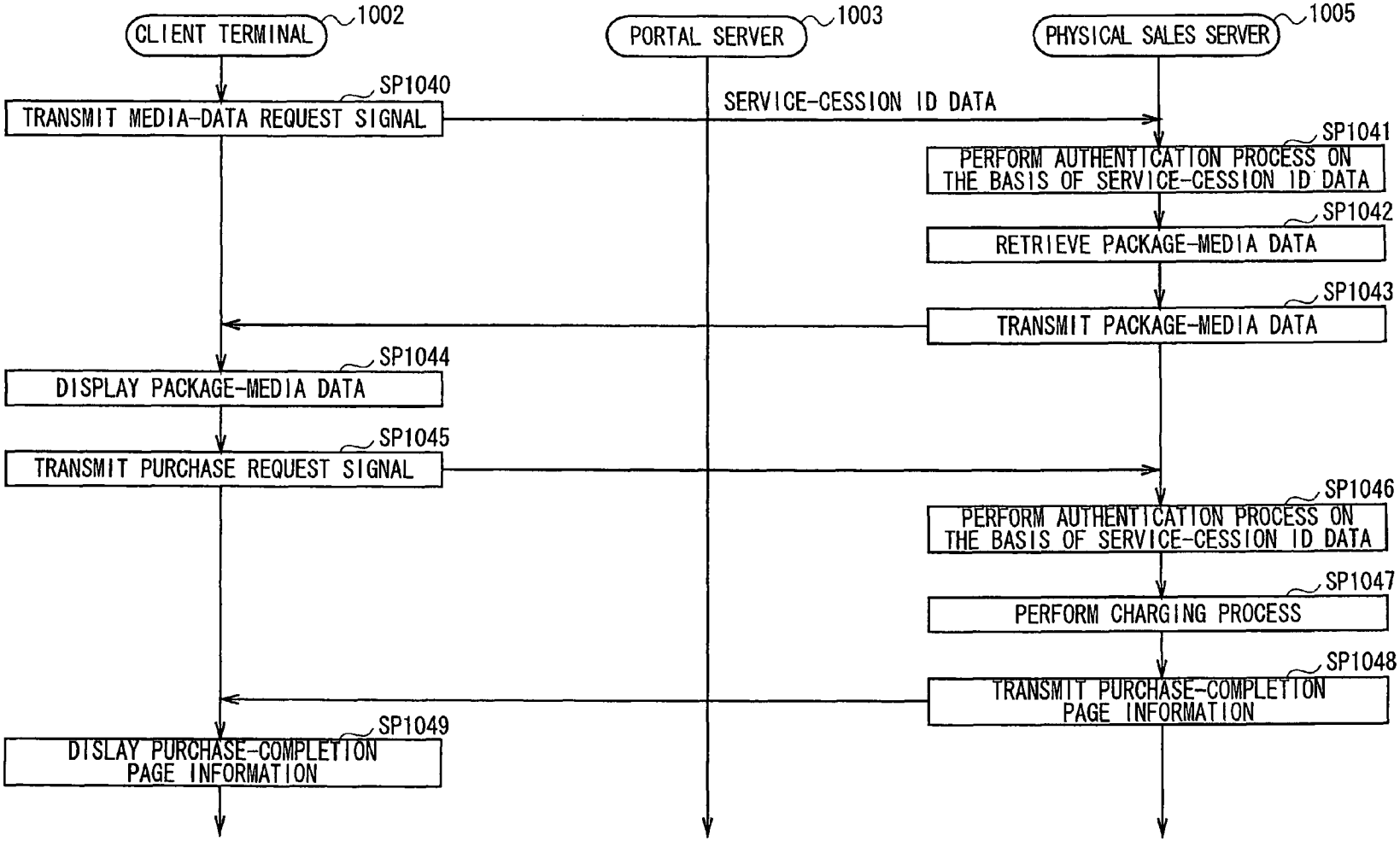
FIG. 19 is a sequence chart representing the sequence of providing the sales service.

The sequence of providing the physical sales service will be described, in which the client terminal 1002 can receive a physical sales service from the physical-sales server 1005, with reference to FIG. 19.

In Step SP1040, the control unit 1023 of the client terminal 1002 receives a control command input at the input-processing unit 1021 to select a part of the package-media sales page displayed by the display unit 1025. In response to the control command, the control unit 1023 generates a media-data request signal that requests for the package-media data about the package medium designated by the control command input.

The control unit 1023 transmits the media-data request signal to the physical-sales server 1005 through the communication control unit 1032 and network interface 1033, together with the service-cession ID data and-the like, which have been issued by the physical-sales server 1005 and which are temporarily stored in the authentication-information storage unit 1038.

In Step SP1041, the control unit 1090 of the physical-sales server 1005 receives the media-data request signal, the service-cession ID data and the like from the client terminal 1002, first through the network interface 1093 and then through the communications control unit 1092. The control unit 1090 supplies the service-cession ID data and the like to the authentication-process unit 1095.

Controlled by the control unit 1090, the authentication-process unit 1095 compares the service-cession ID data and the like, which have been transmitted from the client terminal 1002, with the service-cession ID data and the like that are temporarily stored in the authentication-information storage unit 1097. Thus, the authentication-process unit 1095 carries out the process of authenticating the user.

The authentication-process unit 1095 may determine that the user who has operated the client terminal 1002, demanding that the package-media data be downloaded into the client terminal 1002, is a legal user. In this case, the control unit 1090 goes to the next step, Step SP1042.

In Step SP1042, the retrieval unit 1099 retrieves one of the package-media data item the user desires, from the package-media data item the package-media-data storage unit 1098, in accordance with the retrieval key contained in the media-data request signal. It should be noted that the package-media data item retrieved accords with the retrieval condition the retrieval key describes.

When the retrieval unit 1099 retrieves the package-media data item the user desires, the control unit 1090 causes the authentication-process unit 1095 to extend the validation term of the service-cession ID data and the like issued to the client terminal 1002. The control unit 1090 then goes to the next step, i.e., Step SP1043.

In Step SP1043, the control unit 1090 reads from the package-media-data storage unit 1098 the package-media data item that has been retrieved by the retrieval unit 1099. Further, the control unit 1090 transmits the package-media data item thus read from the storage unit 1098 to the client terminal 1002, first through the communications control unit 1092 and then through the network interface 1093, along with the service-cession ID data and the like whose validation term has been extended by the authentication-process unit 1095.

In Step SP1044, the control unit 1023 of the client terminal 1002 receives the package-media data from the physical-sales server 1005, together with the service-cession ID data and the like whose validation term has been extended, first through the network interface 1033 and then through the communications control unit 1032. The control unit 1023 supplies the package-media data to the page-information generating unit 1036. Further, the control unit 1023 supplies the service-cession ID data and the like, which have been received from the physical-sales server 1005, to the authentication-process unit 1037.

Controlled by the control unit 1023, the authentication-process unit 1037 writes the service-cession ID data and the like which have been transmitted from the physical-sales server 1005 and whose validation term has been extended, over the service-cession ID data and the like that are stored in the authentication-information storage unit 1038. Therefore, the authentication-process unit 1037 updates, in the storage unit 1038, the service-cession ID data and the like to those the validation term of which has been extended.

The page-information generating unit 1036 generates video data from the package-media data supplied to it from the control unit 1023. The video data is supplied to the display control unit 1024. The display control unit 1024 converts the video data, generating an analog video signal. The analog video signal is supplied to the display unit 1025.

Thus, the control unit 1023 causes the display unit 1025 to display package-media data that is represented by the analog video signal. Then, the control unit 1023 goes to the next step, i.e., Step SP1045.

In Step SP1045, the control unit 1023 receives a control command input at the input-processing unit 1021, to buy the package medium identified by the package-media data displayed by the display unit 1025. In response to the control command, the control unit 1023 generates a purchase request signal that requests for buying the package medium identified by the package-media data.

The control unit 1023 transmits the purchase request signal to the physical-sales server 1005, first through the communication control unit 1032 and then through the network interface 1033, together with the service-cession ID data and the like which has been transmitted from the physical-sales server 1005, which is temporarily stored in the authentication-information storage unit 1038 and the validation term of which has been extended.

In Step SP1046, the control unit 1090 of the physical-sales server 1005 receives the purchase request signal, the service-cession ID data and the like from the client terminal 1002, first through the network interface 1093 and then through the communication control unit 1092. The control unit 1090 supplies the service-cession ID data and the like to the authentication-process unit 1095.

Controlled by the control unit 1090, the authentication-process unit 1095 compares the service-cession-ID data and the like, which have been transmitted from the client terminal 1002, with the service-cession ID data and the like that are temporarily stored in the authentication-information storage unit 1097. Thus, the authentication-process unit 1095 carries out the process of authenticating the user of the client terminal 1002.

The authentication-process unit 1095 may determine that the user who has operated the client terminal 1002, demanding that the package-media data be downloaded into the terminal 1002, is a legal user. In this case, the control unit 1090 goes to the next step, Step SP1047.

In Step SP1047, the control unit 1090 transmits charge information to the charging server 1008, first though the communications control unit 1092 and then through the network interface 1093. The charge information will be used to deliver the package medium to the user of the client terminal 1002 and to charge the amount for the package medium the use is to buy. Upon receipt of the charge information, the charging server 1008 performs the process of charging the user for the purchase of the package media.

Further, the control unit 1090 causes the authentication-process unit 1095 to extend-the validation term of the service-cession ID data and the like, which have been issued to the client terminal 1002.

In Step SP1048, the control unit 1090 generates purchase-completion page information and transmits the same to the client terminal 1002, first through the communication control unit 1092 and then through the network interface 1093, together with the service-cession ID data and like whose validation term has been extended by the authentication-process unit 1095. It should be noted that the purchase-completion page information shows that the user has bought the package medium.

In Step SP1049, the control unit 1023 of the client terminal 1002 receives the purchase-completion page information from the physical-sales server 1005, first through the network interface 1033 and then through the communications control unit 1092, together with the service-cession ID data and the like whose validation term has been extended. The control unit 1023 supplies the purchase-completion page information to the page-information generating unit 1036. At the same time, the control unit 1023 supplies the service-cession ID data and the like transmitted from the physical-sales server 1005 to the authentication-process unit 1037.

Controlled by the control unit 1023, the authentication-process unit 1037 writes the service-cession ID data and the like which have been transmitted from the physical-sales server 1005 and whose validation term has been extended, over the service-cession ID data and the like whose validation term has not been-extended, and that are stored in the authentication-information storage unit 1038. Namely, the authentication-process unit 1037 updates, in the storage unit 1038, the service-cession ID data and the like to those the validation term of which has been extended.

The page-information generating unit 1036 generates video data from the purchase-completion page information received from the control unit 1023. The video data thus generated is supplied to the display control unit 1024. The display control unit 1024 performs digital-to-analog conversion on the video data, generating an analog video signal. The analog video signal is supplied to the display unit 1025.

The control unit 1023 causes the display unit 1025 to display the purchase-completion page that is represented by the analog video data.

Thus, the client terminal 1002 utilizes the physical-sales service of the physical-sales server 1005, enabling the user to purchase any package media that he or she wants.

Figure 20:
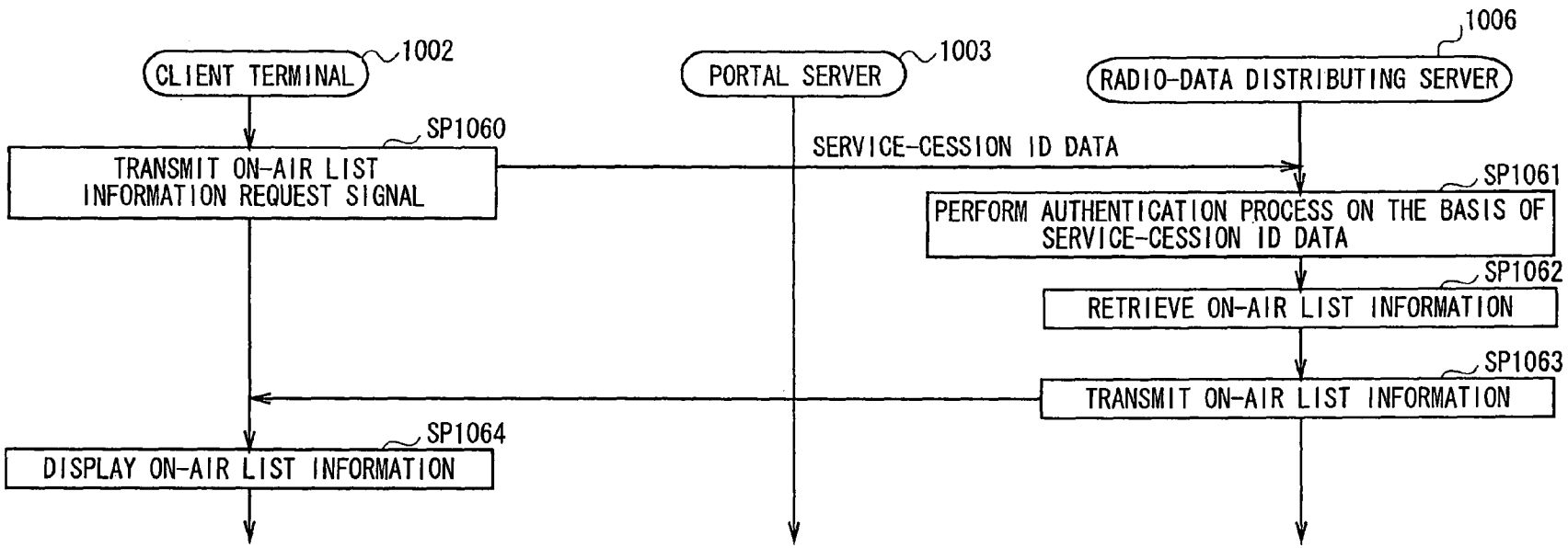
FIG. 20 is a sequence chart representing the sequence (1) of providing the radio-broadcasting information (on-air list)

(3-7-3-3) Sequence of Process of Providing the On-Air List Information Distributing Service The sequence of process of providing the on-air list information distributing service will be described with reference to FIG. 20, in which the client terminal 1002 can receive on-air list information distributing service, as radio broadcasting information distributing service provided by the radio-data distributing server 1006.

In Step SP1060, the control unit 1023 of the client terminal 1002 generates an on-air list information request signal that requests that desired on-air list information be downloaded into the client terminal 1002. The control unit-1023 generates this request signal in response to a control command input at the input-processing unit 1021 when a retrieval key is input in the input box on the page of on-air list information retrieval, which is displayed by the display unit 1025.

The control unit 1023 transmits the on-air list information request signal to the radio-data distributing server 1006, first through the communications control unit 1032 and then through the network interface 1033, together with the service-cession ID data and the like. It should be noted that the service-cession ID data and the like have been issued by the radio-data distributing server 1006 and are temporarily stored in the authentication-information storage unit 1038.

In Step SP1061, the control unit 1110 of the radio-data distributing server 1006 receives the on-air list information request signal, the service-cession ID data and the like from the client terminal 1002, first through the network interface 1113 and then through the communications control unit 1112. The control unit 1110 supplies the service-cession ID data and the like to the authentication-process unit 1115.

Controlled by the control unit 1110, the authentication-process unit 1115 compares the service-cession ID data and the like received from the client terminal 1002, with the service-cession ID data and the like that are temporarily stored in the authentication-information storage unit 1120. Thus, the authentication-process unit 1115 performs the process of authenticating the user of the client terminal 1002.

The authentication-process unit 1115 may determine that the user who has operated the client terminal 1002 to request for the on-air list information is a legal one. In this case, the control unit 1110 goes to the next step, i.e., Step SP1062.

In Step SP1062, the retrieval unit 1118 retrieves, from the on-air list storage unit 1117, that part of the on-air list information which meets the retrieval condition defined by the retrieval key contained in the on-air list information request signal.

When the retrieval unit 1118 retrieves said part of the on-air list information, the control unit 1110 causes the authentication-process unit 1115 to extend the validation term of the service-cession ID data and the like that have been issued to the client terminal 1002. The control unit 1110 then goes to the next step, i.e., Step SP1063.

In Step SP1063, the control unit 1110 reads the on-air list information retrieved by the retrieval unit 1118, from the on-air list storage unit 1117. The control unit 1110 then supplies the on-air list information to the client terminal 1002, first through the communication control unit 1112 and then through the network interface 1113, along with the service-cession ID data and the like whose validation term has been extended by the authentication-process unit 1115.

In Step SP1064, the control unit 1023 of the client terminal 1002 receives the on-air list information from the radio-data distributing server 1006, first through the network interface 1033 and then through the communications control unit 1032, together with the service-cession ID data and the like whose validation term has been extended. The control unit 1023 transmits the on-air list information to the page-information generating unit 1036. At the same time, the control unit 1023 transmits the service-cession ID data and the like received from the radio-data distributing server 1006, to the authentication-process unit 1037.

Controlled by the control unit 1023, the authentication-process unit 1037 writes the service-cession ID data and the like which have been transmitted from the radio-data distributing server 1006 and whose validation term has been extended, over the service-cession ID data and the like that are stored in the authentication-information storage unit 1038. That is, the authentication-process unit 1037 updates, in the storage unit 1038, the service-cession ID data and the like to those the validation term of which has been extended.

The page-information generating unit 1036 generates video data from the on-air list information supplied to it from the control unit 1023. The video data thus generated is supplied to the display control unit 1024. The display control unit 1024 performs digital-to-analog conversion on the video data, generating an analog video signal. The analog video signal is supplied to the display unit 1025. The display unit 1025 displays the on-air list information represented by the analog video data.

Thus, the client terminal 1002 utilizes the radio-broadcasting information distributing service provided by the radio-data distributing server 1006, enabling the user to obtain any on-air list information he or she wants.

Figure 21:
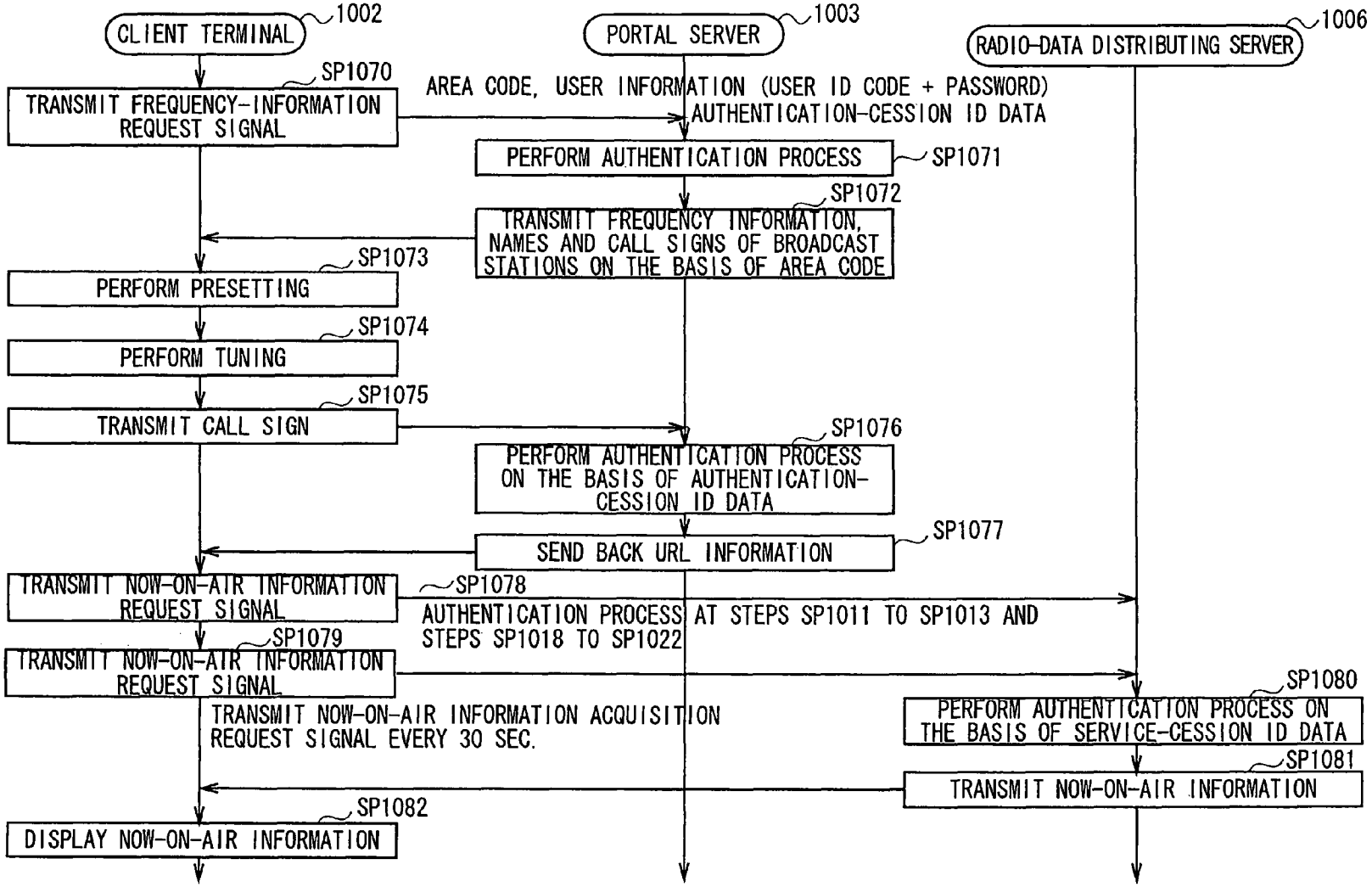
FIG. 21 is a sequence chart representing the sequence (2) of providing the radio-broadcasting information (now-on-air information).

(3-7-3-4) Sequence of Process of Providing the Now-On-Air Information Distributing Service The sequence of process of providing the now-on-air information distributing service will be described with reference to FIG. 21, in which the client terminal 1002 can receive now-on-air information distributing service, as radio-broadcasting information distributing service distributed from the radio-data distributing server 1006.

The radio-data distributing server 1006 that provides now-on-air information is installed in each radio station (that is, for each call sign).

In the initial state, the client terminal 1002 may not store the URL information about the radio-data distributing server 1006 of each radio station.

Therefore, the sequence of the radio-broadcasting information distributing service providing process will be described on the assumption that the portal server 1003 manages the URL information about the radio-data distributing server 1006 of each radio station, in association with the call sign of the radio station.

It is also assumed that, in the sequence of the radio-broadcasting information distributing service providing process, the authentication-information storage unit 1038 does not store the authentication-cession ID data or the like when the client terminal 1002 requests that the portal server 1003 should give it the broadcast frequency information so that it may automatically preset the broadcast frequency of each radio station. Hence, the client terminal 1002 first transmits the user ID code, the user password and the like to the portal server 1003.

In Step SP1070, the control unit 1023 of the client terminal 1002 receives an operation command that the user has input at the input-processing unit 1021 to automatically preset the broadcast frequency of each radio station. In response to the operation command, the control unit 1023 transmits a frequency-information request signal to the portal server 1003, first through the communications control unit 1032 and then through the network interface 1033. The frequency-information request signal, which requests for the frequency information representing the broadcast frequency of the radio station, is transmitted together with the area code input by the user and the user ID codes, the user password, and the like stored in the authentication-information storage unit 1038.

In Step SP1071, the control unit 1050 of the portal server 1003 receives the frequency-information request signal, the user ID code, the user password and the like, all transmitted from the client terminal 1002, first through the network interface 1053 and then through the communications control unit 1052. The control unit 1050 supplies the user ID code, the user password and the like, which have been received from the client terminal 1002, to the authentication-process unit 1056.

Controlled by the control unit 1050, the authentication-process unit 1056 compares the user ID code, the user password and the like, all received from the client terminal 1002, with the client information that is registered in the client database unit 1054. The authentication-process unit 1056 thus carries out the process of authenticating the user of the client terminal 1002.

The authentication-process unit 1056 may determine that the user of the client terminal 1002 is a legal one and that the frequency-information request signal transmitted from the client terminal 1002 is justifiable. In this case, the authentication-process unit 1056 issues an authentication-cession ID data and the like, which identifies the communication condition between the client terminal 1002 and the portal server 1003. The authentication-cession ID data and the like, thus issued, are temporarily stored in the authentication-information storage unit 1057.

When the authentication-process unit 1056 determines that the user of the client terminal 1002 is a legal one, the control unit 1050 goes to the next step, i.e., Step SP1072.

In Step SP1072, the control unit 1050 extracts the information (postal code, address, phone number, etc.) about the area, from the user-set information that is registered in the client database unit 1054, in accordance with the user ID code received from the client terminal 1002 and selects as area code corresponding to the user. The control unit 1050 then retrieves the frequency data items, the names of radio stations and the call signs, all pertaining to the area code, from the frequency-data storage unit 1058. The frequency data items, the names of radio stations, and the call signs are read in the form of a list.

The control unit 1050 may not select the area code in accordance with the user-set information registered in the client database unit 1054. Instead, the client terminal 1002 may transmit an area code to the portal server 1003. In this case, the control unit 1050 retrieves the frequency data items, radio-station names and call signs from the frequency-data storage unit 1058 and then reads them in the form of a list.

The control unit 1050 transmits the list of frequency data items, radio-station names and call signs, which have been read from the frequency-data storage unit 1058, to the client terminal 1002, first through the communications control unit 1052 and then through the network interface 1053. The list is transmitted to the client terminal 1002, together with the authentication-cession ID data and the like that the authentication-process unit 1056 has issued in Step SP1071 to the client terminal 1002.

In Step SP1073, the control unit 1023 of the client terminal 1002 receives the frequency data items, the names of radio stations, the call-sign list, the authentication-cession ID data, and the like from the portal server 1003, first through the network interface 1033 and then through the communications control unit 1032. The control unit 1023 supplies the authentication-cession ID data and the like received from the portal server 1003, to the authentication-process unit 1037. Further, the control unit 1023 supplies the frequency data items, the names of radio stations, and the call-sign list, received also from the client terminal 1002, to the display control unit 1024.

Controlled by the control unit 1023, the authentication-process unit 1037 writes the authentication-cession ID data and the like transmitted from the portal server 1003 into the authentication-information storage unit 1038. Thus, the storage unit 1038 temporarily stores the authentication-cession ID data and the like.

The display control unit 1024 supplies the frequency data items, the names of radio stations, and the call-sign list, all received from the control unit 1023, to the display unit 1025. The display unit 1025 displays the list of the frequency data items, radio-station names and call signs.

When a selection command is input at the input-processing unit 1021, the control unit 1023 writes the frequency information item, radio-station name and call sign, which are selected by the user, into the storage medium 1029, thus presetting these values. Then, the control unit 1023 goes to the next step, i.e., Step SP1074.

In Step SP1074, the control unit 1023 controls the tuner unit 1031 in accordance with the turning-control command input at the input-processing unit 1021. That is, the control unit 1023 causes the tuner unit 1031 to extract, from the radio broadcast waves, the radio signal broadcast at the broadcast frequency that corresponds to the turning-control command.

The tuner unit 1031 decodes the radio signal broadcast at that frequency, generating audio data. The audio data is supplied to the audio-data control unit 1026.

The audio-data control unit 1026 converts the audio data supplied from the tuner unit 1031, to an analog audio signal. The analog audio signal is supplied to the speaker 1027. The speaker 1027 generates sound from the analog audio signal. The user can therefore listen to the radio program he or she has selected.

In Step SP1075, the radio-broadcast display control unit 1039 is controlled by the control unit 1023, reading the call sign stored in the storage medium 1029 and associated with the frequency information representing the broadcast frequency that corresponds to the tuning-control command. The radio-broadcast display control unit 1039 transmits the call sign to the portal server 1003, together with the authentication-cession ID data and the like that are temporarily stored in the storage unit 1038, first through the communications control unit 1032 and then through the network interface 1033.

In Step SP1076, the control unit 1050,of the portal server 1003 receives the call sign, the authentication-cession ID data, and the like, all transmitted from the client terminal 1002, first through the network interface 1053 and then through the communications control unit 1052. The control unit 1050 then supplies the authentication-cession ID data and the like to the authentication-process unit 1056.

Controlled by the control unit 1050, the authentication-process unit 1056 compares the authentication-cession ID data and the like received from the client terminal 1002, with the authentication-cession ID data and the like that are temporarily stored in the authentication-information storage unit 1057. Thus, the authentication-process unit 1056 carries out the process of authenticating the user of the client terminal 1002.

The authentication-process unit 1056 may determine that the authentication-cession ID data and the like received from the client terminal 1002 are still valid and that the user who has operated the client terminal 1002 to transmit the call sign is a legal one. If this is the case, the control unit 1050 goes to the next step, i.e., Step SP1077.

In Step SP1077, the control unit 1050 selects and retrieves one of the URL data items stored in the URL storage unit 1059, which is associated with the call sign received from the client terminal 1002.

The control unit 1050 causes the authentication-process unit 1056 to extend the validation term of the authentication-cession ID data and the like which have been issued to the client terminal 1002.

The control unit 1050 then reads the URL information retrieved, from the URL storage unit 1059. The control unit 1050 transmits the URL information to the client terminal 1002 through the communications control unit 1052 and the network interface 1053, together with the authentication-cession ID data and the like whose validation term has been extended.

In Step SP1078, the control unit 1023 of the client terminal 1002 receives the URL information, and the authentication-cession ID data and the like whose validation term has been extended, from the portal server 1003, first through the network interface 1033 and then through the communications control unit 1032. The authentication-cession ID data and the like are supplied to the authentication-process unit 1037, and the ULR information are supplied to the radio-broadcast display control unit 1039.

Controlled by the control unit 1023, the authentication-process unit 1037 writes the authentication-cession ID and the like which have been transmitted from the portal server 1003 and whose validation term has been extended, over the authentication-cession ID data and the like whose validation term has not been extended and that are stored in the authentication-information storage unit 1038. That is, the authentication-process unit 1037 updates, in the storage unit 1038, the authentication-cession ID data and the like to those the validation term of which has been extended.

Controlled by the control unit 1023, the radio-broadcast display control unit 1039 writes the URL information supplied from the control unit 1023, into, for example, the storage medium 1029. The storage medium 1029 temporarily stores the URL information in association with the call sign.

Controlled by the control unit 1023, the radio-broadcast display control unit 1039 transmits a now-on-air information request signal to the radio-data distributing server 1006 in accordance with the URL-information temporarily stored in, for example, the storage medium 1029. The now-on-air information request signal is transmitted to the radio-data distributing server 1006, first through the communications control unit 1032 and then through the network interface 1033, together with the service-cession ID data and the like that have been transmitted from the radio-data distributing server 1006 and are now temporarily stored in the authentication-information storage unit 1038.

In the sequence of the radio-broadcasting information distributing service providing process, the process (Step SP1078) of transmitting the now-on-air information request signal, the service-cession ID data and the like from the client terminal 1002 to the radio-data distributing server 1006 corresponds to Step SP1010 that has been described with reference to FIG. 17.

Figure 17:
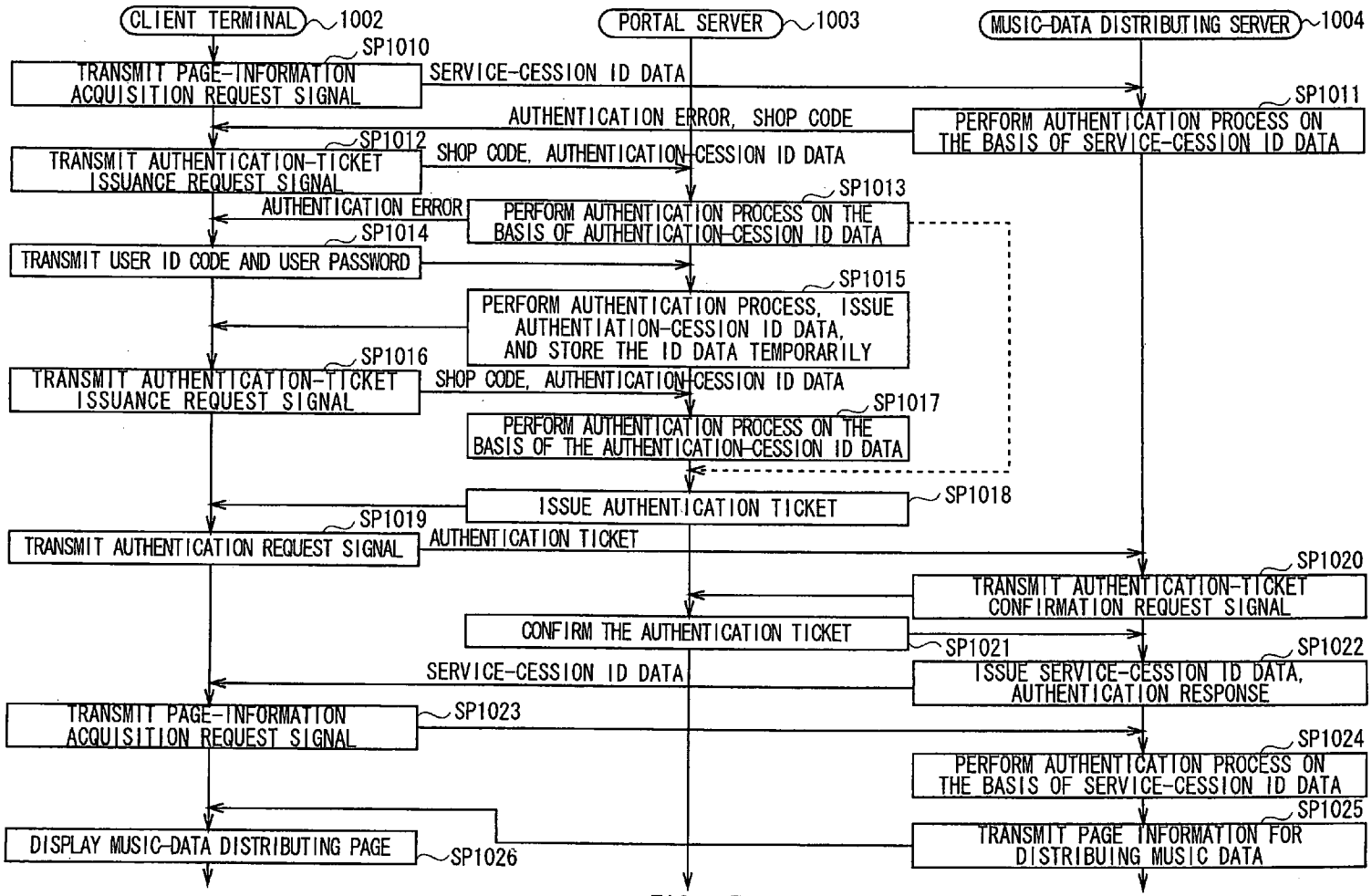
FIG. 17 is a sequence chart illustrating the sequence of verifying the user, accomplished between the client terminal and the music-data distributing server.
Figure 18:
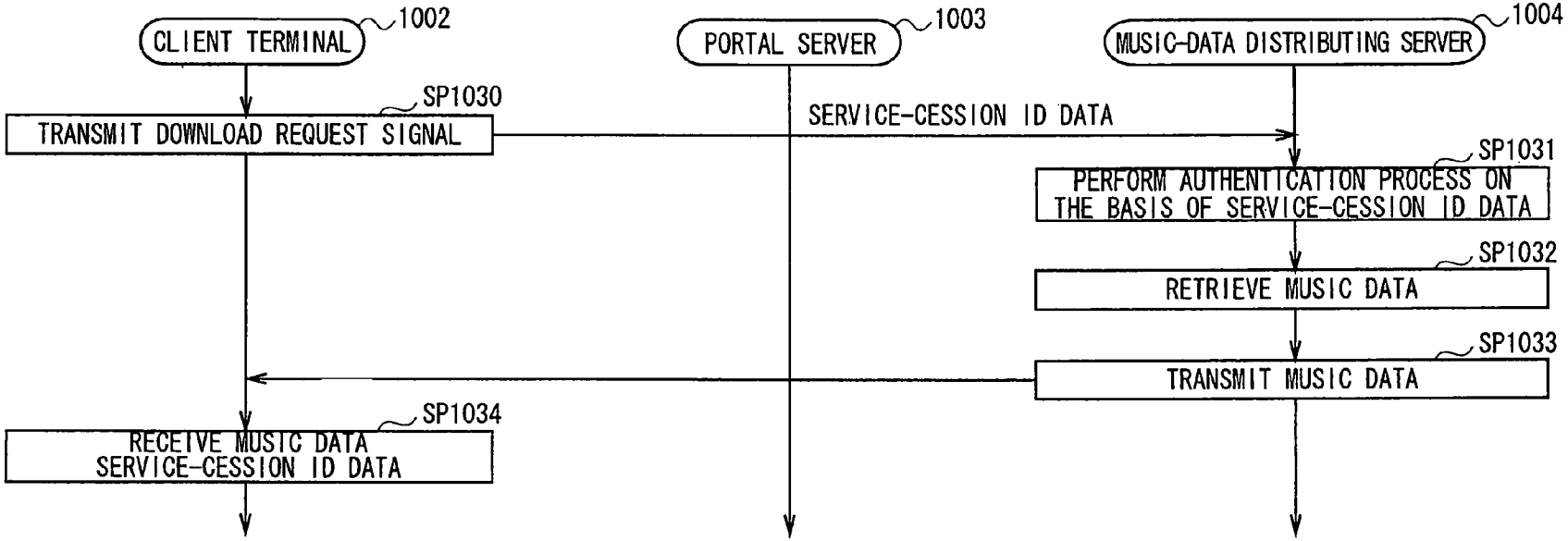
FIG. 18 is a sequence chart representing the sequence of distributing music data.

Hence, in the sequence of the radio-broadcasting information distributing service providing process, the process of authenticating the user, which is similar to Steps SP1011 to SP1013 and Steps SP1018 to SP1022 shown in FIG. 17, is carried out in the client terminal 1002, radio-data distributing server 1006 and portal server 1003 after the process of Step SP1078. Thereafter, the operation goes to Step SP1079.

In Step SP1079, the control unit 1023 of the client terminal 1002 controls the radio-broadcast display control unit 1039, causing the unit 1039 to transmit the now-on-air information request signal to the radio-data distributing server 1006 in accordance with the URL information temporarily stored in, for example, the storage medium 1029. The now-on-air information request signal is transmitted to the server 1006, first through the communication control unit 1032 and then through the network interface 1033, together with the service-cession ID data and the like that have been received from the radio-data distributing server 1006 and are now temporarily stored in the authentication-information storage unit 1038.

In Step SP1080, the control unit 1110 of the radio-data distributing server 1006 receives the now-on-air information request signal, the service-cession ID data and the like from the client terminal 1002, first through the network interface 1113 and then through the communications control unit 1112. The control unit 1110 supplies the service-cession ID data and the like to the authentication-process unit 1115.

Controlled by the control unit 1110, the authentication-process unit 1115 compares the service-cession ID data and the like received from the client terminal 1002, with the service-cession ID data and the like that are temporarily stored in the authentication-information storage unit 1120. Thus, the authentication-process unit 1115 carries out the process of authenticating the user of the client terminal 1002.

The authentication-process unit 1115 may determine that the user of the client terminal 1002 is a legal one. In this case, the unit 1115 determines that now-on-air information request signal transmitted from the client terminal 1002 is justifiable.

When the authentication-process unit 1115 determines that the user of the client terminal 1002 is a legal one, the control unit 1110 causes the authentication-process unit 1115 to extend the validation term of the service-cession ID data and the like issued to the client terminal 1002. The control unit 1110 then goes to the next step, i.e., Step SP1081.

In Step SP1081, the control unit 1110 reads the now-on-air information from the now-on-air information storage unit 1119. The control unit 1110 then transmits the now-on-air information to the client terminal 1002, first through the communications control unit 1112 and then through the network interface 1113, along with the service-cession ID data and the like whose validation term has been extended by the authentication-process unit 1115.

In Step SP1082, the control unit 1023 of the client terminal 1002 receives the now-on-air information, and the service-cession ID data and the like, whose validation term has been extended, from the radio-data distributing server 1006, first through the network interface 1033 and then through the communications control unit 1032. The control unit 1023 supplies the service-cession ID data and the like to the authentication-process unit 1037, and the now-on-air information to the radio-broadcast display control unit 1039.

Controlled by the control unit 1023, the authentication-process unit 1037 writes the service-cession ID data and the like which have been transmitted from the radio-data distributing server 1006 and whose validation term has been extended, over the service-cession ID data and the like that are temporarily stored in the authentication-information storage unit 1038 and whose validation has not been extended. That is, the authentication-process unit 1037 updates, in the storage unit 1038, the service-cession ID data and the like to those the validation term of which has been extended.

The radio-broadcast display control unit 1039 supplies the now-on-air information received from the control unit 1023, to the display unit 1025 through the display control unit 1024. The display unit 1025 displays the now-on-air information about the radio programs that the client terminal 1002 is receiving at the moment.

In the sequence of the radio-broadcasting information distributing service providing process, the client terminal 1002 thereafter repeats the process of transmitting the now-on-air information request signal in Step SP1079 at specific intervals (e.g., 30 seconds). Moreover, the radio-data distributing server 1006 performs Steps SP1080 and SP1081 in response at the request of the client terminal 1002.

Thus, the display unit 1025 of the client terminal 1002 can display the now-on-air information, which is updated from time to time and which shows the name, on-air start time and on-air end time of each radio program and also the title of the music being broadcast in the program, the name of the artist who plays the music, the on-air start time of the music, and the like.

In the second embodiment, the client terminal 1002 can acquire the now-on-air information from any radio station, and the display unit 1025 of the-terminal 1002 displays this information, even if the broadcast station is not tuned in Step SP1074. This is because the client terminal 1002, portal server 1003 and radio-data distributing server 1006 cooperate, performing Steps SP1075 to SP1082, one after another, for any radio station that is preset in the client terminal 1002 in Step SP1073.

Configured as described above, the service-providing system 1000 according the second embodiment, that offers service relating to music, can achieve the same advantages as the first embodiment.

(4) Other Embodiments

In the first and second embodiments described above, the user-set information, including the postal code, address, phone number, etc. of the user, is registered, in on-line fashion, in the integrated service server 10 and the portal server 1003 through the network NT1000. Instead, the user-set information can be registered in off-line fashion, for example by mail.

The various processes performed in the first and second embodiments may be described in an information-processing program. Then, a computer can execute the information-processing program, to carry out the processes.

The program describing the processes performed in the first and second embodiments may be recorded in a computer-readable recording medium. The computer-readable recording medium may be a magnetic recording apparatus, an optical disc, a magneto-optical recording medium, a semiconductor memory, and the like. The magnetic recording apparatus may be a hard disk drive (HDD), a flexible disc (FD), magnetic tape, and the like. The optical disc may be a DVD (Digital Versatile Disc), a DVD-RAM, a CD-ROM (Read-Only Memory), a CD-R (Recordable)/RW (Rewritable), and the like. The magneto-optical recording medium may be an MO (Magneto-Optical disc).

To execute the program, the computer reads the program recorded in a portable recording medium and stores the program into the storage apparatus incorporated in it. Alternatively, the computer receives the program from a server computer and stores the program into the storage apparatus. In either case, the computer executes the program stored in the storage apparatus. The computer may execute the program it has read directly from the portable recording medium. In addition, the computer can perform the processes described in any program that has been transferred to it from the server computer.

In the first and second embodiments described above, the terminal apparatus 20 and the client terminal 1002 can receive the radio programs broadcast by radio stations. Nonetheless, they can receive the related information and information about the radio programs broadcast via the Internet or by broadcast satellites. Moreover, they can receive television programs broadcast by television stations. Further, they can receive the information about the television programs, from a server on the Internet.

Hardware circuit blocks, function-circuit blocks and program modules, which are identical to those of the terminal apparatus 20 (first embodiment) or the client terminal 1002 (second embodiment) may be incorporated into terminals of other types. Then, any other terminal having such blocks and modules can perform the same processes as the terminal apparatus 20 or the client terminal 1002 does.

In the second embodiment, the portal server 1003 that is an information-processing apparatus comprises the client database unit 1054, frequency-data storage unit 1058, control unit 1050 and communications control unit 1052. The client database unit 1054 is a means for storing the user-set information. The frequency-data storage unit 1058 is a means for storing the broadcast station information. The control unit 1050 is a detecting means. The communications control unit 1052 is a transmitting/receiving means. The present invention is not limited to the second embodiment. Rather, other types of means for storing the user-set information, means for storing the broadcast station information, detecting means and transmitting/receiving means may be combined to constitute an information-processing apparatus.

INDUSTRIAL APPLICABILITY

The present invention can be used not only in a network system that provides service relating to music, but also in various network systems that provides, for example, video contents.

The invention claimed is:

1. An information-processing apparatus to be connected via a network to a broadcast terminal apparatus, the information-processing apparatus comprising:

user-set information storing means for storing set information including information identifying an area of operation of the broadcast terminal apparatus and a user ID;

broadcast-station information storing means for storing broadcast-station information in association with an area in which broadcast signals output by a plurality of broadcast stations can be received, said broadcast-station information including names or identification data items of the plurality of broadcast stations;

means for extracting the area of operation of the broadcast terminal apparatus in response to a reception of the user ID and a password, and for retrieving the names or the identification data items of the plurality of broadcast stations, based on the area of operation of the broadcast terminal apparatus and the area in which the broadcast signals can be received; and transmitting/receiving means for receiving the reception of the user ID and the password, and for transmitting at least one of the names or at least one of the identification data items of the plurality of broadcast stations to the broadcast terminal apparatus.

2. The information-processing apparatus according to claim 1, wherein the set information is set when the information-processing apparatus starts a providing service of the at least one of the names or the at least one of the identification data items to the broadcast terminal apparatus.

3. The information-processing apparatus according to claim 1, wherein the means for retrieving correlates the area of operation with the area in which the broadcast signals can be received.

4. The information-processing apparatus according to claim 1, wherein the transmitting/receiving means transmits information request data to the broadcast terminal apparatus and acquires information about the area of operation from the broadcast terminal apparatus.

5. An information-processing method for use in an information-processing apparatus to be connected via a network to a broadcast terminal apparatus, the information-processing method comprising:

storing set information including information identifying an area of operation of the broadcast terminal apparatus and a user ID, and broadcast-station information for a plurality of broadcast stations in association with an area in which broadcast signals output by the plurality of broadcast stations can be received, said broadcast-station information including names or identification data items of the plurality of broadcast stations;

receiving the user ID and a password;

extracting the area of operation of the broadcast terminal apparatus in response to the receiving;

retrieving, based on the area of operation of the broadcast terminal apparatus and the area in which the broadcast signals can be received, the names or the identification data items of the plurality of broadcast stations; and transmitting at least one of the names or at least one of the identification data items to the broadcast terminal apparatus.

6. The information-processing method according to claim 5, wherein the broadcast terminal apparatus is configured to communicate with a related-information server and an authentication server, said related-information server providing related information based on the identification data items;

the related-information server receives a request for the related information and service-session ID data from the broadcast terminal apparatus, said service-session ID data identifying a session between the broadcast terminal apparatus and the related-information server;

the related-information server performs an authentication process based on the service-session ID data, and, when the authentication process fails, the related-information server transmits data indicating an authentication error and a shop code identifying the related-information server to the broadcast terminal apparatus;

the authentication server receives, from the broadcast terminal apparatus, a request for an authentication ticket to access the related-information server and the shop code, and authentication-session ID data;

the authentication server performs an authentication process based on the authentication-session ID data, and, when an authentication is successful, issues and transmits an authentication ticket to the broadcast terminal apparatus;

the related-information server receives the authentication ticket from the broadcast terminal apparatus and transmits the authentication ticket to the authentication server;

the authentication server transmits confirmation success data to the related-information server when a confirmation of the authentication ticket is successful;

upon receiving the confirmation success data, the related-information server issues updated service-session ID data identifying the session between the broadcast terminal apparatus and the related-information server and transmits the updated service-session ID data to the broadcast terminal apparatus; and the related-information server transmits the related information to the broadcast terminal apparatus in response to the request for the related information when the broadcast terminal apparatus is authenticated.

7. The information-processing method according to claim 6, wherein the authentication server performs an authentication process, and, when the authentication process of the authentication server fails, the authentication server transmits data indicating a failure to the broadcast terminal apparatus;

the authentication server performs the authentication process of the authentication server based on the user ID and the password which are transmitted from the broadcast terminal apparatus, and issues authentication-session ID data that identifies a session between the broadcast terminal apparatus and the authentication server; and the authentication server receives, from the broadcast terminal apparatus, the request for the authentication ticket and the authentication-session ID data identifying the session between the broadcast terminal apparatus and the authentication server after transmitting the authentication-session ID data identifying the session between the broadcast terminal apparatus and the authentication server to the broadcast terminal apparatus.

8. A non-transitory, computer readable medium encoded with an information-processing program that, when executed in an information-processing apparatus to be connected via a network to a broadcast terminal apparatus, causes the information-processing apparatus to perform a method comprising:

storing set information including information identifying an area of operation of the broadcast terminal apparatus and a user ID, and broadcast-station information in association with an area in which broadcast signals output by a plurality of broadcast stations can be received, said broadcast-station information containing names or identification data items of the plurality of broadcast stations;

receiving the user ID and a password;

extracting the area of operation of the broadcast terminal apparatus in response to the receiving;

retrieving, based on the area of operation of the broadcast terminal apparatus and the area in which the broadcast signals can be received, the names or the identification data items of the plurality of broadcast stations; and transmitting at least one of the names or at least one of the identification data items to the broadcast terminal apparatus.

9. The information-processing apparatus according to claim 1, wherein the set information is received from the broadcast terminal apparatus.

10. An information-processing apparatus to be connected via a network to a broadcast terminal apparatus, the information-processing apparatus comprising:

a user-set information storing unit configured to store set information including information identifying one or more areas of operation of the broadcast terminal apparatus and a user ID;

a broadcast-station information storing unit configured to store broadcast-station information in association with an area in which broadcast signals output by a plurality of broadcast stations can be received, said broadcast-station information including names or identification data items of the plurality of broadcast stations;

a detecting unit configured to extract the one or more areas of operation of the broadcast terminal apparatus in response to a reception of the user ID and a password, and to retrieve the names or the identification data items of the plurality of broadcast stations, based on the one of the one or more areas of operation of the broadcast terminal apparatus and the area in which the broadcast signals can be received; and a transmitting/receiving unit configured to receive the reception of the user ID and the password, and to transmit a transmission of at least one of the names or at least one of the identification data items of the plurality of broadcast stations to the broadcast terminal apparatus.

* * * * *